US007887177B2

(12) United States Patent
Doi et al.

(10) Patent No.: US 7,887,177 B2
(45) Date of Patent: Feb. 15, 2011

(54) INK-RECIPIENT PARTICLE, MATERIAL FOR RECORDING, RECORDING APPARATUS AND STORAGE MEMBER FOR INK-RECIPIENT PARTICLE

(75) Inventors: Takatsugu Doi, Kanagawa (JP); Masaya Ikuno, Kanagawa (JP); Ken Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 823 days.

(21) Appl. No.: 11/891,833

(22) Filed: Aug. 13, 2007

(65) Prior Publication Data

US 2008/0055381 A1 Mar. 6, 2008

(30) Foreign Application Priority Data

Sep. 1, 2006 (JP) ..... 2006-237903
Oct. 4, 2006 (JP) ..... 2006-273097

(51) Int. Cl.
*B41J 2/01* (2006.01)

(52) U.S. Cl. ..... 347/103

(58) Field of Classification Search ..... 347/86, 347/101, 103
See application file for complete search history.

(56) References Cited

U.S. PATENT DOCUMENTS 6,283,031 B1 * 9/2001 Kakuta et al. ..... 101/466
6,716,562 B2 * 4/2004 Uehara et al. ..... 430/125.3
2007/0222811 A1 * 9/2007 Yanagi ..... 347/21

FOREIGN PATENT DOCUMENTS

| | | |
|---|---|---|
| JP | 11-188858 | 7/1999 |
| JP | 2000-94654 | 4/2000 |
| JP | 2000-343808 | 12/2000 |
| JP | 2002-321443 | 11/2002 |
| JP | 2002-370347 | 12/2002 |
| JP | 2003-057967 | 2/2003 |

* cited by examiner

*Primary Examiner*—Daniel Petkovsek
(74) *Attorney, Agent, or Firm*—Fildes & Outland, P.C.

(57) ABSTRACT

A recording apparatus comprises: an intermediate transfer body; a releasing agent supply device that supplies a releasing agent onto the intermediate transfer body; a particle supply device that supplies hydrophilic ink-recipient particles that receive an ink, onto the releasing agent supplied onto the intermediate transfer body; an ink ejection device that ejects the ink onto the ink-recipient particles supplied onto the intermediate transfer body; and a transfer device that transfers the ink-recipient particles that received the ink, onto a recording medium from the intermediate transfer body, the releasing agent comprising at least one selected from the group consisting of a silicone oil, a fluorinated oil and an organic compound having a solubility parameter (SP value) of about 11 or less.

7 Claims, 12 Drawing Sheets

INK-RECIPIENT PARTICLE, MATERIAL FOR RECORDING, RECORDING APPARATUS AND STORAGE MEMBER FOR INK-RECIPIENT PARTICLE

CROSS REFERENCE TO RELATED APPLICATIONS

This application claims priority under 35USC 119 from Japanese Patent Application Nos. 2006-237903 filed Sep. 1, 2006 and 2006-273097 filed Oct. 4, 2006, the disclosures of which are incorporated herein by reference.

BACKGROUND

1. Technical Field

The present invention relates to a recording apparatus and ink-recipient particles. And also, the invention relates to a material for recording and recording apparatus taking advantage of the ink-recipient particles, and a storage member for the ink-recipient particles.

2. Related Art

An ink-jet recording method is one of recording methods of images and data using an ink. In principle, a liquid or a molten solid ink is ejected from a nozzle, slit or porous film, and an image is recorded on a paper sheet, cloth or film in the ink-jet recording method. Examples of the method for ejecting the ink that has been proposed include a so-called charge control method in which the ink is ejected by taking advantage of an electrostatic attraction force, a so-called drop-on-demand method (a pressure pulse method) in which the ink is ejected by taking advantage of vibration pressure of a piezoelectric element, and a so-called heat ink-jet method in which the ink is ejected by taking advantage of a pressure generated by forming bubbles by heating at a high temperature followed by allowing the bubbles to grow. Recorded matters of highly precise images and data may be obtained by these methods.

In the recording methods using the ink including the ink-jet recording method, it is proposed to transfer an image to a recording medium such as permeable medium and non-permeable medium after the image has been recorded on an intermediate body.

SUMMARY

According to an aspect of the invention, there is provided a recording apparatus comprising: an intermediate transfer body; a releasing agent supply device that supplies a releasing agent onto the intermediate transfer body; a particle supply device that supplies hydrophilic ink-recipient particles that receive an ink, onto the releasing agent supplied onto the intermediate transfer body; an ink ejection device that ejects the ink onto the ink-recipient particles supplied onto the intermediate transfer body; and a transfer device that transfers the ink-recipient particles that received the ink, onto a recording medium from the intermediate transfer body, the releasing agent comprising at least one selected from the group consisting of a silicone oil, a fluorinated oil and an organic compound with a solubility parameter (SP value) of about 11 or less.

According to another aspect of the invention, there is provided ink-recipient particles comprising: a hydrophilic organic resin having a polar monomer at a ratio of from about 10 mol % to about 90 mol % relative to all monomer components thereof; and one or both of a water-repellent first organic material that is a solid at room temperature and has a melting point of about 150° C. or lower and a water-repellent second organic material that is a liquid at room temperature, wherein the ink-recipient particles receive an ink

DETAILED DESCRIPTION

Figure 1:
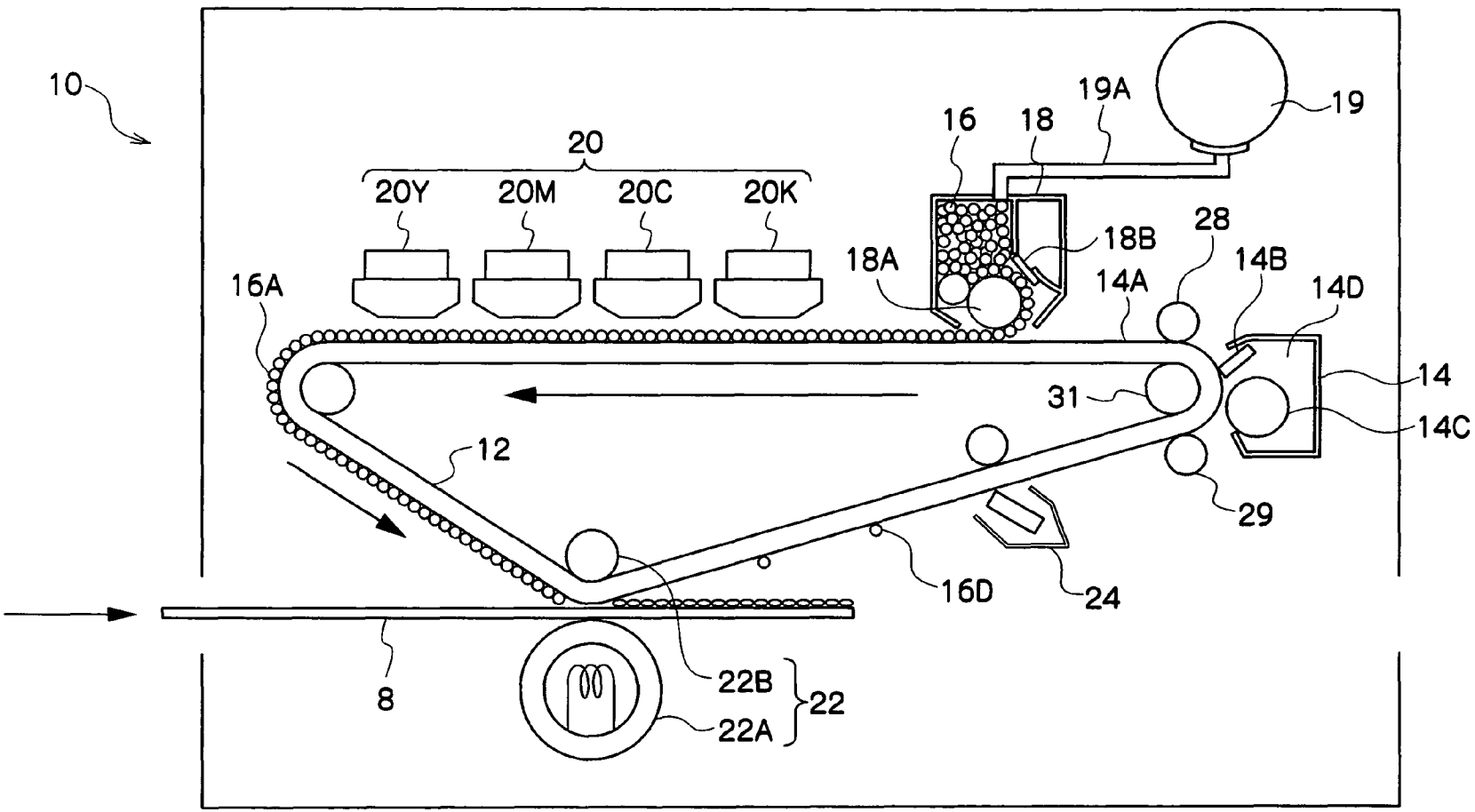
FIG. 1 shows a recording apparatus according to the first exemplary embodiment of the invention.

Exemplary embodiments of the invention will be described below with reference to drawings. The same members having the same functions are given the same reference numeral throughout the drawings, and overlapped descriptions are omitted occasionally.

First Exemplary Embodiment

Figure 2:
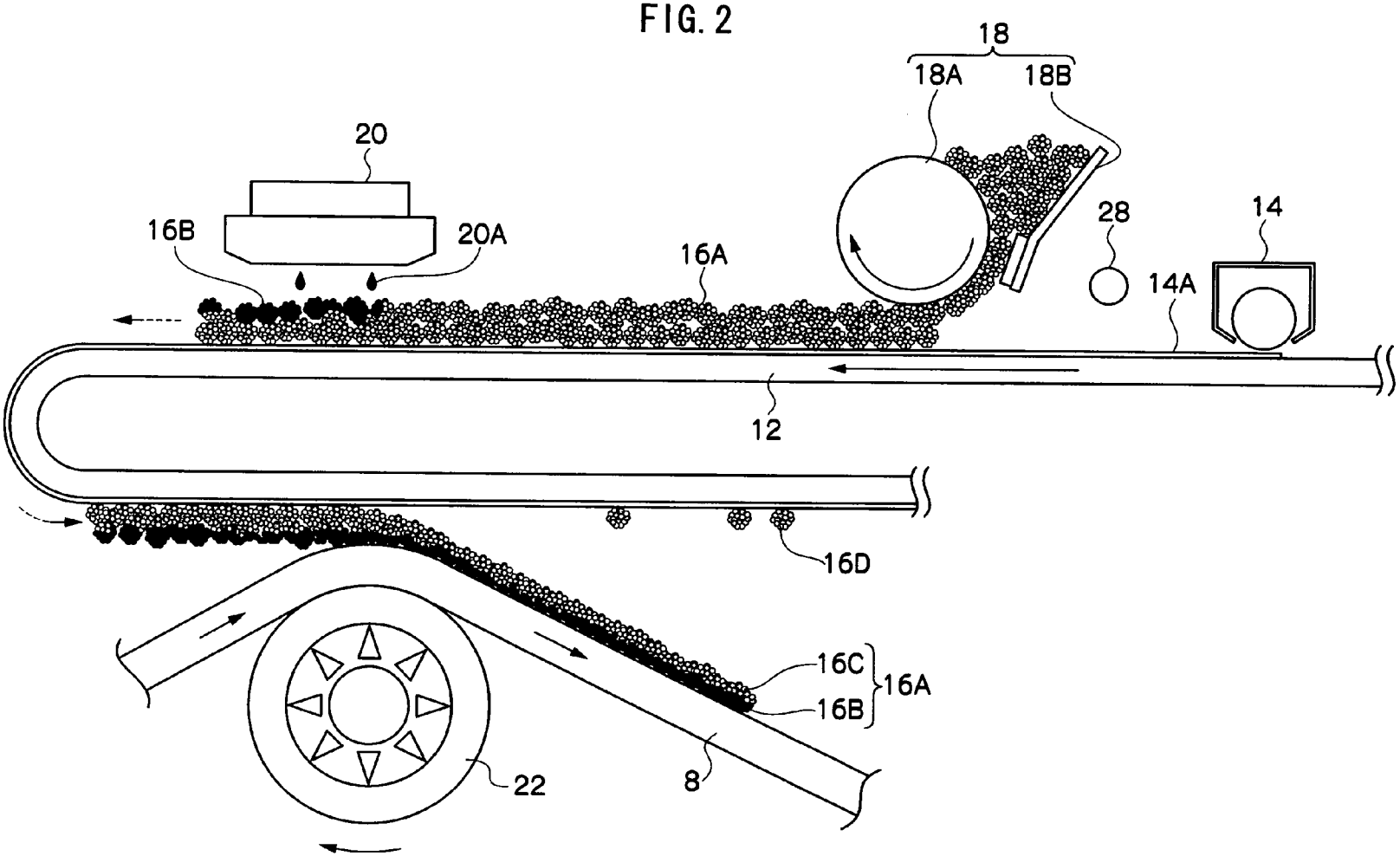
FIG. 2 shows a main part of the recording apparatus according to the first exemplary embodiment of the invention.
Figure 3A:
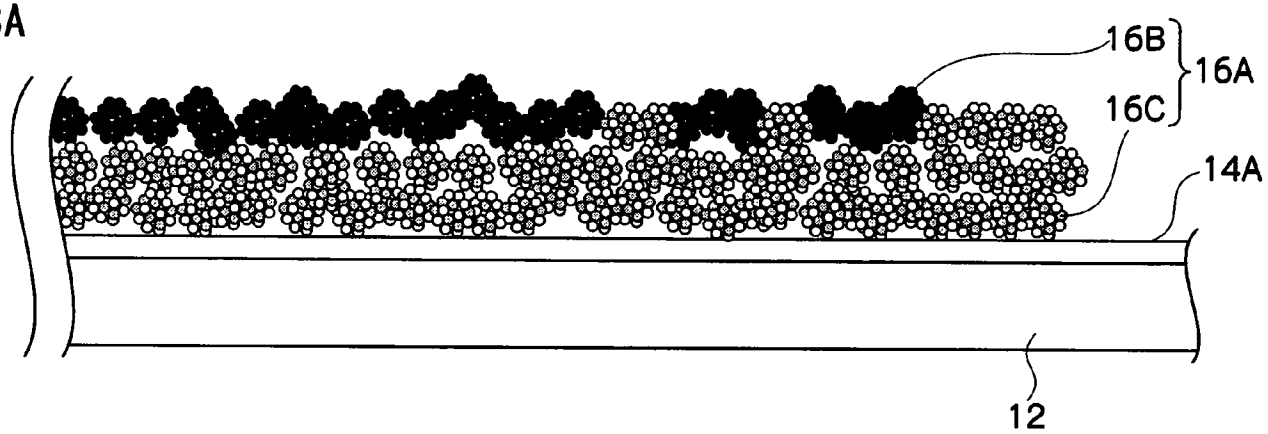
FIGS. 3A and 3B show an ink-recipient particle layer according to the first exemplary embodiment of the invention.
Figure 3B:
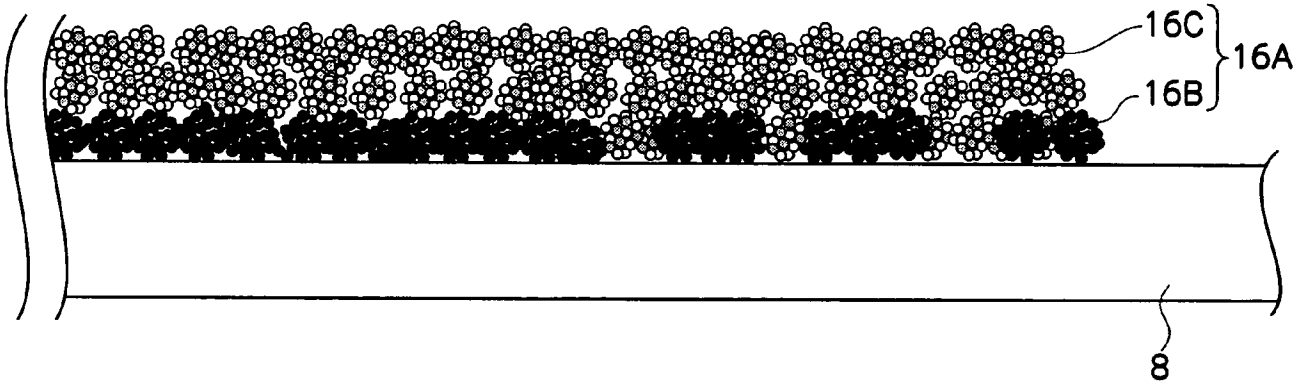

FIG. 1 shows a recording apparatus according to a first exemplary embodiment of the invention. FIG. 2 shows a main part of the recording apparatus according to the first exemplary embodiment of the invention. FIGS. 3A and 3B show an ink-recipient particle layer according to the first exemplary embodiment of the invention. The first exemplary embodiment describes a case that composite particles are used as the ink-recipient particles described below.

As shown in FIG. 1, the recording apparatus 10 according to the first exemplary embodiment includes an intermediate transfer body 12 as an endless belt, a charging device 28 for charging the surface of the intermediate transfer body 12, a particle supply device 18 for forming a particle layer by supplying ink-recipient particles 16 in a charged region on the intermediate transfer body 12, an ink-jet recording head 20 for forming an image by ejecting ink droplets on the particle layer, and a transfer and fixing device 22 for transferring and fixing an ink-recipient particle layer on a recording medium 8 by putting the recording medium 8 on the intermediate transfer body 12 followed by applying a pressure and heat. A cartridge 19 for storing the ink-recipient particles are attachably and detachably connected to a particle supply device 18 via a feed pipe 19A.

A releasing agent supply device 14 for forming a releasing layer 14A by supplying a releasing agent 14D is disposed upstream of the charging device 28.

On the surface of the intermediate transfer body 12 charged with the charging device 28, the ink-recipient particles 16 is formed as a layer by the particle supply device 18, and color images are formed on the particle layer by ejecting ink droplets of respective colors from ink-jet recording heads 20 of the respective colors, that is, 20K, 20C, 20M and 20Y.

The particle layer on the surface of which the color images are formed is transferred together with the color images on the recording medium 8 with the transfer and fixing device (transfer and fixing roller) 22. Downstream of the transfer and fixing device 22, disposed is a cleaning device 24 for removing the ink-recipient particles 16 remaining on the surface of the intermediate transfer body 12 and for removing foreign substances other than the particles (such as paper powder of the recording medium 8) adhering to the surface of the intermediate transfer body.

The recording medium 8 on which the color image is transferred is directly transported, and the surface of the intermediate transfer body 12 is charged again at the charging device 28. The ink-recipient particles transferred onto the recording medium 8 are promptly transported since they absorb and retain ink droplets 20A.

A discharging device 29 for removing residual charge on the surface of the intermediate transfer body 12 may be optionally disposed between the cleaning device 24 and the releasing agent supply device 14 ("between A and B" means both A and B are not included unless otherwise stated).

In the exemplary embodiment, a surface layer of an ethylene-propylene rubber (EPDM) with a thickness of 400 μm is formed on a polyimide film base of the intermediate transfer body 12 with a thickness of 1 mm. This surface layer desirably has a surface resistant of about $10^{13}$ Ω/□ and a volume resistivity of about $10^{12}$ Ω·cm (semiconductive).

While the intermediate transfer body 12 circulates, the releasing layer 14A is formed on the surface of the intermediate transfer body 12 at first by means of the releasing agent supply device 14. The releasing agent 14D is supplied on the surface of the intermediate transfer body 12 with a feed roller 14C of the releasing agent supply device 14, and the thickness of the releasing layer is determined with a blade 14B.

The releasing agent supply device 14 may continuously contact the intermediate transfer body 12 or may be apart from the intermediate transfer body 12 in order to continuously form and print the image.

Alternatively, supply of the releasing agent 14D may be prevented from being suspended by supplying the releasing agent 14D from an independent liquid supply system (not shown).

Subsequently, the surface of the intermediate transfer body 12 is positively charged by conferring the surface of the intermediate transfer body 12 with a positive charge using the charging device 28. For this purpose, a potential capable of supplying/adsorbing the ink-recipient particles 16 on the surface of the intermediate transfer body 12 may be formed by an electrostatic force capable of being formed between a feed roller 18A of the particle supply device 18 and the surface of the intermediate transfer body 12.

The surface of the intermediate transfer body 12 is charged in this exemplary embodiment by applying a voltage between the charging device 28 and a following roll 31 (grounded) disposed between the charging device 28 and the intermediate transfer body 12 using the charging device 28.

The charging device 28 is a roll-shaped member adjusted to have a volume resistance from about $10^6$ Ω·cm to about $10^8$ Ω·cm by forming an elastic layer (urethane foam resin) in which a conductivity conferring material is dispersed on the outer circumference of a rod made of stainless steel. The surface of the elastic layer is further coated with a water-repellent and oil-repellent coating layer (for example, made of an ethylene tetrafluoride-perfluoroalkyl vinylether copolymer (PFA)) with a thickness from 5 μm to 100 μm.

DC power source is connected to the charging device 28, and the following roll 31 is electrically connected to a frame ground. The charging device 28 is subjected to coupled movement while putting the intermediate transfer body 12 between the charging device 28 and following roll 31, and is able to charge the surface of the intermediate transfer body 12 since a given electric potential is generated at a press point between the grounded following roll 31 and the charging device 28. A voltage of, for example, 1 kV is impressed on the surface of the intermediate transfer body 12 from the charging device 28 to charge the surface of the intermediate transfer body 12.

The charging device 28 may be a corotron or the like.

The ink-recipient particles 16 are supplied on the surface of the intermediate transfer body 12 from the particle supply device 18 to form an ink-recipient particle layer 16A. The particle supply device 18 has the feed roller 18A disposed at a portion facing the intermediate transfer body 12 in a vessel for storing the ink-recipient particles 16 and a charging blade 18B disposed so that it is pressed onto the feed roller 18A. The charging blade 18B also serves for controlling the thickness of the layer of the ink-recipient particles 16 supplied on the surface of the feed roller 18A.

The ink-recipient particles 16 are supplied to the feed roller 18A (conductive roll). The thickness of the ink-recipient particle layer 16A is determined by the charging blade 18B (conductive blade) while the ink-recipient particles are negatively charged so that the particles have polarity opposed to the charge on the surface of the intermediate transfer body 12. An aluminum solid roll may be used for the feed roller 18A, while a metal plate (such as a SUS plate) on which urethane rubber is fixed may be used for the charging blade 18B in order to apply a pressure. The charging blade 18B is in contact with the feed roller 18A by a doctor method.

The charged ink-recipient particles 16 form, for example, one layer of the particle layer on the surface of the feed roller 18A, and are transported to a portion facing the surface of the intermediate transfer body 12. The charged ink-recipient particles 16 are transferred onto the surface of the intermediate transfer body 12 by an electric field generated by a potential difference between the feed roller 18A and the surface of the intermediate transfer body 12.

The travel speed of the intermediate transfer body 12 and rotation speed of the feed roller 18A (circumferential speed ratio) are relatively determined so that one particle layer is formed on the surface of the intermediate transfer body 12. The circumferential speed ratio depends on parameters such as the amount of charge of the intermediate transfer body 12, the amount of charge of the ink-recipient particles 16, the positional relation between the feed roller 18A and intermediate transfer body 12 and the like.

The number of particles supplied onto the intermediate transfer body 12 may be increased by relatively increasing the circumferential speed of the feed roller 18A based on the circumference speed ratio for forming one layer of the ink-recipient particle layer 16A. When the density of a transferred image is low (the amount of ink jetting is small: for example from 0.1 g/m$^2$ to 1.5 g/m$^2$), the thickness of the layer is controlled to be a minimum essential thickness (for example from 1 μm to 5 μm), while the thickness of the layer is controlled to be a thickness (for example from 10 μm to 25 μm) enough for retaining ink liquid components (solvents and dispersion media) when the amount of ink jetting is large (for example from 4 g/m$^2$ to 15 g/m$^2$).

In a case of a letter image or the like that is printed with a small amount of ink jetting, for example, when the image is formed on the one layer of the ink-recipient particles layer on the intermediate transfer body, image-forming components (pigments) in the ink are trapped on the surface of the ink-recipient particle layer on the intermediate transfer body and fixed on the surface of the ink-recipient particles and in internal voids between the particles so that the components have a small distribution in the direction of depth.

For example, when a particle layer 16C as a protective layer is to be provided on an image layer 16B a final image, the layer 16A of the ink-recipient particles is formed with a thickness of three layers or so. When the ink image is formed on the uppermost layer (see FIG. 3A), the particle layer 16C of the two layers on which no image is formed is formed on the image layer 16B to be a protective layer after transfer and fixing of the image (see FIG. 3B).

When an image with a large amount of ink jetting, for example a secondary or tertiary color image, is formed, layers of the ink-recipient particles 16 are laminated with a sufficient number of particles so that the layers are able to retain ink liquid components (solvents and dispersion media) and to trap a recording material (for example a pigment) while the recording material does not reach the lowermost layer. The image forming-material (pigment) is not exposed to the surface of the image layer after transfer and fixing, and the ink-recipient particles 16 that are not involved in imaging may form a protective layer on the surface of the image.

Then, the ink-jet recording head 20 ejects the ink droplets 20A on the ink-recipient particle layer 16A. The ink-jet recording head 20 ejects the ink droplets 20A on predetermined positions based on given image information.

Finally, the recording medium 8 and intermediate transfer body 12 are inserted into a transfer and fixing device 22, and the ink-recipient particle layer 16A is transferred on the recording medium 8 by applying pressure and heat to the ink-recipient particle layer 16A.

The transfer and fixing device 22 has a heating roll 22A and a pressurizing roll 22B facing the heating roll 22A across the intermediate transfer body 12, and forms a contact portion where the heating roll 22A contacts the pressurizing roll 22B. The heating roll 22A and pressurizing roll 22B used may be coated with silicone rubber on a outer surface of an aluminum core with a PFA tube for further coating the surface of the silicone rubber coating. the ink-recipient particle layer 16A is heated with a heater at the contact point between the heating roll 22A and pressurizing roll 22B, and the ink-recipient particle layer 16A is transferred and fixed on the recording medium 8 by applying a pressure.

Organic resin particles constituting the ink-recipient particle 16 at non-image portions are softened (or melted) by being heated at a temperature above the glass transition point (Tg), and the ink-recipient particle layer 16A is released from the releasing layer 14A formed on the surface of the intermediate transfer body 12 formed by pressurizing so that the ink-recipient particle layer is transferred and fixed on the recording medium 8. Transfer and fixing ability is improved by heating. The surface of the heating roll 22A is controlled at 160° C. in the exemplary embodiment of the invention. Accordingly, the ink liquid components (solvents and dispersion media) retained in the ink-recipient particle layer 16A continue to be retained and fixed in the ink-recipient particle layer 16A after the transfer. The intermediate transfer body 12 may be pre-heated before arriving at the transfer and fixing device 22.

Both permeable media (such as plain paper and ink-jet coat paper) and non-permeable media (such as art paper and resin film) may be used for the recording medium 8. The recording medium is not necessarily restricted to those described above, and other industrial products such as semiconductor substrates may also be used.

The image forming process of the recording apparatus according to the exemplary embodiment of the invention will be described in detail hereinafter. As shown in FIG. 2, the releasing layer 14A may be formed with the releasing layer supply device 14 on the surface of the intermediate transfer body 12 in the recording apparatus according to the exemplary embodiment of the invention. Forming the releasing layer 14A is particularly desirable when the material of the intermediate transfer body 12 is aluminum and a PET base. Alternatively, the surface itself of the intermediate transfer body 12 may have release ability by using a material of a fluoride resin or silicone rubber.

The surface of the intermediate transfer body 12 is charged to have an inverse polarity to the ink-recipient particles 16 using the charging device 28. The ink-recipient particles 16 supplied with the feed roller 18A of the particle supply device 18 are electrostatically adsorbed, and a layer of the ink-recipient particles 16 may be formed on the surface of the intermediate transfer body 12.

The layer of the ink-recipient particles 16 is formed on the surface of the intermediate transfer body 12 using the feed roller 18A of the particle supply device 18. For example, the ink-recipient particle layer 16A is formed so that the ink-recipient particles 16 are stacked at a thickness of about three layers. The thickness of the ink-recipient particle layer 16A that is transferred onto the recording medium 8 is adjusted by controlling the ink-recipient particle layer 16A by the space between the charging blade 18B and feed roller 18A. Alternatively, the thickness may be adjusted by the circumferential speed ratio between the feed roller 18A and intermediate transfer body 12.

Ink droplets 20A are ejected on the ink-recipient particle layer 16A from ink-jet recording heads 20 of respective colors by a piezoelectric method, thermal method, or the like and the image layer 16B is formed on the ink-recipient particle layer 16A. The ink droplets 20A ejected from the ink-jet recording head 20 are jetted onto the ink-recipient particle layer 16A, and the liquid component of the ink is promptly absorbed into the voids between the ink-recipient particles 16 and into the voids constituting the ink-recipient particles 16 while the recording material (for example pigment) is also trapped on the surface of the ink-recipient particles 16 (constituent particles) or in the voids between the particles constituting the ink-recipient particles 16.

While the ink liquid components (solvents and dispersion media) contained in the ink droplets 20A permeate into the ink-recipient particle layers 16A, the recording material such as the pigment is trapped on the surface of the ink-recipient particle layer 16A or in the void between the particles. In other words, while the ink liquid components (solvents and dispersion media) may be permeated to the back face of the ink-recipient particle layer 16A, the recording material such as the pigment does not permeate to the back face of the ink-recipient particle layer 16A. Therefore, since the particle layer 16C into which the recording material such as the pigment is not permeated is formed on the image layer 16B when the image is transferred onto the recording medium 8, the particle layer 16C serves as a protective layer for confining the surface of the image layer 16B, and an image having no recording materials (for example colorants such as pigments) exposed on the surface may be formed.

A color image is formed on the recording medium 8 by transfer/fixing of the ink-recipient particle layer 16A on which the image layer 16B is formed onto the recording medium 8 from the intermediate transfer body 12. The ink-recipient particle layer 16A on the intermediate transfer body 12 is heated and pressurized with the transfer and fixing device (transfer and fixing roller) 22 heated with a heating device such as a heater, and is transferred on the recording medium 8.

Glossiness of the surface may be adjusted by controlling the roughness of the surface of the image by heating and pressurizing, or may be adjusted by cooling and separating as will be described hereinafter.

Residual particles 16D remaining on the surface of the intermediate transfer body 12 after separating the ink-recipient particle layer 16A are retrieved with a cleaning device 24 (see FIG. 1), the surface of the intermediate transfer body 12 is charged again with the charging device 28, and the ink-recipient particle layer 16A is formed by supplying the ink-recipient particles 16.

FIGS. 3A and 3B show the particle layer used for forming an image according to the exemplary embodiment of the invention. As shown in FIG. 3A, the releasing layer 14A is formed on the surface of the intermediate transfer body 12.

A layer of the ink-recipient particles 16 is formed on the surface of the intermediate transfer body 12 using the particle supply device 18. The ink-recipient particle layer 16A formed as described above desirably has a thickness corresponding to about three layers of the ink-recipient particles 16. The thickness of the ink-recipient particle layer 16A transferred on the recording medium 8 is controlled by controlling the ink-recipient particle layer 16A to have a desired thickness. The surface of the ink-recipient particle layer 16A is evened to an extent not inhibiting the image (image layer 16B) from being formed by ejection of the ink droplets 20A.

The recording material such as the pigment contained in the ink droplets 20A permeates to a depth from ⅓ to ½ of the ink-recipient particle layer 16A as shown in FIG. 3A, and a particle layer 16C in which the recording material such as the pigment is not permeated remains under the permeated layer.

Since the ink-recipient particle layer 16A formed on the recording medium 8 by transfer with heating and pressurizing using the transfer and fixing device (transfer and fixing roller) 22 includes the particle layer 16C containing no ink on the image layer 16B as shown in FIG. 3B, the image layer 16B is not directly exposed on the surface and the layer 16C serves as a protective layer. Accordingly, the ink-recipient particles 16 should be transparent at least after fixing.

The surface of the particle layer 16C may be flattened by heating and pressurizing with the transfer and fixing device (transfer and fixing roller) 22, and glossiness of the surface of the image may be controlled by heating and pressurizing.

The ink liquid components (solvents and dispersion media) trapped in the ink-recipient particles 16 may be accelerated to be dried by heating.

The ink liquid components (solvents and dispersion media) received and retained in the ink-recipient particle layer 16A are also retained in the ink-recipient particle layer 16A after transfer and fixing, and removed by spontaneous drying.

The image forming process completes through above-mentioned steps. When residual particles 16D remaining on the intermediate transfer body 12 and foreign substances such as paper powders released from the recording medium 8 are left behind on the intermediate transfer body 12 after transfer of the ink-recipient particles 16 to the recording medium 8, they may be removed with the cleaning device 24.

A discharging device 29 may be placed downstream of the cleaning device 24. For example, the surface of the intermediate transfer body 12 is discharged by inserting the intermediate transfer body between a conductive roll used as the discharging device 29 and the following roll 31 (grounded) and by applying a voltage of about ±3 kV at a frequency of 500 Hz to the surface of the intermediate transfer body 12.

Charge voltage, thickness of the particle layer, and other conditions of the devices such as fixing temperature are optimized for respective devices, since the optimum conditions are determined by the ink-recipient particles 16, the composition of the ink, the amount of ejection of the ink and the like.

<Each Constitution Element>

The constituent element of each step in the first exemplary embodiment will be described in detail below.

<Intermediate Transfer Body>

The intermediate transfer body 12 on which the ink-recipient particle layer is formed may be a belt or a cylinder (drum). For supplying and retaining the ink-recipient particles on the surface of the intermediate transfer body by an electrostatic force, the outer circumference of the intermediate transfer body is required to have semiconductive or insulative particle-retaining characteristics. A material is used so that the intermediate transfer body has a surface resistivity from $10^{10}$ Ω/□ to $10^{14}$ Ω/□ and volume resistivity from $10^{9}$ Ω·cm to $10^{13}$ Ω·cm when electrical characteristics of the surface of the intermediate transfer body is semiconductive, while a material is used so that the intermediate transfer body has a surface resistivity of $10^{14}$ Ω/□ and volume resistivity of $10^{13}$ Ω·cm when electrical characteristics of the surface of the intermediate transfer body is insulative.

When the intermediate transfer body is a belt, the base of the belt may be capable of rotary drive of the belt in the apparatus and have a sufficient mechanical strength, and further may have required heat resistance, in particular, in a case that heat is used for transfer and fixing. Specific examples of the material used include polyimide, polyamide-imide, aramid resin, polyethylene terephthalate, polyester, polyether sulfone and stainless steel.

The base may be aluminum, stainless steel or the like when the intermediate transfer member is a drum.

For applying an electromagnetic heating method in the fixing process on the transfer and fixing device (transfer and fixing roller) 22, a heat-generating layer may be used for the intermediate transfer body 12 instead of the transfer and fixing device (transfer and fixing roller) 22. A metal that exhibits an electromagnetic induction action is used for the heat-generating layer. For example, nickel, iron, copper, aluminum or chromium may be selected.

<Particle Supply Process>

The ink-recipient particle layer 16A is formed on the surface of the intermediate transfer body 12 on which the releasing layer 14A is formed. A usually used method for supplying a toner to a photosensitive material in electrophotography may be used as the method for forming the ink-recipient particle layer 16A. The surface of the intermediate transfer body 12 is charged in advance by the usually used charging method (such as charging with the charging device 28) in electrophotography. The ink-recipient particles 16 are charged by frictional electrification (one-component or two-component frictional electrification) to an inverse polarity to the charge on the surface of the intermediate transfer body 12.

The ink-recipient particles 16 retained on the feed roller 18A generates an electric field between the particles and the surface of the intermediate transfer body 12, and are transferred and supplied onto the intermediate transfer body 12 and retained there. The thickness of the ink-recipient particle layer 16A may be controlled depending on the thickness of the image layer 16B formed on the ink-recipient particle layer 16A (in response to the amount of the jetted ink). The absolute value of charging of the ink-recipient particles 16 is desirably in the range from 5 μc/g to 50 μc/g.

The thickness of the ink-recipient particle layer 16A is desirably from 1 μm to 100 μm, more desirable from 1 μm to 50 μm, and further desirably from 5 μm to 25 μm. The void ratio in the ink-recipient particle layer (i.e., the void ratio between the ink-recipient particles+the void ratio within the ink-recipient particles (trap structure)) is desirably from 10% to 80%, more desirably from 30% to 70%, and further preferably from 40% to 60%.

The particle supply process corresponding to the one-component supply (development) method will be described below.

The ink-recipient particles 16 are supplied to the feed roller 18A, and the particles are charged while the thickness of the particle layer is controlled with the charging blade 18B.

The charging blade 18B serves for determining the thickness of the layer of the ink-recipient particles 16 on the surface of the feed roller 18A. For example, the thickness of the layer of the ink-recipient particles 16 on the surface of the feed roller 18A is changed by changing the pressure applied to the feed roller 18A. For example, the ink-recipient particles 16 are formed as substantially one layer on the surface of the feed roller 18A, and the ink-recipient particles 16 are formed as one layer on the surface of the intermediate transfer body 12. Alternatively, the compression pressure of the charging blade 18B is controlled low in order to increase the thickness of the layer of the ink-recipient particles 16 formed on the surface of the feed roller 18A, and the thickness of the layer of the ink-recipient particles formed on the surface of the intermediate transfer body 12 may be increased.

Otherwise, when the circumferential speed ratio between the feed roller 18A and intermediate transfer body 12 is adjusted to 1 for forming one layer of the particle layer on the surface of the intermediate transfer body 12, the condition for forming the layer may be controlled so that the number of the ink-recipient particles 16 supplied onto the intermediate transfer body 12 is increased by increasing the circumferential speed of the feed roller 18A to consequently increase the thickness of the layer of the ink-recipient particles on the intermediate transfer body 12. The thickness may be controlled by combining above-mentioned two methods. The ink-recipient particles 16 are negatively charged while the surface of the intermediate transfer body 12 is positively charged in above-mentioned examples.

A pattern covered with the protective layer on the surface may be formed while the amount of consumption of the ink-recipient particle layer is suppressed by controlling the thickness of the ink-recipient particle layer as described above.

A roll with a diameter from 10 mm to 25 mm having a volume resistivity from $10^6$ Ω·cm to $10^8$ Ω·cm may be used as the charging roll in the charging device 28, wherein an elastic layer is formed by dispersing a conductivity conferring material on the outer circumference of a rod-like or pipe-like member made of aluminum, stainless steel or the like.

One of resin materials such as a urethane resin, thermoplastic elastomer, epichlorohydrin rubber, ethylene-propylene-diene copolymer rubber, silicone rubber, acrylonitrile-butadiene copolymer rubber and polynorbornene rubber may be used alone for the elastic layer, or they may be used as a mixture. The urethane foam is a desirable material.

The urethane foam desirably has a closed-cell structure by dispersing hollow materials such as hollow glass beads or heat-expanded microcapsules in the urethane resin.

The surface of the elastic layer may be further coated with a water-repellent coating layer at a thickness from 5 μm to 100 μm.

DC power source is connected to the charging device 28, and the following roll 31 is electrically connected to a frame ground. The charging device 28 is subjected to coupled movement while putting the intermediate transfer body 12 between the charging device 28 and following roll 31, and a predetermined potential difference is generated at a press point between the charging device and following roll 31.

<Marking Process>

Ink droplets 20A are ejected on the layer of the ink-recipient particles 16 (ink-recipient particle layer 16A) formed on the surface of the intermediate transfer body 12 from the ink-jet recording head 20 based on image signal to form an image. The ink droplets 20A ejected from the ink-jet recording head 20 are jetted to the ink-recipient particle layer 16A. The ink droplets 20A are promptly adsorbed in inter-particle voids (spaces) formed in the ink-recipient particles 16, and recording materials (for example pigments) are trapped on the surface of the ink-recipient particles 16 or in the inter-particle voids constituting the ink-recipient particles 16.

It is desirable that much recording materials (for example pigments) are trapped on the surface of the ink-recipient particle layer 16A. The inter-particle voids (spaces) in the ink-recipient particles 16 exhibit a filter effect, and the recording materials (for example pigments) are trapped on the surface of the ink-recipient particle layer 16A while they are trapped and fixed in the inter-particle voids in the ink-recipient particles 16.

For reliably trapping the recording materials (for example pigments) on the surface of the ink-recipient particle layer 16A and in the inter-particle voids of the ink-recipient particles 16, the recording materials (for example pigments) may be rapidly insolubilized (coagulated) by allowing the ink to react with the ink-recipient particles 16. Specifically, a reaction between the ink and multivalent metal salts or a pH-dependent reaction may be used.

While a line-type ink-jet recording head having a width equal to or larger than the width of the recording medium is desirable, the image may be sequentially formed on the particle layer formed on the intermediate transfer body using a conventional scanning type ink-jet recording head. The ink ejection method of the ink-jet recording head 20 is not restricted so long as the method is capable of ejecting the ink such as a piezoelectric element actuation method and heating element actuation method. A pigment ink is preferably used as the ink while a conventional dye ink may also be used.

When the ink-recipient particles 16 are made to react with the ink, the particles used are treated with an aqueous solution containing a coagulant (for example multivalent metal salts, organic acids and the like) for giving an effect for coagulating the pigment by permitting the ink-recipient particles 16 to react with the ink and dried.

<Transfer Process>

The ink-recipient particle layer 16A, which has received the ink droplets 20A and on which an image is formed, forms the image on a recording medium 8 by transfer and fixing of the particle layer on the recording medium. While transfer and fixing may be carried out in separate processes, respectively, it is desirable to substantially simultaneously perform the transfer and fixing processes. While the ink-recipient particle layer 16A may be fixed by either heating or pressurizing, or by both heating and pressurizing, it is desirable to simultaneously apply heating and pressurizing.

It is possible to control surface properties and glossiness of the ink-recipient particle layer 16A by controlling heating and pressurizing. When the recording medium 8, on which the image (the ink-recipient particle layer 16A) has been transferred, is separated from the intermediate transfer body 12 after heating and pressurizing, the recording medium may be separated after the ink-recipient particle layer 16A has been cooled. The cooling method includes spontaneous cooling and forced cooling such as air cooling. The intermediate transfer body 12 suitable for applying these processes is an intermediate transfer belt.

The ink image is desirably formed so that it is protected with the particle layer 16C of the ink-recipient particles 16, by forming the image on the surface layer of the layer of the ink-recipient particles 16 formed on the intermediate transfer body 12 (the recording material (pigment) is trapped on the surface of the ink-recipient particle layer 16A), and by transferring the image on the recording medium 8.

The ink liquid components (solvents and dispersion media) that have received and retained in the layer of the ink-recipient particle 16 are retained in the layer of the ink-recipient particle 16 after transfer and fixing, and are removed by spontaneous drying.

<Releasing Layer>

The releasing layer 14A is formed by the releasing agent 14D on the surface of the intermediate transfer body 12 through the releasing agent supply device 14 before supplying the ink-recipient particles 16.

The method for supplying the releasing layer 14A include: a method by which the releasing agent 14D is stored in the apparatus, the releasing agent 14D is supplied to a releasing agent supply member, and the releasing agent 14D is supplied onto the surface of the intermediate transfer body 12 by means of the supply member to form the releasing layer 14A; and a method for forming the releasing layer 14A on the surface of the intermediate transfer body 12 by means of the supply member impregnated with the releasing agent 14D.

The releasing agent 14D contains at least one selected from the group consisting of a silicone oil, a fluorinated oils and organic compounds with a solubility parameter (SP value) of 11 or less, or about 11 or less.

Examples of the silicone oil include straight silicone oils and modified silicone oils.

Examples of the straight silicone oil include dimethyl silicone oil and methyl hydrogen silicone oil.

Examples of the modified silicone oil include methylstyryl-modified silicone oil, alkyl-modified silicone oil, higher fatty acidester-modified silicone oil, fluorine-modified silicone oil and amino-modified silicone oil.

The organic compound having the solubility parameter (SP value) of 11 or less or about 11 or less, desirably has the solubility parameter (SP value) of 10 or less or about 10 or less, more desirably has the solubility parameter (SP value) of from 8 to 10, or from about 8 to about 10. The ink-recipient particles 16 are prevented from tightly adhering onto the intermediate transfer body 12 by adjusting the solubility parameter (SP value) within above-mentioned range.

The solubility parameter (SP value) is calculated from the Fedors equation below using the evaporation energy (Δei) and molar volume (Δvi) of atoms or atomic groups in a chemical structure:

$$SP\ \text{value}=(\Sigma\Delta ei/\Sigma\Delta vi)^{1/2}$$

Examples of the organic compound having the solubility parameter (SP value) within above-mentioned range include polyalkyleneglycol and surfactants.

While examples of the polyalkyleneglycol include polyethyleneglycol, polypropyleneglycol, ethyleneoxide-propyleneoxide copolymer and polybutyleneglycol, polypropyleneglycol is desirable among them.

While examples of the surfactant include anionic surfactants, cationic surfactants, amphoteric surfactants and nonionic surfactants, the nonionic surfactants are preferable among them.

Examples of the anionic surfactant include alkylbenzene sulfonates, alkylphenyl sulfonates, alkylnaphthalene sulfonates, higher fatty acid salts, sulfate esters of higher fatty acid esters, sulfonates of higher fatty cid esters, sulfates and sulfonates of higher alcohol ethers, higher alkyl sulfosuccinates, higher alkyl phosphate esters, phosphate esters of higher alcohol-ethyleneoxide adducts, metallic soaps of fatty acids, N-acyl amino acids and salts thereof, alkylether carbonates, acylated peptides, formalin polycondensates of naphthalene sulfonates, dialkylsulfosuccinate esters, alkylsulfoacetate, α-olefin sulfonate, N-acyl methyl taurine, sulfated oils, alkylether sulfates, secondary higher alcohol ethoxysulfate, polyoxyethylene alkylphenyl ether sulfates, sulfate of fatty acid alkylolamide, alkylether phosphate esters and alkyl phosphate esters.

Examples of the cationic surfactant include aliphatic amine salts, aliphatic quaternary ammonium salts, benzarconium salts, benzethonium chloride salts, pyridinium salts and imidazolinium salts.

Examples of the amphoteric surfactant include carboxybetaine, aminocarboxylic acid salts, imidazolinium betaine and lecithin.

Examples of the nonionic surfactant include polyoxyethylene alkyl ether, single chain length polyoxyethylene alkyl ether, polyoxyethylene secondary alcohol ether, polyoxyethylene alkylphenyl ether, polyoxyethylene sterol ether, polyoxyethylene lanoline derivatives, ethyleneoxide derivatives of alkylphenol formalin condensate, polyoxyethylene-polyoxypropylene copolymers (polyoxyethylene-polyoxypropylene block polymers), polyoxyethylene-polyoxypropylene alkyl ether, polyoxyethylene glycerin fatty acid esters, polyoxyethylene castor oil and hardened castor oil, polyoxyethylene sorbitan fatty acid esters, polyoxyethylene sorbitol fatty acid esters, polyethyleneglycol fatty acid esters, fatty acid monoglyceride, polyglycerin fatty acid esters, sorbitan fatty acid esters, propyleneglycol fatty acid esters, sucrose fatty acid esters, fatty acid alkanolamide, polyoxyethylene fatty acid amide, polyoxyethylene alkylamide and alkylamine oxide. Polyoxyethylene alkyl ether and polyoxyethylene-polyoxypropylene copolymer are desirable among them.

The viscosity of the releasing agent 14D is desirably from 5 mP·s to 200 mP·s, or from about 5 mP·s to about 200 mP·s, more desirably from 5 mP·s to 100 mP·s or from about 5 mP·s to about 100 mP·s, and further desirably from 5 mP·s to 50 mP·s, or from about 5 mP·s to about 50 mP·s.

The viscosity is measured as follows. The viscosity of the ink obtained is measured using a measuring apparatus RHEOMAT 115 (trade name, manufactured by Contraves). A sample is placed in a measuring vessel, which is attached to the apparatus by a prescribed method, and the viscosity is measured at a temperature of 40° C. under a shear rate of 1400 $s^{-1}$.

The surface tension of the releasing agent 14D is, for example, 40 mN/m or less (desirably 30 mN/m or less, more desirably 25 mN/m or less).

The surface tension is measured as follows. The surface tension of the sample obtained is measured under an environment of 23±0.5° C. and 55±5% RH using a Wilhelmy type surface tension meter (manufactured by Kyowa Interface Science Co., Ltd.).

The boiling point of the releasing agent 14D is, for example, 250° C. or higher at 760 mmHg (desirably 300° C. or higher, more desirably 350° C. or higher).

The boiling point is measured as an initial boiling point according to JIS K2254.

The difference between the solubility parameter (SP value) of the releasing agent 14D and the solubility parameter (SP value) of the material constituting the surface of the intermediate transfer body is about 2 or less (desirably about 1 or less, more desirably from about 0.2 to about 0.8) for example.

The contact angle of the releasing agent 14D to the surface of the intermediate transfer body (constituent material thereof) is, for example about 40° or less (desirably about 30° or less, more desirably from about 5° to about 25°).

The contact angle is measured by dripping a prescribed amount of the sample on an object to be dripped using FIBRO 1100 DAT MK II (trade name, manufactured by FIBRO System Corp.). Specifically, 4.0 μL of the sample is set over the dripping object, and the contact angle is measured at the point of 0.04 seconds after dripping the sample on the object to be dripped. When the contact angle cannot be measured at the point of 0.04 seconds after dripping the sample on the object, the contact angle is measured at a time when the measurement is possible after dripping the sample.

The thickness of the releasing layer 14A of the releasing agent 14D is, for example, about 1 μm or less (desirably about 0.5 μm or less, more desirably about 0.1 μm or less).

<Cleaning Process>

A process for cleaning the surface of the intermediate transfer body 12 with the cleaning device 24 is necessary for repeatedly using the intermediate transfer body after refreshing. The cleaning device 24 has a cleaning part and a particle transport/retrieval part (not shown). The ink-recipient particles 16 (residual particles 16D) remaining on the surface of the intermediate transfer body 12 and adhered substances on the intermediate transfer body 12 such as foreign substances other than the particles (for example paper powder of the recording medium 8) are removed by cleaning. The retrieved residual particles 16D may be reused.

<Decharging Process>

The surface of the intermediate transfer body 12 may be discharged using the discharging device 29 before forming the releasing layer 14A.

As described above, the surface of the intermediate transfer body is charged through the charging device 28 after forming the releasing layer 14A by supplying the releasing agent 14D onto the surface of the intermediate transfer body 12 through the releasing agent supply device 14. Then, the ink-recipient particles 16 are supplied to the area of the intermediate transfer body 12 where the releasing layer has been formed and charged, from the particle supply device 18. Subsequently, an image is formed on the particle layer by ejecting ink droplets from the ink-jet recording head 20 to permit the ink-recipient particles 16 to receive the ink. Then, the ink-recipient particle layer is transferred and fixed on the recording medium 8 by superposing the recording medium 8 on the intermediate transfer body 12 and by applying a pressure and heat with the transfer and fixing device 22.

The hydrophilic ink-recipient particles 16 constituted as described below is suppressed from tightly adhering onto the intermediate transfer body 12 by applying one of above-mentioned releasing agent as the releasing agent 14D.

The ink-recipient particles applied in the exemplary embodiment of the invention will be described below. Reference numerals are omitted in the description hereinafter.

The ink-recipient particles receive the ink components by contact of the ink with the particles. "Ink-recipient" as used herein refers to retaining at least a part (at least a liquid component) of the ink components. The ink-recipient particles include at least an organic resin in which the proportion of polar monomers to all monomer components thereof is from 10 mol % to 90 mol %. In a specific example, there is used a composition that the ink-recipient particles include particles containing above-mentioned organic resin (referred to as hydrophilic organic particle hereinafter). (The particles including the hydrophilic organic particle are referred to as "mother particles" hereinafter).

The fact that the ink-recipient particles are hydrophilic means that the particles contain the organic resin having at least the polar monomer of from 10 mol % to 90 mol % relative to all the monomer components thereof. Such ink-recipient particles have higher adhesivity than the hydrophobic ink-recipient particles.

The ink-recipient particles may contain only the hydrophilic organic particles (primary particles) as the mother particles, or the mother particles may be composite particles as aggregates of at least the hydrophilic organic particles.

When the mother particles are composed of only the hydrophilic organic particles (primary particles), at least the liquid component of the ink is absorbed by the hydrophilic organic particles when the ink adheres to the ink-recipient particles for permitting the ink-recipient particles to receive the ink.

The ink is received by the ink-recipient particles as described above. Recording is possible by transfer of the ink-received ink-recipient particles on the recording medium.

On the other hand, when the mother particles are composed of the composite particles into which the hydrophilic organic particles aggregates, at least the liquid component of the ink is trapped by the voids between particles (at least the hydrophilic organic particles) constituting the composite particles (the inter-particle voids (spaces) may be referred to as a trap structure) when the ink adheres on the ink-recipient particles for permitting the ink-recipient particles to receive the ink. The recording material in the ink components is trapped by adhesion on the surface of the ink-recipient particles or in the trap structure of the ink-recipient particles. The ink-recipient particles thus receive the ink. Recording is possible by transfer of the ink-recipient particles that have received ink to the recording medium.

Trap of the ink liquid component by the trap structure is chemical and/or physical trap by the voids (physical structure of the particle wall) between the particles.

The ink liquid component is trapped by the voids (physical structure of the particle wall) between the particles constituting the composite particles while the ink liquid component is absorbed into and retained by the hydrophilic organic particles, when the mother particles are formed as composite particles into which the hydrophilic organic particles aggregate.

The ink liquid component is also absorbed into and retained by the hydrophilic organic particles.

The component of the hydrophilic organic particles constituting the ink-recipient particles also serves as a binder resin and coating resin for the recording material contained in the ink after transfer of the ink-recipient particles. In addition, the recording material is trapped in the trap structure when the ink-recipient particles are composite particles. In particular, it is desirable that a transparent resin is used as the component of the hydrophilic organic particles constituting the ink-recipient particles.

While a large amount of the resin is to be added for improving fixability (anti-friction) of the ink (for example a pigment ink) using an insoluble component such as a pigment or dispersed particles as the recording material, reliability of the ink ejection device is impaired by clogging of the nozzle when a large quantity of polymers are added to the ink (including treatment liquid). However, the organic resin component constituting the ink-recipient particles may serve as above-mentioned resin in above-mentioned constitution.

The "voids between the particles constituting the composite particles", that is, the "trap structure" is a physical structure of the particle wall capable of trapping at least the liquid. The size of the void is desirably from about 0.1 μm to about 5 μm, more desirably from about 0.3 μm to about 1 μm, as the largest aperture. While the size may be enough for trapping the recording material, particularly the pigment with a volume average particle diameter of, for example, about 100 nm, fine pores with a maximum aperture diameter of about 50 nm or less may also exist. The voids and capillaries preferably communicate to one another inside the particles.

The size of the void is determined by reading the image of a scanning electron microscope (SEM) of the surface of the particles with an image analyzer, detecting the void through binarization, and analyzing size and size distribution of the void.

The trap structure is expected to trap the liquid component of the ink components as well as the recording material thereof. When the recording material in particular pigment, together with the ink liquid component, is trapped by the trap structure, the recording material may be retained and fixed in the ink-recipient particles without localizing the recording material. The liquid component of the ink is mainly composed of ink solvents and dispersion media (vehicles).

The ink-recipient particles will be described in more detail below. The mother particles of the ink-recipient particles may be solely composed of the hydrophilic organic particles (primary particles), or the mother particles may be formed as composite particles into which at least the hydrophilic organic particles aggregate. Examples of the particles other than the hydrophilic organic particles constituting the composite particles include inorganic particles and porous particles. Naturally, the mother particles may be composed of the composite particles formed by aggregating plural hydrophilic organic particles. Further, examples of the particles adhered to the surface of the mother particles include inorganic particles other than the hydrophobic organic particles.

Figure 4:
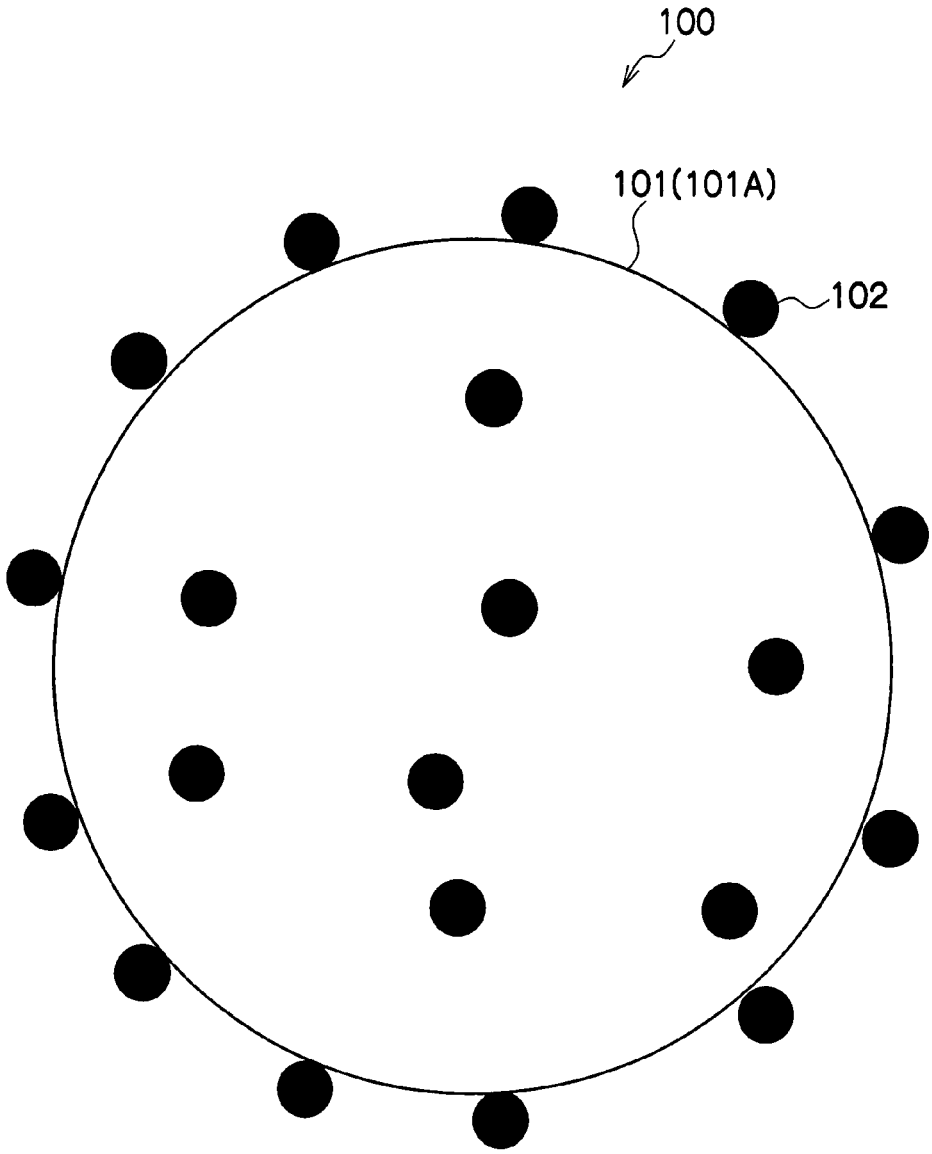
FIG. 4 schematically illustrates an example of ink-recipient particles according to the first exemplary embodiment of the invention.
Figure 5:
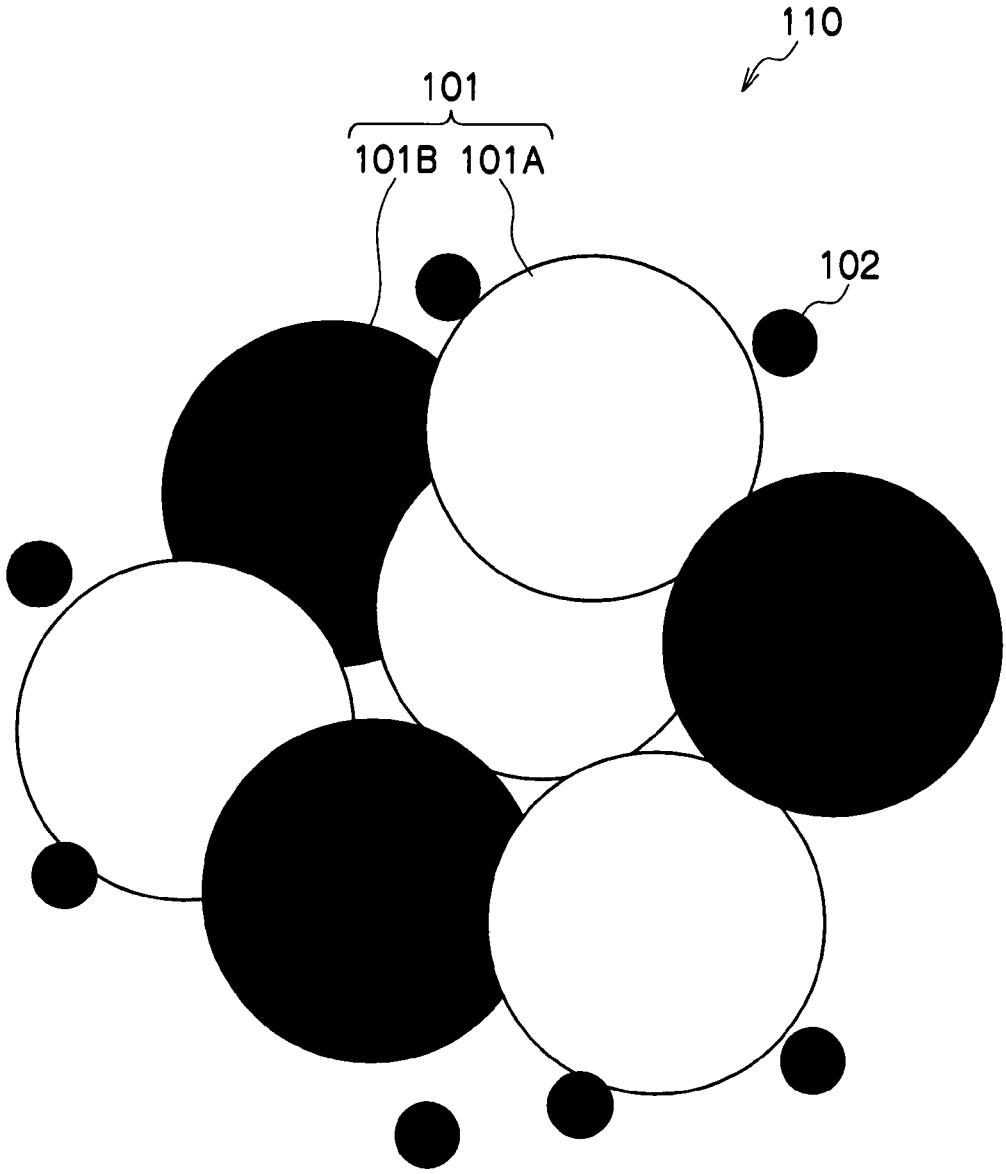
FIG. 5 schematically illustrates another example of ink-recipient particles according to the first exemplary embodiment of the invention.

A specific example of the ink-recipient particles includes the ink-recipient particles 100 as shown in FIG. 4, which are composed of mother particles 101 of the hydrophilic organic particles 101A only (primary particles) and inorganic particles 102 adhered to the mother particles 101. Another example of the ink-recipient particles includes the ink-recipient particles 110 as shown in FIG. 5, which are composed of mother particles 101 of the composite particles as compounds of the hydrophilic organic particles 101A and inorganic particles 101B, and inorganic particles 102 adhered to the mother particles 101. Void structures are formed as the voids between the mother particles of the composite particles.

When the mother particles are composed of the composite particles, the weight ratio of the hydrophilic organic particles to other particles (hydrophilic organic particles:other particles) is, for example, from about 5:1 to about 1:10 when the other particles are inorganic particles.

The particle diameter of the mother particles is, for example, from about 0.1 μm to about 50 μm (desirably from about 0.5 μm to about 25 μm, more desirably from about 1 μm to about 10 μm) as a sphere-reduced average particle diameter.

When the mother particles are composed of the composite particles, BET specific area ($N_2$) thereof is, for example, from about 1 $m^2/g$ to about 750 $m^2/g$.

When the mother particles are composed of the composite particles, the composite particles are obtained, for example, by granulating as semi-sintered particles. The semi-sintered particles refer to a state in which particle configuration partially remains and voids are kept between the particles. When the ink liquid components are trapped in the trap structure of the composite particles, at least a part of the particles may be disintegrated, that is, the composite particles may be dissolved to disperse the constituting particles.

The hydrophilic organic particles will be described below. The hydrophilic organic particles contain an organic resin with a ratio of the polar monomer to all the monomer components thereof from 10 mol % to 90 mol %, or from about 10 mol % to about 90 mol %, desirably 15 mol % to 85 mol %, or about 15 mol % to about 85 mol %, and further desirably from 30 mol % to 80 mol %, or about 30 mol % to about 80 mol %. Specifically, the hydrophilic organic particles may be made up to contain an organic resin containing the polar monomer in above-mentioned ratio (referred to as water-absorbent resin hereinafter).

Examples of the polar monomer include monomers containing an ethyleneoxide group, a carboxylic acid group, a sulfonic acid group, a substituted or none-substituted amino group, a hydroxyl group or salts thereof. For example, the monomer desirably has salt-forming structures such as (substituted) amino group, (substituted) pyridine group, or ammine salts or quaternary ammonium salts thereof when the monomer is positively charged. When the monomer is negatively charged, the monomer desirably has organic acid (salt) structures such as carboxylic acid (salts) and sulfonic acid (salts).

The ratio of the polar monomer is determined as follows. The organic component is identified by an analytical method such as mass analysis, NMR and IR. Then, the acid value or basic value of the organic component is measured according to JIS K0070 or JIS K2501. The ratio of the polar monomer may be calculated from the constitution of the organic component and the acid value/basic value ratio. The method is the same hereinafter.

The hydrophilic organic particle is composed of a liquid-absorbent resin, for example. The hydrophilic organic particle may contribute to fixability by softening since liquid component (for example water or aqueous solvent) absorbed into the particles serves as a plasticizer for the resin (polymer).

It may be favorable that the liquid-absorbent resin is a weakly liquid-absorbent resin. The weakly liquid-absorbent resin refers to a lyophilic resin that is able to absorb from several percentage (~5%) to hundreds of percentage (~500%), desirably from 5% to 100% of the liquid when the absorbed liquid is water.

While the liquid-absorbent resin may be composed of a homopolymer of a hydrophilic monomer or a copolymer of a hydrophilic monomer and a hydrophobic monomer, the copolymer is preferable when the resin is a weakly water-absorbent resin. A graft copolymer or a block copolymer that is formed by copolymerization of other units such as a polymer/oligomer structure as starting units may also be used, in addition to the copolymer using monomers.

Examples of the hydrophilic monomer include those having —OH, -EO (ethyleneoxide), —COOM (M is, for example, hydrogen, alkali metals such as Na, Li and K, ammonia or organic amine), —$SO_3M$ (M is, for example, hydrogen, alkali metals such as Na, Li and K, ammonia or organic amine), —$NR_3$ (R is, for example H, alkyl or phenyl), or —$NR_4X$ (R is, for example, H, alkyl or phenyl, and X is, for example, halogen, sulfate group, acid anion such as carboxylate, or $BF_4$). Specific examples include 2-hydroxyethyl methacrylate, 2-hydroxyethyl acrylate, acrylamide, acrylic acid, methacrylic acid, unsaturated carboxylic acid, crotonic acid and maleic acid. Examples of the hydrophilic unit or monomer include cellulose derivatives such as cellulose, ethyl cellulose and carboxymethyl cellulose; starch derivatives and monosaccharide or polysaccharide derivatives; polyvinyl sulfonic acid and styrene sulfonic acid; polymerizable carboxylic acids such as acrylic acid, methacrylic acid and maleic acid (maleic anhydride) or (partially) neutralized salts thereof; derivatives such as vinyl alcohol, vinyl pyrrolidone, vinyl pyridine, amino(meth)acrylate and dimethylamino(meth)acrylate or onium salts thereof; amides such as acrylamide and isopropyl acrylamide; polyethylene oxide chain-containing vinyl compounds; hydroxyl group-containing vinyl compounds; polyesters composed of polyfunctional carboxylic acids and polyfunctional alcohols; in particular branched polyesters that contain tri-functional or more of acids such as trimellitic acid and many terminal carboxylic acids or hydroxyl groups; and polyesters containing a polyethyleneglycol structure.

The hydrophobic monomers have hydrophobic groups, and specific examples of the hydrophobic monomer include olefins (such as ethylene and butadiene), styrene, α-methyl styrene, α-ethyl styrene, methyl methacrylate, ethyl methacrylate, butyl methacrylate, acrylonitrile, vinyl acetate, methyl acrylate, ethyl acrylate, butyl acrylate and lauryl methacrylate. Examples of the hydrophobic unit or monomer include styrene, styrene derivatives such as α-methyl styrene and vinyl toluene, vinyl cyclohexane, vinyl naphthalene, vinyl naphthalene derivatives, acrylic acid alkyl ester, acrylic acid phenyl ester, methacrylic acid alkyl ester, methacrylic acid phenyl ester, methacrylic acid cycloalkyl ester, crotonic acid alkyl ester, itaconic acid dialkyl ester, maleic acid dialkyl ester and derivatives thereof.

Favorable examples of the liquid-absorbent resin as a copolymer of the hydrophilic monomer and hydrophobic monomer include (meth)acrylic acid esters, styrene/(meth) acrylic acid/maleic acid (maleic anhydride) copolymer, olefin polymers such as ethylene/propylene polymer (or modified polymers or carboxylic acid unit-introduced polymers), branched polyester having an improved acid value with trimellitic acid and polyamide.

The liquid-absorbent resin may contain neutralized salt structures (for example carboxylic acid). The neutralized salt structure forms an ionomer by interaction with a cation when the resin absorbs an ink containing cations (for example monovalent metal cation such as Na and Li).

The liquid-absorbent resin desirably contains a substituted or non-substituted amino group, or substituted or non-substituted pyridine group. The group may interact with a recording material (for example pigment and dye) having a bactericidal effect and anionic group.

The molar ratio of the hydrophilic unit (hydrophilic monomer) and hydrophobic unit (hydrophobic monomer) of the liquid-absorbent resin (hydrophilic monomer: hydrophobic monomer) is, for example, from about 5:95 to about 70:30.

The liquid-absorbent resin may form an ionic cross-link with ions supplied from the ink. Specifically, the resin may contain a copolymer containing carboxylic acids such as (meth)acrylic acid and maleic acid in the water-absorbent resin, or a unit containing carboxylic acids such as (branched) polyesters having carboxylic acids in the resin. Ionic cross-linking or acid-base interaction may be formed between the carboxylic acid in the resin and alkali metal cations, alkali earth metal cations or organic amine-onium cations.

Common characteristics of the liquid-absorbent resin and non-liquid-absorbent resin constituting hydrophobic organic particles (collectively referred to as organic resins hereinafter) will be described below.

While the liquid-absorbent resin may have a linear chain structure, it has favorably a branched structure. The liquid-absorbent resin is desirably not cross-linked or has a low degree of cross-linking. While the liquid-absorbent resin may be a random copolymer or block copolymer having the liner chain structure, polymers having a branched structure (including a random copolymer, block copolymer and graft copolymer having branched structures) may be more favorably used. For example, the number of terminal groups may be increased through the branched structure in a case of using the polyester that can be synthesized by polymerization condensation. In a generally used method, the branched structure may be synthesized by adding a so-called cross-linking agent such as divinyl benzene or di(meth)acrylate in the polymerization process (for example addition of less than 1% of the cross-linking agent) or by adding a large amount of an initiator together with the cross-linking agent.

A charge control agent used for electrophotographic toners such as low molecular weight quaternary ammonium salts, organic borates and salt-forming compounds of salicylic acid derivatives may be further added to the liquid-absorbent resin. It is effective for controlling conductivity to add conductive inorganic additives (conductivity means a volume resistivity of less than about $10^7$ Ω·cm; the definition is the same hereinafter unless otherwise specified) or semiconductive inorganic additives (semiconductivity means a volume resistivity from about $10^7$ Ω·cm to about $10^{13}$ Ω·cm; the definition is the same hereinafter unless otherwise specified) such as tin oxide and titanium oxide.

The liquid-absorbent resin is desirably an amorphous resin, and the glass transition temperature (Tg) is, for example, in the range from 40° C. to 90° C. The glass transition temperature (and melting point) is determined from a maximum peak measured according to ASTM D3418-8. DSC-7 (trade name, manufactured by PerkinElmer) may be used for measuring the maximum peak. The melting points of indium and zinc are used for temperature calibration of the detector of this apparatus, and the heat of fusion of indium is used for calibration of the quantity of heat. The sample is placed on an aluminum pan with setting an empty pan for a control, and the heating rate for the measurement is 10° C./min.

The weight average molecular weight of the liquid-absorbent resin is, for example, from about 3,000 to about 300,000. The weight average molecular weight is determined, for example, by using HLC-81 20 GPC SC-8020 (trade name, manufactured by Tosoh Corp.) with two columns (6.0 mm (ID)×15 cm) packed with TSK gel, Super HM-H (trade name, manufactured by Tosoh Corp.) and with THF (tetrahydrofuran) as an eluant. The experimental conditions are: sample concentration 0.5%; flow rate 0.6 mL/min; sample injection volume 10 μL; and measuring temperature 40° C.; with an IR detector for detection. The calibration curve is obtained using "polystyrene standard samples TSK standard"; 10 samples of A-500, F-1, F-10, F-80, F-380, A-2500, F-4, F-40, F-128 and F-700, manufactured by Tosoh Corp.

The acid value of the liquid-absorbent resin is, for example, from 50 mg·KOH/g to 777 mg·KOH/g as converted into carboxylic acid group (—COOH). The acid value converted into carboxylic acid group (—COOH) is measured as follows.

The acid value is determined by a neutralization titration method according to JIS K0070. An appropriate amount of the sample is extracted, 100 mL of a solvent (a mixed solvent of diethylether/ethanol) and several drops of an indicator (phenolphthalein solution) are added, and the sample solution is sufficiently shaken in a water bath until the sample is dissolved. This solution is titrated with 0.1 mol/L potassium hydroxide solution in ethanol, and the end point of titration is detected when the pink color of the indicator is sustained for 30 seconds. The acid value A is calculated as $A=(B\times f\times 5.611)/S$, where S is the amount of the sample (g), B is the volume of 0.1 mol/L potassium hydroxide solution in ethanol (mL), and f is a factor of 0.1 mol/L potassium hydroxide solution in ethanol.

In any embodiment, the liquid-absorbent resin described above is used with the polar monomer ratio in above-mentioned range.

As to the particle diameter of the hydrophilic organic particles, in a case of using the primary particles as the mother particles, the sphere-reduced average diameter thereof is from about 0.1 μm to about 50 μm (desirably from about 0.5 μm to about 25 μm, more desirably from about 1 μm to about 10 μm). On the other hand, in a case of forming the composite particles, the sphere-reduced average particle diameter of the composite particles is from about 10 nm to about 30 nm (desirably from about 50 nm to about 10 μm, more desirably from about 0.1 μm to about 5 μm).

The ratio of the hydrophilic organic particles to the whole of the ink-recipient particles is 75% or more, or about 75% or more, (desirably 85% or more, or about 85% or more, and more desirably from 90% to 99%, or from about 90% to about 99%) by weight ratio.

The inorganic particles that constitute the composite particles together with the hydrophilic organic particles, and the inorganic particles adhered to the mother particles will be described below. Any of non-porous particles and porous particles may be used as the inorganic particles. Examples of the inorganic particles include colorless, pale colored or white particles (for example colloidal silica, alumina, calcium carbonate, zinc oxide, titanium oxide and tin oxide). These particles may be subjected to surface treatment (such as partial hydrophobizing treatment and treatment for introducing specified functional groups). For example, alkyl groups are introduced by treating the hydroxyl group of silica with a silylation agent such as trimethylchlorosilane or t-butyldimethylchlorosilane when the inorganic particles are silica particles. The reaction proceeds by dehydrochlorination with the silylation agent. The reaction may be accelerated by converting hydrochloric acid into hydrochloride by adding an amine. The reaction may be controlled by controlling the amount of treatment with silane coupling agents containing alkyl group and phenyl group as the hydrophobic group or titanate or zirconate coupling agents, or by controlling the treatment conditions. Surface treatment with aliphatic alcohols or higher fatty acid or derivatives thereof is also available. Cationic coupling agents having cationic functional group such as silane coupling agents having a (substituted) amino group or quaternary ammonium structure, coupling agents having fluorine-containing functional such as fluorosilane and other coupling agents having anionic functional groups such as carboxylic acids may also be used for surface treatment. The inorganic particles may be introduced into the hydrophilic organic particles, or may be so-called internal addition particles.

The particle diameter of the inorganic particles constituting the composite particles is, as a sphere-reduced average particle diameter, from about 10 nm to about 30 μm (desirably from about 50 nm to about 10 μm, more desirably from about 0.1 μm to about 5 μm). On the other hand, the particle diameter of the inorganic particles adhered to the mother particles is, as a sphere-reduced average particle diameter, from about 10 nm to about 1 μm (desirably from about 10 nm to about 0.1 μm, more desirably from about 10 nm to about 0.05 μm).

The ink-recipient particles and other additives will be described below. The ink-recipient particles desirably contain components for aggregating or thickening the ink components.

The component having above-mentioned function may be contained as functional groups of the resin constituting the liquid-absorbent resin (water-absorbent resin), or may be contained as compounds. Examples of the functional group include carboxylic acids, polyfunctional cations and polyamines.

Examples of the compound preferably include coagulants such as inorganic electrolytes, organic acids, inorganic acids and organic amines.

Examples of the inorganic electrolyte include salts of alkali metal ions such as lithium ion, sodium ion and potassium ion, polyvalent metal ions such as aluminum ion, barium ion, calcium ion, copper ion, iron ion, magnesium ion, manganese ion, nickel ion, tin ion, titanium ion and zinc ion with hydrochloric acid, hydrobromic acid, hydroiodic acid, sulfuric acid, nitric acid, phosphoric acid, thiocyanic acid, and organic carboxylic acid and organic sulfonic acid such as acetic acid, oxalic acid, lactic acid, fumaric acid, citric acid, salicylic acid and benzoic acid.

Specific examples include alkali metal salts such as lithium chloride, sodium chloride, potassium chloride, sodium bromide, potassium bromide, sodium iodide, potassium iodide, sodium sulfate, potassium nitrate, sodium acetate, potassium oxalate, sodium citrate and potassium benzoate; and polyvalent metal salts such as aluminum chloride, aluminum bromide, aluminum sulfate, aluminum nitrate, sodium aluminum sulfate, potassium aluminum sulfate, aluminum acetate, barium chloride, barium bromide, barium iodide, barium oxide, barium nitrate, barium thiocyanate, calcium chloride, calcium bromide, calcium iodide, calcium nitrite, calcium nitride, calcium nitrate, calcium dihydrogen phosphate, calcium thiocyanate, calcium benzoate, calcium acetate, calcium salicylate, calcium tartrate, calcium lactate, calcium fumarate, calcium citrate, copper chloride, copper bromide, copper sulfate, copper nitrate, copper acetate, iron chloride, iron bromide, iron iodide, iron sulfate, iron nitride, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogenphosphate, manganese acetate, manganese salicylate, manganese benzoate, manganese lactate, nickel chloride, nickel bromide, nickel sulfate, nickel nitride, nickel acetate, tin sulfate, titanium chloride, zinc chloride, zinc bromide, zinc sulfate, zinc nitrate, zinc thiocyanate and zinc acetate.

Specific examples of the organic acid include alginic acid, citric acid, glycine, glutamic acid, succinic acid, tartaric acid, cysteine, oxalic acid, fumaric acid, phthalic acid, maleic acid, malonic acid, lysine, malic acid and compounds represented by formula (1), and derivatives of these compounds.

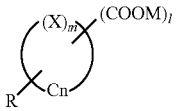

(1)

In the formula, X represents O, CO, NH, $NR_1$, S or $SO_2$. $R_1$ represents an alkyl group, which is desirably $CH_3$, $C_2H_5$ or $C_2H_4OH$. R represents an alky group, which is desirably $CH_3$, $C_2H_5$ or $C_2H_4OH$. R may be included or not included in the formula. X is desirably CO, NH, NR or O, more desirably CO, NH or O. M represents hydrogen atom, alkali metals or ammines. M is desirably H, Li, Na, K, monoethanolamine, diethanolamine or triethanolamine, more preferably H, Na or K, and further preferably hydrogen atom. n is an integer from 3 to 7. n is desirably a number for forming 6- or 5-membered heterocyclic ring, more preferably 5-membered heterocyclic ring. m is 1 or 2. The compound represented by formula (1) may be a heterocyclic ring, either saturated heterocyclic ring or unsaturated heterocyclic ring. 1 is an integer from 1 to 5.

Specific examples of the compound represented by formula (1) include compounds having a furan, pyrrole, pyrroline, pyrrolidone, pyron, thiophene, indole, pyridine or quinoline structure, and further having a carboxyl group as a functional group. Specific examples include 2-pyrrolidone-5-carboxylic acid, 4-methyl-4-pentanolido-3-carboxylic acid, furan carboxylic acid, 2-benzofuran carboxylic acid, 5-methyl-2-furan carboxylic acid, 2,5-dimethyl-3-furan carboxylic acid, 2,5-furan dicarboxylic acid, 4-butanolido-3-carboxylic acid, 3-hydroxy-4-pyrone-2,6-dicarboxylic acid, 2-pyron-6-carboxylic acid, 4-pyron-2-carboxylic acid, 5-hydroxy-4-pyrone-5-carboxylic acid, 4-pyrone-2,6-dicarboxylic acid, 3-hydroxy-4-pyrone-2,6-dicarboxylic acid, thiophene carboxylic acid, 2-pyrrole carboxylic acid, 2,3-dimethylpyrrole-4-carboxylic acid, 2,4,5-trimethylpyrrole-3-propionic acid, 3-hydroxy-2-indole carboxylic acid, 2,5-dioxo-4-methyl-3-pyrroline-3-propionic acid, 2-pyrrolidine carboxylic acid, 4-hydroxyproline, 1-methylpyrrolidine-2-carboxylic acid, 5-carboxy-1-methylpyrrolidine-2-acetic acid, 2-pyridine carboxylic acid, 3-pyridine carboxylic acid, 4-pyridine carboxylic acid, pyridine dicarboxylic acid, pyridine tricarboxylic acid, pyridine pentacarboxylic acid, 1,2,5,6-tetrahydro-1-methyl nicotinic acid, 2-quinoline carboxylic acid, 4-quinoline carboxylic acid, 2-phenyl-4-quinoline carboxylic acid, 4-hydroxy-2-quinoline carboxylic acid and 6-methoxy-4-quinoline carboxylic acid.

The organic acid is desirably citric acid, glycine, glutamic acid, succinic acid, tartaric acid, phthalic acid, pyrrolidone carboxylic acid, pyrone carboxylic acid, pyrrole carboxylic acid, furan carboxylic acid, pyridine carboxylic acid, coumalic acid, thiophene carboxylic acid or nicotinic acid, or derivatives thereof, or salts thereof. The organic acid is more desirably pyrrolidone carboxylic acid, pyrone carboxylic acid, pyrrole carboxylic acid, furan carboxylic acid, pyridine carboxylic acid, coumalic acid, thiophene carboxylic acid or nicotinic acid, or derivatives thereof, or salts thereof; more desirably pyrrolidone carboxylic acid, pyrone carboxylic acid, furan carboxylic acid or coumalic acid, or derivatives thereof, or salts thereof.

The organic amine may be any one of primary, secondary, tertiary and quaternary amines, and salts thereof. Specific examples include tetraalkyl ammonium, alkylamine, benzarconium, alkyl pyridium, imidazolium and polyamine, and derivatives thereof and salts thereof. Specific examples include amylamine, butylamine, propanolamine, propylamine, ethanolamine, ethylethanolamine, 2-ethylhexylamine, ethylmetylamine, ethylbenzylamine, ethylenediamine, octylamine, oleylamine, cyclooctylamine, cyclobutylamine, cyclopropylamine, cyclohexylamine, diisopropanolamine, diethanolamine, diethylamine, di-2-ethylhexylamine, diethylene triamine, diphenylamine, dibutylamine, dipropylamine, dihexylamine, dipentylamine, 3-(dimethylamino)propylamine, dimethylethylamine, dimethylethylene diamine, dimethyloctylamine, 1,3-dimethylbutylamine, dimethyl-1,3-propane diamine, dimethylhexylamine, aminobutanol, aminopropanol, aminopropane diol, N-acetylamino ethanol, 2-(2-aminoethylamino)ethanol, 2-amino-2-ethyl-1,3-propanediol, 2-(2-aminoethoxy)ethanol, 2-(3,4-dimethoxyphenyl)ethylamine, cetylamine, triisopropanolamine, triisopentylamine, triethanolamine, trioctylamine, trithylamine, bis(2-aminoethyl)-1,3-propane diamine, bis(3-aminopropy)ethylenediamine, bis(3-aminopropyl)-1,3-propane diamine, bis(3-aminopropyl)methylamine, bis(2-ethylhexyl)amine, bis(trimethylsilyl)amine, butylamine, butylisopropylamine, propane diamine, propyldiamine, hexylamine, pentylamine, 2-methylcyclohexylamine, methylpropylamine, methylbenzylamine, monoethanolamine, laurylamine, nonylamine, trimethylamine, triethylamine, dimethylpropylamine, propylenediamine, hexamethylenediamine, tetraethylene pentamine, diethyl ethanolamine, tetramethyl ammonium chloride, tetraethyl ammonium bromide, dihydroxyethyl stearylamine, 2-heptadecenyl hydroxyethyl imidazoline, lauryldimethylbenzyl ammonium chloride, cetylpyridinium chloride, stearamidomethyl pyridium chloride, diallyldimethyl ammonium chloride polymer, diallylamine polymer and monoallylamine polymer.

More preferably, triethanolamine, triisopropanolamine, 2-amino-2-ethyl-1,3-propane diol, ethanolamine, propanediamine and propylamine are used.

Polyvalent metal salts (such as $Ca(NO_3)$, $Mg(NO_3)$, $Al(OH)_3$ and polyaluminum chloride) are favorably used among these coagulants.

One of these coagulants may be used alone, or two or more of them may be used by mixing. The content of the coagulant is desirably from about 0.01% to about 30% by weight, more desirably from about 0.1% to about 15% by weight, and further desirably from about 1% to about 15% by weight.

The ink-recipient particles may contain the releasing agent. The releasing agent may be contained in the liquid-absorbent resin, or the releasing agent particles may be added by compounding with the hydrophilic organic resin particles.

Examples of the releasing agent include low molecular weight polyolefin such as polyethylene, polypropylene and polybutene; silicones that are softened by heating, fatty acid amides such as oleic acid amide, erucic acid amide, ricinoleic acid amide and stearic acid amide; plant waxes such as carnauba wax, rice wax, candelilla wax, wood wax and jojoba oil; animal waxes such as bees wax, mineral and petroleum waxes such as montan wax, ozokerite, cerecin, paraffin wax, microcrystalline wax and Fischer-Tropsch wax; and modified products of these waxes. Crystalline compounds may be used among these compounds.

The ink used in the exemplary embodiment of the invention will be described in detail below. The ink used is aqueous ink. The aqueous ink (simply referred to as an ink hereinafter)

contains ink solvents (for example water and water-soluble organic solvents) as well as the recording material. Other additives may be optionally added.

The recording material will be described first. An example of the recording material is a colorant. While the colorant available is either a dye or a pigment, the pigment is preferable. Any of organic pigments and inorganic pigments may be used. Examples of the black pigment include carbon black pigments such as furnace black, lamp black, acetylene black and channel black. Black color and three primary colors of cyan, magenta and yellow as well as pigments of specified colors such as red, green, blue, charcoal and white, metallic luster pigments of gold and silver colors, colorless or pale-colored extender pigments, and plastic pigments may be used. The pigment may be optionally synthesized for use in the exemplary embodiment of the invention.

Particles prepared by adhering a dye or pigment to surface of cores of silica, alumina or polymer beads, insoluble lake of dyes, colored emulsions and colored latexes may also be used as the pigment.

While specific examples of the black pigment include RAVEN 7000, RAVEN 5750, RAVEN 5250, RAVEN 5000 ULTRA II, RAVEN 3500, RAVEN 2000, RAVEN 1500, RAVEN 1250, RAVEN 1200, RAVEN 1190 ULTRA II, RAVEN 1170, RAVEN 1255, RAVEN 1080 and RAVEN 1060 (manufactured by Columbian Carbon Corp.), REGAL 400R, REGAL 330R, REGAL 660R, MOGUL L, BLACK PEARLS L, MONARCH 700, MONARCH 800, MONARCH 880, MONARCH 900, MONARCH 1000, MONARCH 1100, MONARCH 1300 and MONARCH 1400 (manufactured by Cabot Corp.), COLOR BLACK FW1, COLOR BLACK FW2, COLOR BLACK FW2V, COLOR BLACK 18, COLOR BLACK FW200, COLOR BLACK S150, COLOR BLACK S160, COLOR BLACK S170, PRINTEX 35, PRINTEX U, PRINTEX V, PRINTEX 140U, PRINTEX 140V, SPECIAL BLACK 6, SPECIAL BLACK 5, SPECIAL BLACK 4A and SPACIAL BLACK 4 (manufactured by Degussa), and NO. 25, NO. 33, NO. 40, NO. 47, NO. 52, NO. 900, NO. 2300, MCF-88, MA 600, MA 7, MA 8 and MA 100 (manufactured by Mitsubishi Chemical Corp.), the pigments are not restricted to these examples.

While examples of the cyan pigment include C.I. Pigment Blue-1, -2, -3, -15, -15:1, -15:2, -15:3, 15:4, -16, -22 and -60, the pigments are not restricted to these examples.

While examples of the magenta pigment include C.I. Pigment Red-5, -7, -12, -48, -48:1, -57, -112, -122, -123, -146, -168, -177, -184 and -202, and C.I. Pigment Violet-19, the pigments are not restricted to these examples.

While examples of the yellow pigment include C.I. Pigment Yellow-1, -2, -3, -12, -13, -14, -16, -17, -73, -74, -75, -83, -93, -95, -97, -98, -114, -128, -129, -138, -151, -154 and -180, the pigments are not restricted to these examples.

When the pigment is used as the colorant, it is desirable to use a pigment dispersion agent together. Examples of the pigment dispersion agent available include polymer dispersion agents, anionic surfactants, cationic surfactants, amphoteric surfactants and nonionic surfactants.

Polymers having a hydrophilic structure and hydrophobic structure may be favorably used as the polymer dispersion agent. Condensation polymers and addition polymers may be used as the polymers having the hydrophilic structure and hydrophobic structure. Examples of the condensation polymer are known polyester dispersion agents. Examples of the addition polymers are addition polymers of monomers having α,β-ethylenic unsaturated groups. Desired polymer dispersion agents may be obtained by copolymerizing a mixture of monomers having α,β-ethylenic unsaturated groups and having hydrophilic groups and monomers having α,β-ethylenic unsaturated groups and having hydrophobic groups. Homopolymers of monomers having α,β-ethylenic unsaturated groups having hydrophilic groups may also be used.

Examples of the monomer having α,β-ethylenic unsaturated groups and having hydrophilic groups include monomers having carboxyl group, sulfonic acid group, hydroxyl group or phosphoric acid group, for example acrylic acid, methacrylic acid, crotonic acid, itaconic acid, itaconic monoester, maleic acid, maleic acid monoester, fumaric acid, fumaric acid monoester, vinylsulfonic acid, styrenesulfonic acid, sulfonated vinylnaphthalene, vinyl alcohol, acrylamide, methacryloxyethyl phosphate, bismethacryloxyethyl phosphate, methacryloxyethylphenyl acid phosphate, ethyleneglycol dimethacrylate and diethyleneglycol dimethacrylate.

Examples of the monomer having the α,β-ethylenic unsaturated group and having hydrophobic groups include styrene derivatives such as styrene, α-methyl styrene and vinyl toluene, vinyl cyclohexane, vinyl naphthalene, vinyl naphthalene derivatives, acrylic acid alkyl ester, methacrylic acid alkyl eater, methacrylic acid phenyl ester, methacrylic acid cycloalkyl ester, crotonic acid alkyl ester, itaconic acid dialkyl ester and maleic acid dialkyl ester.

Examples of the desirable copolymer used for the polymer dispersion agent include styrene-styrene-sulfonic acid copolymer, styrene-maleic acid copolymer, styrene-methacrylic acid copolymer, styrene-acrylic acid copolymer, vinyl naphthalene-maleic acid copolymer, vinyl naphthalene-methacrylic acid copolymer, vinyl naphthalene-acrylic acid copolymer, acrylic acid alkyl ester-acrylic acid copolymer, methacrylic acid alkyl ester-methacrylic acid copolymer, styrene-methacrylic acid alkyl ester-methacrylic acid copolymer, styrene-acrylic acid alkyl ester-acrylic acid copolymer, styrene-methacrylic acid phenyl ester-methacrylic acid copolymer and styrene-methacrylic acid cyclohexyl ester-methacrylic acid copolymer. These polymers may be copolymerized with monomers having polyoxyethylene group or hydroxyl group.

The polymer dispersion agent has a weight average molecular weight of, for example, from about 2,000 to about 50,000.

One of these pigment dispersing agent may be used alone, or two or more of them may be used together. While the amount of addition of the pigment dispersing agent cannot be uniquely determined since it is largely different depending on the pigments, it is usually from 0.1% to 100% by weight relative to the amount of the pigment.

Pigments self-dispersible in water may be used as the colorant. The pigments self-dispersible in water refer to pigments having a number of water-solubilizing groups on the surface of the pigment and capable of being dispersed in water without adding the polymer dispersion agent. Specifically, the pigment self-dispersible in water may be obtained by subjecting so-called common pigments to a surface modification treatment such as acid-base treatment, coupling agent treatment, polymer graft treatment, plasma treatment or oxidation/reduction treatment.

Examples of the pigment self-dispersible in water include the pigments subjected to surface modification treatment as described above as well as commercially available pigments self-dispersible in water such as CAB-O-JET-200, CAB-O-JET-250, CAB-O-JET-260, CAB-O-JET-270, CAB-O-JET-300, (manufactured by Cabot Corp.), and MICROJET BLACK CW-1 and CW-2 (manufactured by Orient Chemical Industries, Ltd.).

The self-dispersible pigment desirably has at least sulfonic acid, sulfonic acid salts, carboxylic acid or carboxylic acid salts as functional groups on the surface of the pigment. The pigment more desirably has at least carboxylic acid or carboxylic acid salts on the surface as functional groups.

Pigments coated with a resin may also be used. The pigment is called as a microcapsule pigment, and examples of the microcapsule pigment available include commercially available microcapsule pigments manufactured by Dainippon Ink and Chemicals, Inc. and Toyo Ink Mfg. Co., Ltd. as well as microcapsule pigments as test products for the exemplary embodiment of the invention.

Resin dispersible pigments prepared by physically adsorbing or chemically bonding a polymer substance to the pigment may also be used.

Other examples of the recording material include hydrophilic anionic dyes, direct dyes, cationic dyes, reactive dyes, dyes such as polymer dyes and oil-soluble dyes, wax powders, resin powders and emulsions colored with dyes, fluorescent dyes and fluorescent pigments, IR absorbing agents, UV absorbing agents, magnetic materials such as ferromagnetic materials represented by ferrite and magnetite, titanium oxide, semiconductors and photocatalysts represented by zinc oxide, and particles of other organic and inorganic electronic materials.

The content (concentration) of the recording material is, for example, in the range from about 5% to about 30% by weight relative to the amount of the ink.

The volume average particle diameter of the recording material is, for example, from about 10 nm to about 1,000 nm.

The volume average particle diameter of the recording material refers to the recording material's own particle diameter, or the particle diameter including additives such as dispersion agents adhering to the recording material in a case that the additives have adhered to the recording particle. MICROTRACK UPA particle diameter analyzer 9340 (trade name, manufactured by Leeds & Northrup) is used as a measuring apparatus of the volume average particle diameter. The ink (4 ml) is charged in a measuring cell, and the volume average particle diameter is measured by a predetermined measuring method. The viscosity of the ink is used as the viscosity and the density of the recording material is used as the density of the dispersed particles as input values necessary for measuring the particle diameter.

The water-soluble organic solvent will be described below. Examples of the water-soluble organic solvent used include polyfunctional alcohols, polyfunctional alcohol derivatives, nitrogen-containing solvents, alcohols and sulfur-containing solvents.

Specific examples of the water-soluble solvent include, as the polyfunctional alcohols, ethyleneglycol, diethyleneglycol, propyleneglycol, butyreneglycol, triethyleneglycol, 1,5-pentane diol, 1,2-hexane diol, 1,2,6-hexane triol, glycerin, trimethylol propane, sugar alcohols such as xylitol, and sugars such as xylose, glucose and galactose.

Examples of the polyfunctional alcohol derivatives include ethyleneglycol monomethyl ether, ethyleneglycol monoethyl ether, ethyleneglycol monobutyl ether, diethyleneglycol monomethyl ether, diethyleneglycol monoethyl ether, diethyleneglycol monobutyl ether, propyleneglycol monobutyl ether, dipropyleneglycol monobutyl ether and ethyleneoxide adduct of diglycerin.

Examples of the nitrogen-containing solvent include pyrrolidone, N-methyl-2-pyrrolidone, cyclohexyl pyrrolidone and triethanolamine; and examples of alcohol include ethanol, isopropyl alcohol, butyl alcohol and benzyl alcohol.

Examples of the sulfur-containing solvent include thiodiethanol, thiodiglycerol, sulfolane and dimethylsulfoxide.

Propylene carbonate and ethylene carbonate may also be used as the water-soluble organic solvent.

At least one or more of the water-soluble organic solvents may be used. The content of the water-soluble organic solvent is from 1% to 70% by weight.

Water will be described below. Ion-exchange water, ultrapure water, distilled water or ultrafiltration water may be used for preventing impurities from being mingled.

Other additives will be described below. A surfactant may be added to the ink.

Examples of the surfactant include various anionic surfactants, nonionic surfactants, cationic surfactants and amphoteric surfactants. It is desirable to use the anionic surfactant and nonionic surfactant.

Specific examples of the surfactant will be listed below.

Examples of the anionic surfactant available include alkylbenzene sulfonate, alkylphenyl sulfonate, alkylnaphthalene sulfonate, salts of higher fatty acid, sulfate of higher fatty acid ester, sulfonate of higher fatty acid ester, sulfate and sulfonate of higher alcohol ether, higher alkyl sulfosuccinate, plyoxyethylene alkylether carboxylate, polyoxyethylene alkylether sulfate, alkylphosphate and polyoxyethylene alkylether phosphate. Dodecylbenzene sulfonate, isopropylnaphthalene sulfonate, monobutylphenylphenol monosulfonate, monobutylbiphenyl sulfonate, monobutylbiphenyl sulfonate and dibutylphenylphenol disulfonate are desirably used.

Examples of the nonionic surfactants available include polyoxyethylene alkylether, polyoxyethylene alkylphenylether, polyoxyethylene fatty acid ester, sorbitan fatty acid ester, polyoxyethylene sorbitan fatty acid ester, polyoxyethylene sorbitol fatty acid ester, glycerin fatty acid ester, polyoxyethylene glycerin fatty acid ester, polyglycerin fatty acid ester, sucrose fatty acid ester, polyoxyethylene alkyl amine, polyoxyethylene fatty acid amide, alkyl alkanol amide, polyethylene glycol polypropyleneglycol block copolymer, acetyleneglycol and polyoxyethylene adduct of acetyleneglycol. Polyoxyethylene nonylphenyl ether, polyoxyethylene octylphenyl ether, polyoxyethylene dodecylphenyl ether, polyoxyethylene alkylether, polyoxyethylene fatty acid ester, sorbitan fatty acid ester, polyoxyethylene sorbitan fatty acid ester, fatty acid alkyrol amide, polyethyleneglycol polypropyleneglycol block copolymer, acetyleneglycol and polyoxyethylene adduct of acetyleneglycol are desirably used.

In addition, silicone surfactants such as polysiloxane oxyethylene adduct; fluorinated surfactants such as perfluoroalkyl carboxylate, perfluoroalkyl sulfate and oxyethylene perfluoroalkyl ether; and bio-surfactants such as spiculisporic acid, rhamnolipid and lysolecithin may also be used.

One of these surfactants may be used alone, or a mixture of them may be used. The hydrophobicity-hydrophilicity balance of the surfactant is desirably in the range from 3 to 20 in terms of solubility.

The amount of addition is desirably from about 0.001% to about 5% by weight, particularly from about 0.01% to about 3% by weight.

An penetrant for improving osmosis; polyethylenimine, polyamine, polyvinyl pyrrolidone, polyethyleneglycol, ethyl cellulose and carboxymethyl cellulose for controlling characteristics such as improvement of ink ejectability; alkali metal compounds such as potassium hydroxide, sodium hydroxide and lithium hydroxide for controlling conductivity and pH; and optionally a pH buffering agent, an antioxidant, a fungicide, a viscosity control agent, a conductive agent, ultraviolet absorber and chelating agent; may also be added to the ink.

An exemplary of characteristics of the ink will be described below. The ink has a surface tension from about 20 mN/m to about 45 mN/m.

A Wilhelmy type surface tension meter (manufactured by Kyowa Interface Science Co., Ltd.) is used for measuring the surface tension, and values measured at 23° C. and 55% RH are employed.

The viscosity of the ink is from about 1.5 mP·s to about 30 mP·s.

RHEOMAT 115 (manufactured by Contraves) is used for the measurement, and values at 23° C. with a shear rate of 1400 $s^{-1}$ are employed.

The ink is not restricted to above-mentioned constitution. The ink may contain, for example, functional materials such as liquid crystal materials and electronic materials in addition to the recording materials.

While full color images are recorded on the recording medium 8 by selectively ejecting the ink droplets 20A from the ink-jet recording heads 20 of black, yellow, magenta and cyan colors based on image information in above exemplary embodiment of the invention, recording is not restricted to recording of letters and images on the recording medium. The apparatus according to the exemplary embodiment of the invention may also be applied to all industrially used droplet ejection (injection) apparatus.

Second Exemplary Embodiment

The second exemplary embodiment of the invention will be described in detail below.

(Ink-recipient Particles)

The ink-recipient particles according to the second exemplary embodiment of the invention receive the ink component by contact of the ink with the particles. Ink-recipient as used herein refers to retention of at least a part (at least liquid components) of the ink components.

The ink-recipient particles of the exemplary embodiment of the invention contains a hydrophilic organic resin with a ratio of the polar monomer to all monomer components thereof from 10 mol % to 90 mol %, or about 10 mol % to about 90 mol % (may be simply referred to as a "hydrophilic organic resin" hereinafter), and one or both of a first organic material that is a water-repellent solid at room temperature and has a melting point of 150° C. or lower, pr about 150° C. or lower, and a second organic material that is a water repellent liquid at room temperature (both may be referred to as "water-repellent organic materials").

The ink-recipient particles of the exemplary embodiment of the invention may comprise particles containing the hydrophilic organic resin (may be referred to as "hydrophilic organic particles" hereinafter). The ink-recipient particles may be composed of only the hydrophilic organic particles (may be referred to as a "primary particles" hereinafter), or may be composite particles formed by aggregation of particles including at least the hydrophilic organic particles. The primary particles and composite particles are collectively referred to as "mother particles" hereinafter.

The ink-recipient particles of the exemplary embodiment of the invention contains a water-repellent organic material in the mother particles. The water-repellent organic material may be contained as domains in the hydrophilic organic particles, or may be contained as particles (water-repellent particles) constituting the composite particles.

Since the mother particles contain the water-repellent organic material, the molten (or bled) water-repellent organic material forms a releasing layer on the surface of a fixing device when a fixed image is formed using the ink-recipient particles of the exemplary embodiment of the invention. Accordingly, the image is prevented from being disturbed by suppressing excessive adhesion of the ink-recipient particles that have received the ink onto the fixing device.

When the mother particles are composed of only the hydrophilic organic particles, at least the liquid component of the ink is absorbed by the hydrophilic organic particles when the ink adheres to the ink-recipient particles for allowing the ink-recipient particle to receive the ink.

The ink-recipient particles receive the ink by above-mentioned manner. The image is recorded by transfer of the ink-received ink-recipient particles onto the recording medium.

When the mother particles are composed of composite particles aggregated with incorporation of the hydrophilic organic particles, on the other hand, at least the ink liquid component of the ink is trapped by voids (the inter-particle void (space) may be referred to as a "trap structure" hereinafter) between particles constituting the composite particles when the ink adheres to the ink-recipient particles for allowing the ink-recipient particles to receive the ink. The recording medium in the ink component is adhered to the surface of the ink-recipient particles or trapped in the trap structure. The ink-recipient particles receive the ink by above-mentioned manner. The image is recorded by transfer of the ink-received ink-recipient particles onto the recording medium.

Trap of the ink component (liquid component and recording material) by the trap structure is physical and/or chemical trapping by the voids (physical structure of the particle wall) between the particles.

When the mother particles are composed of the composite particles aggregated by incorporating the hydrophilic organic particles, the ink liquid component is trapped in the voids (physical structure of the particle wall) between the particles that constitute the composite particles while the ink liquid component is adsorbed and retained by the hydrophilic organic particles.

The component of the hydrophilic organic particles constituting the ink-recipient particles serve as a binding resin and coating resin after transfer of the ink-recipient particles. It is particularly desirable that a transparent resin is used as the component of the hydrophilic organic particles constituting the ink-recipient particles.

While addition of a large amount of the resin to the ink is necessary for improving fixability (friction resistance) of the ink (for example a pigment ink) using an insoluble component or a dispersed particulate materials such as a pigment as the recording material, reliability of the apparatus is impaired due to clogging of the nozzle as an ink ejection device when a large amount of the polymer is added in the ink (including the treatment liquid of the ink). On the contrary, the organic resin component constituting the ink-recipient particles may serve as above-mentioned resin in the exemplary embodiment of the invention.

The "void between the particles constituting the composite particles", that is, the "trap structure" is a structure of the particle wall capable of trapping at least the liquid. The size of the void as the larges aperture is, for example, in the range from about 0.1 μm to about 5 μm, desirably from about 0.3 μm to about 1 μm. The size of the void may be a size enough for trapping the pigment with a volume average particle diameter of about 100 nm. Fine voids with a maximum aperture of less than 50 nm may also be contained. The voids and capillaries desirably communicate to each other in the particles.

The size of the void is determined as follows. The size of the void is determined by reading the image of a scanning electron microscope (SEM) of the surface of the particles with an image analyzer, detecting the void through binarization, and analyzing size and size distribution of the void.

The trap structure is desirably able to trap the liquid component as well as the recording material in the ink component. The recording material may be evenly retained and fixed in the ink-recipient particles without localization, when the recording material, particularly the pigment, is trapped together with the ink liquid component. The ink liquid component mainly serves as an ink solvent and dispersion medium (vehicle liquid).

The ink-recipient particles of the exemplary embodiment of the invention will be described in more detail below. The mother particles may be composed of only the hydrophilic organic particles in the ink-recipient particles of the exemplary embodiment of the invention, or may be composed of composite particles aggregated by incorporating the hydrophilic organic particles.

When the mother particles are composed of only the hydrophilic organic particles, a water-repellent organic material as well as a hydrophilic organic resin may be incorporated in the hydrophilic organic particles. When the mother particles are composed of composite particles aggregated by incorporating at least the hydrophilic organic particles, the water-repellent organic material may be incorporated in the hydrophilic organic particles, or the organic material may be contained as the particles (may be referred to as water-repellent particles) constituting the composite particles together with the hydrophilic organic particles. The water-repellent organic material is contained in the mother particle by above-mentioned manner. The water-repellent particle may contain the water-repellent organic material as well as third components (for example the hydrophobic organic material and inorganic materials).

Examples of the particles constituting the composite particle include the hydrophilic organic particles and water-repellent particles as well as inorganic particles and porous particles. The mother particle may be naturally composed of the composite particles formed by aggregation of plural hydrophilic organic particles, or composite particles formed by aggregation of plural hydrophilic organic particles and water-repellent particles, so long as the water-repellent organic material is contained in the particles in any configurations.

Examples of the particles to be adhered to the mother particle include hydrophobic organic particles and inorganic particles.

Figure 6:
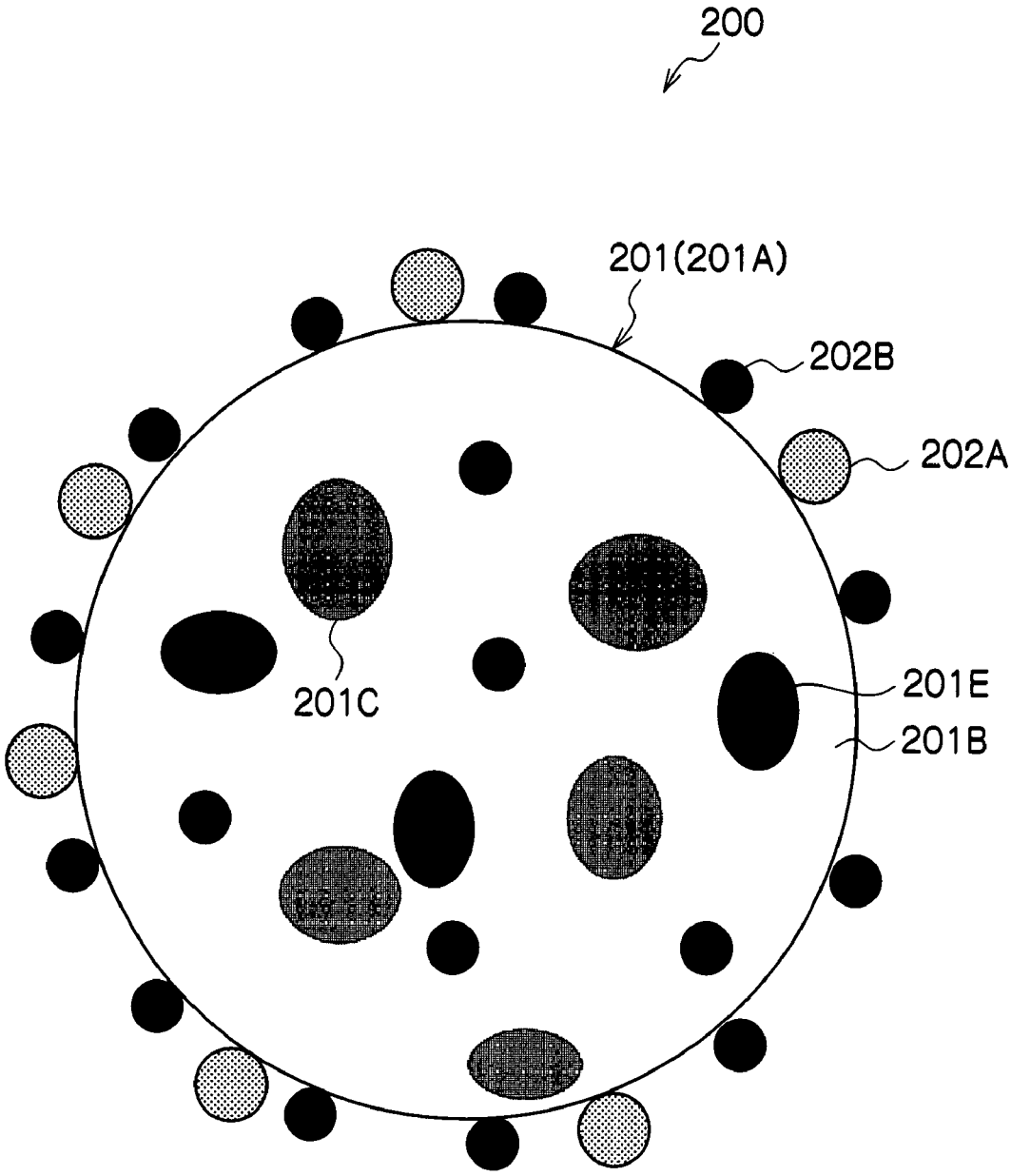
FIG. 6 schematically illustrates an example of ink-recipient particles according to the second exemplary embodiment of the invention.
Figure 7:
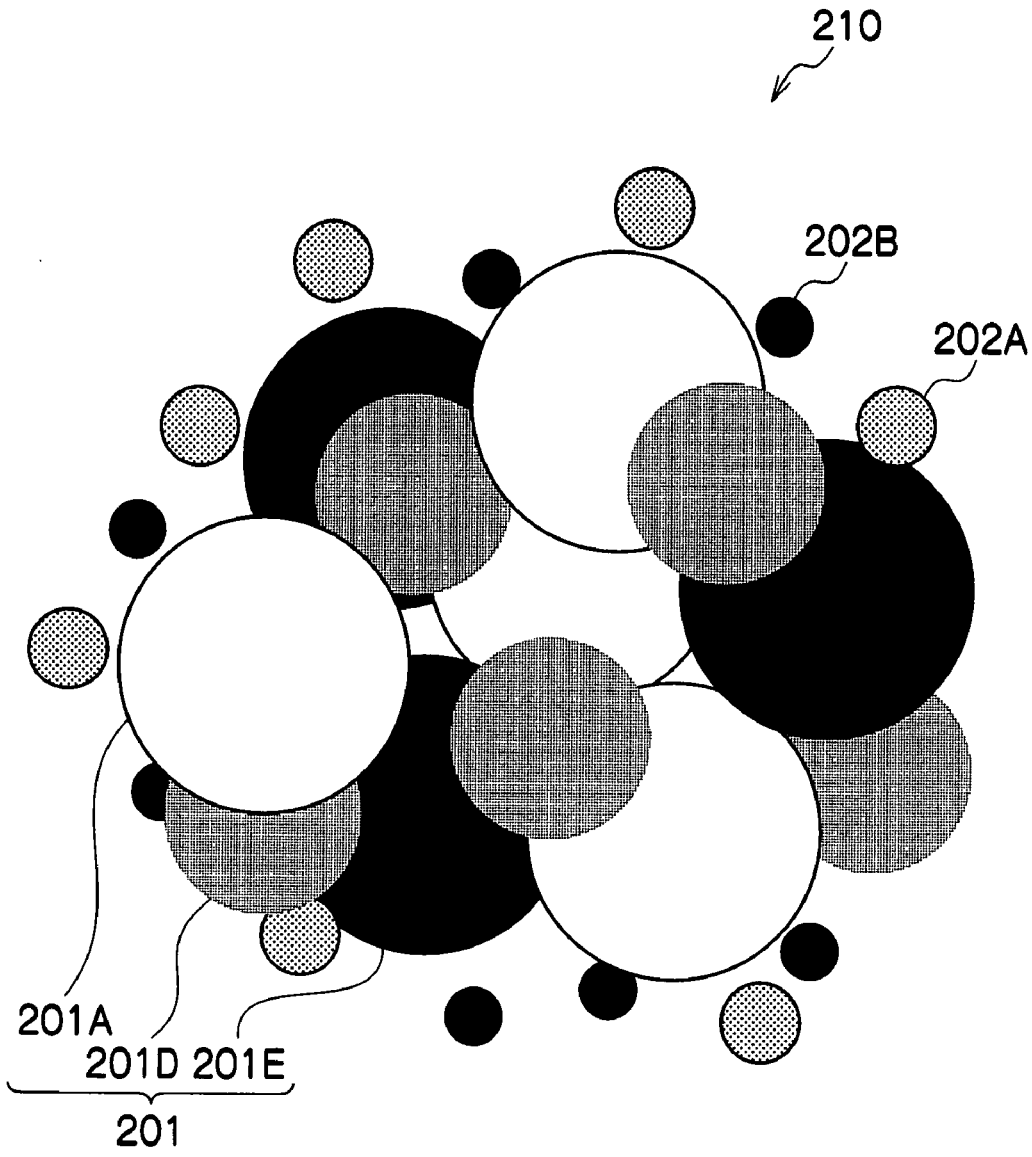
FIG. 7 schematically illustrates another example of ink-recipient particles according to the second exemplary embodiment of the invention.

In a specific exemplary embodiment shown in FIG. 6, the ink-recipient particles 200 is composed of the mother particles 201 composed of only the hydrophilic organic particles 201A containing the water-repellent organic material 201C and inorganic particles 201E in the hydrophilic organic resin 201B as a binder resin, hydrophobic organic particles 201A and inorganic particles 202B which have adhered to the mother particle 201. In another specific exemplary embodiment shown in FIG. 7, the ink-recipient particles 210 is composed of mother particles 201 as composite particles formed as compounds of the hydrophilic organic particles 201A containing a hydrophilic organic resin, water-repellent particles 201D containing a water repellent organic material and inorganic particles 201E, and hydrophobic organic particles 202A and inorganic particles 202B which have adhered to the mother particles 201. The mother particles of the composite particle form a void structure by the voids between the particles.

The sphere-reduced average particle diameter of the entire ink-recipient particles is in the range from 0.5 μm to 50 μm.

The sphere-reduced particle diameter is determined as follows. While the optimum method differs depending on the particle size, it is possible to use a variety of methods such as determining the particle diameter by taking advantage of the principle of light scattering by dispersing the particles in a liquid, and determining a projection image of the particles by image processing. Examples of commonly used method include a micro-track UPA method and a Coulter counter method.

When the mother particles are composed of the composite particles, the weight ratio of the hydrophilic organic particles to other particles (hydrophilic organic particles:other particles) is, for example, in the range from about 5:1 to about 1:10 when the other particles are inorganic particles.

The particle diameter of the mother particle is, as a sphere-reduced average diameter, in the range from about 0.1 μm to about 50 μm, desirably from about 0.5 μm to about 25 μm, and more desirably from about 1 μm to about 10 μm.

When the mother particles are composed of the composite particles, the BET specific surface area is in the range from about 1 $m^2/g$ to about 750 $m^2/g$.

When the mother particles are composed of the composite particles, the composite particles are granulated, for example, as a semi-sintered state. The semi-sintered state refers to a state in which particle configuration partially remains and voids are kept between the particles. At least a part of the particles may be disintegrated, or the composite particles may be dissolved to disperse constituting particles, when the ink liquid component is trapped in the trap structure.

The hydrophilic organic particles will be described below. The hydrophilic organic particles are composed of the hydrophilic organic resin in a ratio of the polar monomer from 10 mol % to 90 mol %, or from about 10 mol % to about 90 mol %, desirably from 15 mol % to 85 mol %, or from about 15 mol % to 85 mol %, and more desirably from 30 mol % to 80 mol %, or from about 30 mol % to about 80 mol %, relative to all the monomer components thereof.

The polar monomer refers to a monomer having ethyleneoxide group, carboxyl group, sulfo group, substituted or non-substituted amino group, hydroxyl group, amide group, imide group, nitrile group, ether group or ester group, or a salt thereof. For example, the monomer desirably has a salt-forming structure such as an amine salt or a quaternary ammonium salt of (substituted) amino group or (substituted) pyridine group when the monomer is positively charged. The monomer desirably has an organic acid (salt) structure such as carboxylic acid (salt) or sulfonic acid (salt) when the monomer is negatively charged.

The proportion of the polar monomer is determined as follows. The constitution of the organic component is identified at first through analytical methods such as mass analysis, NMR and IR. Then, the acid value or basic value of the organic component is measured according to JIS K0070 or JIS K2501. The proportion of the polar monomer may be calculated from the constitution and acid/basic value of the organic component. The method is the same hereinafter.

As described above, the hydrophilic organic particle is constituted by containing the hydrophilic organic resin (may be referred to as a "liquid-absorbent resin" hereinafter). The liquid-absorbent resin may contribute to fixability by softening since liquid component (for example water or aqueous solvent) absorbed into the liquid-absorbent resin serves as a plasticizer for the resin (polymer).

It may be favorable that the liquid-absorbent resin is a weakly liquid-absorbent resin. The weakly liquid-absorbent resin refers to a lyophilic resin that is able to absorb from several percentage (~5%) to hundreds of percentage (~500%), desirably from 5% to 100% of the liquid when the absorbed liquid is water.

While the liquid-absorbent resin may be composed of a homopolymer of a hydrophilic monomer or a copolymer of a hydrophilic monomer and a hydrophobic monomer, the copolymer is preferable when the resin is a weakly water-absorbent resin. A graft copolymer or a block copolymer that is formed by copolymerization of other units such as a polymer/oligomer structure as starting units may also be used, in addition to the copolymer using monomers.

Examples of the hydrophilic monomer include those having —OH, -EO (ethyleneoxide), —COOM (M is, for example, hydrogen, alkali metals such as Na, Li and K, ammonia or organic amine), —$SO_3M$ (M is, for example, hydrogen, alkali metals such as Na, Li and K, ammonia or organic amine), —$NR_3$ (R is, for example H, alkyl or phenyl), or —$NR_4X$ (R is, for example, H, alkyl or phenyl, and X is, for example, halogen, sulfate group, acid anion such as carboxylate, or $BF_4$). Specific examples include 2-hydroxyethyl methacrylate, 2-hydroxyethyl acrylate, acrylamide, acrylic acid, methacrylic acid, unsaturated carboxylic acid, crotonic acid and maleic acid. Examples of the hydrophilic unit or monomer include cellulose derivatives such as cellulose, ethyl cellulose and carboxymethyl cellulose; starch derivatives and monosaccharide or polysaccharide derivatives; polyvinyl sulfonic acid and styrene sulfonic acid; polymerizable carboxylic acids such as acrylic acid, methacrylic acid and maleic acid (maleic anhydride) or (partially) neutralized salts thereof; derivatives such as vinyl alcohol, vinyl pyrrolidone, vinyl pyridine, amino(meth)acrylate and dimethylamino(meth)acrylate or onium salts thereof; amides such as acrylamide and isopropyl acrylamide; polyethylene oxide chain-containing vinyl compounds; hydroxyl group-containing vinyl compounds; polyesters composed of polyfunctional carboxylic acids and polyfunctional alcohols; in particular branched polyesters that contain tri-functional or more of acids such as trimellitic acid and many terminal carboxylic acids or hydroxyl groups; and polyesters containing a polyethyleneglycol structure.

The hydrophobic monomers have hydrophobic groups, and specific examples of the hydrophobic monomer include olefins (such as ethylene and butadiene), styrene, α-methyl styrene, α-ethyl styrene, methyl methacrylate, ethyl methacrylate, butyl methacrylate, acrylonitrile, vinyl acetate, methyl acrylate, ethyl acrylate, butyl acrylate and lauryl methacrylate. Examples of the hydrophobic unit or monomer include styrene, styrene derivatives such as α-methyl styrene and vinyl toluene, vinyl cyclohexane, vinyl naphthalene, vinyl naphthalene derivatives, acrylic acid alkyl ester, acrylic acid phenyl ester, methacrylic acid alkyl ester, methacrylic acid phenyl ester, methacrylic acid cycloalkyl ester, crotonic acid alkyl ester, itaconic acid dialkyl ester, maleic acid dialkyl ester and derivatives thereof.

Specific examples of the liquid-absorbent resin as a copolymer of the hydrophilic monomer and hydrophobic monomer favorably include styrene-alkyl(meth)acrylate-(meth)acrylic copolymer, styrene-(meth)acrylic acid-maleic acid (anhydride) copolymer thereof, copolymer of olefin such as ethylene-propylene (or a modified copolymer or a copolymer in which carboxylic acid units are introduced by copolymerization), branched polyester and polyamide having improved acid value with trimellitic acid.

The liquid-absorbent resin may contain neutralized salt structures (for example carboxylic acid). The neutralized salt structure forms an ionomer by interaction with a cation when the resin absorbs an ink containing cations (for example monovalent metal cation such as Na and Li).

The liquid-absorbent resin desirably contains a substituted or non-substituted amino group, or substituted or non-substituted pyridine group. The group may interact with a recording material (for example pigment and dye) having a bactericidal effect and anionic group.

The molar ratio of the hydrophilic unit (hydrophilic monomer) and hydrophobic unit (hydrophobic monomer) of the liquid-absorbent resin (hydrophilic monomer:hydrophobic monomer) is, for example, from about 5:95 to about 70:30.

The liquid-absorbent resin may form an ionic cross-link with ions supplied from the ink. Specifically, the resin may contain a copolymer containing carboxylic acids such as (meth)acrylic acid and maleic acid in the water-absorbent resin, or a unit containing carboxylic acids such as (branched) polyesters having carboxylic acids in the resin. Ionic cross-linking or acid-base interaction may be formed between the carboxylic acid in the resin and alkali metal cations, alkali earth metal cations or organic amine-onium cations.

The ratio of the liquid-absorbent resin (hydrophilic organic resin) to the total amount of the ink-recipient resin is desirably from 50% to 99%, or from about 50% to about 99% by weight, more desirably from 60% to 99%, or from about 60% to about 99% by weight, and further desirably from 70% to 99%, or from about 70% to about 99% by weight.

In any embodiment, the liquid-absorbent resin described above is used with the polar monomer ratio in above-mentioned range.

As to the particle diameter of the hydrophilic organic particles, in a case of using the primary particles as the mother particles, the sphere-reduced average diameter thereof is from about 0.1 μm about 50 μm (desirably from about 0.5 μm to about 25 μm, more desirably from about 1 μm to about 10 μm). On the other hand, in a case of forming the composite particles, the sphere-reduced average particle diameter of the composite particles is from about 10 nm to about 30 nm (desirably from about 50 nm to about 10 μm, more desirably from about 0.1 μm to about 5 μm).

The ratio of the hydrophilic organic particles to the whole of the ink-recipient particles is 75% or more, or about 75% or more, (desirably 85% or more, or about 85% or more, and more desirably from 90% to 99%, or from about 90% to about 99%) by weight ratio.

The hydrophobic organic particle will be described below. The hydrophobic organic particle has a proportion of the polar monomer to all monomer thereof from about 0 mol % to about 10 mol %, desirably from about 0.1 mol % to about 8 mol %, and more desirably from about 2 mol % to about 5 mol %. Specifically, the hydrophobic organic particle is made up to contain the organic resin having above-mentioned ratio of the polar monomer (referred to as non-liquid-absorbent resin).

The hydrophobic organic particles contain the polar monomer in above-mentioned range.

Examples of the non-liquid-absorbent resin constituting the hydrophobic organic particle include a homopolymer of one of the hydrophobic monomer or a copolymer of the plural the hydrophobic monomers. Examples of the hydrophobic monomer include olefin compounds such as ethylene, propylene and butadiene; styrene or styrene derivatives such as α-methyl styrene, α-ethyl styrene and vinyl toluene; and methyl methacrylate, ethyl methacrylate, butyl methacrylate, acrylonitrile, vinyl acetate, methyl acrylate, ethyl acrylate, butyl acrylate, lauryl methacrylate, vinyl cyclohexane, vinyl naphthalene, vinyl naphthalene derivatives, alkyl acrylate, phenyl acrylate, alkyl methacrylate, phenyl methacrylate, cycloalkyl methacrylate, alkyl crotonate, dialkyl itaconate and dialkyl maleate.

Specific examples of the non-liquid-absorbent resin favorably include vinyl resins (for example styrene-(meth)acrylic acid copolymer and alkyl (meth)acrylate-(meth)acrylic acid copolymer), polyester resins (for example polyethylene terephthalate and polybutylene terephthalate), silicone resins (for example organopolysiloxane) and fluorinated resins (for example vinylidene fluoride resin, polytetrafluoroethylene, tetrafluoroethylene-perfluoroalkylvinyl copolymer and tetrafluoroethylene-ethylene copolymer).

The non-liquid-absorbent resin refers to a resin capable of absorbing less than 5% of the liquid relative to the total weight of the resin when water is absorbed as the liquid.

Above-mentioned non-liquid-absorbent resin may be used by controlling the proportion of the polar monomer within above-mentioned range in any applications.

The particle diameter of the hydrophobic organic particle is, as a sphere-reduced average particle diameter, about 0.1 μm or less, desirably in the range from about 0.01 μm to about 0.05 μm, and more desirably from about 0.015 μm to about 0.02 μm.

The proportion of the hydrophobic organic particle relative to the total amount of the ink-recipient particles is from about 0.1% to about 5%, desirably from about 0.1% to about 2.5%, and more desirably from about 0.5% to about 2% by weight ratio.

The proportion of the hydrophobic organic particles in the total amount of the ink-recipient particles is determined as follows. The ink-recipient particles are classified with a dry classifier (trade name: SONIC SHIFTER L-200P/SPIN AIR SIEVE) or an air classifier (trade name: CLASSIEL N-01) based on the particle diameter. The weight ratio is calculated from an assumption that particles having a smaller diameter are the hydrophobic organic particles and particles having a larger diameter are the hydrophilic particles. It is also possible to calculate the proportion between the hydrophilic particles and hydrophobic particles by dispersing the ink-recipient particles in a liquid medium and by calculating the distribution of particle diameter using hydrodynamic chromatography.

The hydrophobic organic particles may be subjected to surface treatment (such as partially hydrophobizing treatment and specified functional group introducing treatment). Specifically, it is possible to introduce alkyl groups by treating with a silylation reagent such as trimethyl chlorosilane and t-butyldimethyl chlorosilane. Since the reaction proceeds to generate dehydrochlorination by silylation reagent, the reaction may be accelerated by converting hydrochloric acid into hydrochloride by addition of an amine. Surface treatment with aliphatic alcohols and higher fatty acids, or with derivatives thereof, is also possible. Furthermore, surface treatment with coupling agents having cationic functional groups such as silane coupling agents having (substituted) amino group or quaternary ammonium salt structures, coupling agents having fluorinated functional groups such as fluorosilane, or other coupling agents having anionic functional groups such as carboxylic acid is also possible.

Common characteristics of the liquid-absorbent resin constituting the hydrophilic organic particles and the non-liquid-absorbent resin constituting hydrophobic organic resin (collectively referred to as organic resin) will be described below.

While the organic resin may have a linear chain structure, it has favorably a branched structure. The organic resin is desirably not cross-linked or has a low degree of cross-linking. While the organic resin may be a random copolymer or block copolymer having the liner chain structure, polymers having a branched structure (including a random copolymer, block copolymer and graft copolymer having branched structures) may be more favorably used. For example, the number of terminal groups may be increased through the branched structure in a case of using the polyester that can be synthesized by polymerization condensation. In a generally used method, the branched structure may be synthesized by adding a so-called cross-linking agent such as divinyl benzene or di(meth)acrylate in the polymerization process (for example addition of less than about 1% of the cross-linking agent) or by adding a large amount of an initiator together with the cross-linking agent.

A charge control agent used for electrophotographic toners such as low molecular weight quaternary ammonium salts, organic borates and salt-forming compounds of salicylic acid derivatives may be further added to the organic resin. It is effective for controlling conductivity to add conductive inorganic additives (conductivity means a volume resistivity of less than about $10^7$ Ω·cm; the definition is the same hereinafter unless otherwise specified) or semiconductive inorganic additives (semiconductivity means a volume resistivity from about $10^7$ Ω·cm to about $10^{13}$ Ω·cm; the definition is the same hereinafter unless otherwise specified) such as tin oxide and titanium oxide.

The organic resin is desirably an amorphous resin, and the glass transition temperature (Tg) is, for example, in the range from 40° C. to 90° C., or from about 40° C. to about 90° C. The glass transition temperature (and melting point) is determined by a maximum peak measured according to ASTM D3418-8. DSC-7 (trade name, manufactured by PerkinElmer) may be used for measuring the maximum peak. The melting points of indium and zinc are used for temperature calibration of the detector of this apparatus, and the heat of fusion of indium is used for calibration of the quantity of heat. The sample is placed on an aluminum pan with setting an empty pan for a control, and the heating rate for the measurement is 10° C./min.

The weight average molecular weight of the organic resin is, for example, from about 3,000 to about 300,000. The weight average molecular weight is determined, for example, by using HLC-81 20 GPC SC-8020 (trade name, manufactured by Tosoh Corp.) with two columns (6.0 mm (ID)×15 cm) packed with TSK gel, Super HM-H (trade name, manufactured by Tosoh Corp.) and with THF (tetrahydrofuran) as an eluant. The experimental conditions are: sample concentration 0.5%; flow rate 0.6 mL/min; sample injection volume 10 μL; and measuring temperature 40° C.; with an IR detector for detection. The calibration curve is obtained using "polystyrene standard samples TSK standard"; 10 samples of A-500, F-1, F-10, F-80, F-380, A-2500, F-4, F-40, F-128 and F-700, manufactured by Tosoh Corp.

The acid value of the organic resin is, for example, from 50 mg·KOH/g to 777 mg·KOH/g as converted into carboxylic acid group (—COOH). The acid value converted into carboxylic acid group (—COOH) is measured as follows.

The acid value is determined by a neutralization titration method according to JIS K0070. An appropriate amount of the sample is extracted, 100 mL of a solvent (a mixed solvent of diethylether/ethanol) and several drops of an indicator (phenolphthalein solution) are added, and the sample solution is sufficiently shaken in a water bath until the sample is dissolved. This solution is titrated with 0.1 mol/L potassium hydroxide solution in ethanol, and the end point of titration is detected when the pink color of the indicator is sustained for 30 seconds. The acid value A is calculated as $A=(B\times f\times 5.611)/S$, where S is the amount of the sample (g), B is the volume of 0.1 mol/L potassium hydroxide solution in ethanol (mL), and f is a factor of 0.1 mol/L potassium hydroxide solution in ethanol.

The water-repellent organic material will be described below. "Water-repellent" means that the contact angle to water is 90° or more.

The contact angle may be measured as follows using a dynamic contact angle tester (trade name: FIBRO 1100 DAT MK II, manufactured by FIBRO System Corp.). The contact angle is evaluated under an environment of 23±0.5° C. and 50±5% RH, unless otherwise clearly described.

A material to be evaluated is placed on a polyimide film when the melting point is from 20° C. or higher to 150° C. or lower, and heated at 180° C. for 30 minutes followed by cooling to room temperature to prepare an evaluation sample. Then, the evaluation sample is set on the contact angle tester. Ion-exchanged water (3 μL) is dripped on the evaluation sample, and the contact angle of water to the base material is measured 0.1 second after dripping.

When the sample is a liquid at room temperature, the evaluation sample is prepared by allowing the liquid sample to leave for 5 minutes after dripping the evaluation sample on a polyimide film. Then, the evaluation sample is set on the contact angle tester. Subsequently, 3 μL of ion-exchanged water is dripped on the evaluation sample, and the contact angle of water to the base material is measured 0.1 second after dripping.

The water-repellent organic material is incorporated into the hydrophilic organic particles when the mother particles are composed of only the hydrophobic organic particles. On the other hand, when the mother particles are composed particles, the water-repellent organic material may be contained in the hydrophilic organic particles, or may be incorporated as water-repellent particles constituting the composite particles.

The water repellent organic material that is a solid at room temperature will be described below. "Being a solid at room temperature" refers to "being a solid at 23±0.5° C.".

The melting point of the organic material that is a solid at room temperature is 150° C. or lower, or about 150° C. or lower, desirably from 45° C. or higher to 130° C. or lower, or from about 45° C. or higher to about 130° C. or lower, and more desirably from 50° C. or higher to 110° C. or lower, or from about 50° C. or higher to about 110° C. or lower.

The melting point of the water-repellent organic material that is a solid at room temperature is determined from a maximum peak measured according to ASTM D3418-8. DSC-7 (trade name, manufactured by PerkinElmer) may be used for measuring the maximum peak. The melting points of indium and zinc are used for temperature calibration of the detector of this apparatus, and the heat of fusion of indium is used for calibration of the quantity of heat. The sample is placed on an aluminum pan with setting an empty pan for the reference, and the heating rate for the measurement is 10° C./min.

Examples of the water-repellent organic material that is a solid at room temperature include polyolefins such as polyethylene, polypropylene and polybutene; silicones; silicones; fatty acid amides such as oleic acid amide, erucic acid amide, ricinolic acid amide, 1,2-hydroxystearic acid amide, stearic acid amide and phthalimide anhydride; plant waxes such as ester wax, camauba wax, rice wax, candelilla wax, cotton wax, wood wax and jojoba wax; animal waxes such as bees wax and lanolin; synthetic hydrocarbon waxes such as montan wax, ozokerite, cerecin, paraffin wax, microcrystalline wax, Fischer-Tropsch wax and modified products thereof; mineral waxes such as ozokerite and cerecin; petroleum waxes such as paraffin, microcrystalline wax and petratum; and synthetic waxes such as ester, ketone and ether waxes. Polyethylene, polypropylene, polybutene, paraffin wax and microcrystalline wax are preferable among them as the water-repellent organic material that is a solid at room temperature, and polyethylene is more preferable.

The water-repellent organic material that is a liquid at room temperature will be described below. "Being liquid at room temperature" means "being liquid at 23±0.5° C.".

Specific examples of the organic material include silicone oils, modified silicone oils, fluorinated oils, hydrocarbon oils, mineral oils, plant oils, polyalkyleneglycol, alkyleneglycol ether, alkane diol, molten waxes and surfactants. Silicone oils, fluorinated oils and organic compounds with a solubility parameter (SP value) of about 11 or less are particularly preferable among them. The organic material that is a liquid at room temperature may be used by being impregnated in porous particles such as porous silica and porous apatite.

Examples of the silicone oil include straight silicone oils and modified silicone oils.

Examples of the straight silicone oil include dimethyl silicone oil and methyl hydrogen silicone oil.

Examples of the modified silicone oil include methylstyryl-modified silicone oil, alkyl-modified silicone oil, higher fatty acidester-modified silicone oil, fluorine-modified silicone oil and amino-modified silicone oil.

The organic compound having the solubility parameter (SP value) of about 11 or less desirably has the solubility parameter (SP value) of 10 or less, or about 10 or less, more desirably has the solubility parameter (SP value) of from 8 to 10, or from about 8 to about 10. The ink-recipient particles 16 are prevented from tightly adhering onto the intermediate transfer body 12 by adjusting the solubility parameter (SP value) within above-mentioned range.

Any methods for determining from measured values such as calculation from heat of evaporation, calculation from refraction index, calculation from kauri-butanol value and calculation from surface tension, and methods for determining from chemical compositions may be used for determining the solubility parameter (SP value). The solubility parameter (SP value) used in the exemplary embodiment of the invention is determined by calculation from the following Fedors equation using evaporation energy (Δei) and molar volume (Δvi) of atoms or atomic groups of a chemical structure.

$$SP\ \text{value}=(\Sigma\Delta ei/\Sigma\Delta vi)^{1/2}$$

Examples of the organic compound with the solubility parameter (SP value) within above-mentioned range are polyalkyleneglycol and surfactants.

Examples of the polyalkylne glycol include polyethyleneglycol, polypropyleneglycol, ethyleneoxide-propyleneoxide copolymer and polybutyleneglycol. Among them, polypropyleneglycol is preferable.

While examples of the surfactant include anionic surfactants, cationic surfactants, amphoteric surfactants and nonionic surfactants, the nonionic surfactants are preferable among them.

Examples of the anionic surfactant include alkylbenzene sulfonates, alkylphenyl sulfonates, alkylnaphthalene sulfonates, higher fatty acid salts, sulfate esters of higher fatty acid esters, sulfonates of higher fatty cid esters, sulfates and sulfonates of higher alcohol ethers, higher alkyl sulfosuccinates, higher alkyl phosphate esters, phosphate esters of higher alcohol-ethyleneoxide adducts, metallic soaps of fatty acids, N-acyl amino acids and salts thereof, alkyl ether carbonates, acylated peptides, formal in polycondensates of naphthalene sulfonates, dialkylsulfosuccinate esters, alkylsulfoacetate, α-olefin sulfonate, N-acyl methyl taurine, sulfated oils, alkylether sulfates, secondary higher alcohol ethoxysulfate, polyoxyethylene alkylphenyl ether sulfates, sulfate of fatty acid alkylolamide, alkylether phosphate esters and alkyl phosphate esters.

Examples of the cationic surfactant include aliphatic amine salts, aliphatic quaternary ammonium salts, benzarconium salts, benzethonium chloride salts, pyridinium salts and imidazolinium salts.

Examples of the amphoteric surfactant include carboxybetaine, aminocarboxylic acid salts, imidazolinium betaine and lecithin.

Examples of the nonionic surfactant include polyoxyethylene alkyl ether, single chain length polyoxyethylene alkyl ether, polyoxyethylene secondary alcohol ether, polyoxyethylene alkylphenyl ether, polyoxyethylene sterol ether, polyoxyethylene lanoline derivatives, ethyleneoxide derivatives of alkylphenol formalin condensate, polyoxyethylene-polyoxypropylene copolymers (polyoxyethylene-polyoxypropylene block polymers), polyoxyethylene-polyoxypropylene alkyl ether, polyoxyethylene glycerin fatty acid esters, polyoxyethylene castor oil and hardened castor oil, polyoxyethylene sorbitan fatty acid esters, polyoxyethylene sorbitol fatty acid esters, polyethyleneglycol fatty acid esters, fatty acid monoglyceride, polyglycerin fatty acid esters, sorbitan fatty acid esters, propyleneglycol fatty acid esters, sucrose fatty acid esters, fatty acid alkanolamide, polyoxyethylene fatty acid amide, polyoxyethylene alkylamide and alkylamine oxide. Polyoxyethylene alkyl ether and polyoxyethylene-polyoxypropylene copolymer are desirable among them.

The viscosity of the organic material that is a liquid at room temperature is desirably from 5 mP·s to 200 mP·s, or from about 5 mP·s to about 200 mP·s, more desirably from 5 mP·s to 100 mP·s, or from about 5 mP·s to about 100 mP·s, further desirably from 5 mP·s to 50 mP·s, or from about 5 mP·s to about 50 mP·s. The organic material that is a liquid at room temperature may be readily spread on the intermediate transfer body, and uncoated region of the organic material that is a liquid at room temperature is prevented from being formed.

The vapor pressure of the water-repellent organic material at 23° C. is about 1000 Pa or less, desirably about 500 Pa or less, and more preferably about 133 Pa or less.

The total amount of the organic material that is a liquid at room temperature is preferably from about 1% to about 15% by weight, more preferably from about 1% to about 10% by weight, and further preferably from about 1% to about 5% by weight relative to the total amount of the ink-recipient particles.

The liquid-absorbent performance of the ink-recipient particles and prevention of ghost due to offset on the fixing roll may be compatible when the total amount of the organic material that is a liquid at room temperature is controlled within above-described range.

The total content of the water-repellent organic material is preferably from about 1% to about 15% by weight, more preferably from about 1.5% to about 10% by weight, and further preferably from about 2% to about 5% by weight. The total content of the water-repellent organic material refers to the total amount of the water-repellent organic material contained in the hydrophilic organic particles and water-repellent organic material contained in the water-repellent particles. The definition is the same when the mother particles are composed of particles of the hydrophilic organic particles and when the mother particles are composed of the composite particles containing at least the hydrophilic organic particles.

Inorganic particles constituting the composite particles together with the hydrophilic organic particles, and inorganic particles adhered to the mother particles together with the hydrophobic organic particles will be described below. Both non-porous particles and porous particles may be used as the inorganic particles. Examples of the inorganic particles include colorless, pale colored or white particles (for example colloidal silica, alumina, calcium carbonate, zinc oxide, titanium oxide and tin oxide). These inorganic particles may be subjected to surface treatment (such as partially hydrophobizing treatment, specified functional group introducing treatment). For example, an alkyl group is introduced into silica by treating hydroxyl groups of silica with a silylation agent such as trimethylchlorosilane and t-butyldimethylchlorosilane. The reaction proceeds to generate dehydrochlorination by the silylation agent. Amines may be added for accelerating the reaction by converting hydrochloric acid into hydrochloride. The reaction may be controlled by control of the amount of treatment and treatment conditions with silane coupling agents having an alkyl group or a phenyl group as the hydrophobic group, titanate coupling agents and zirconate coupling agents. Aliphatic alcohols and higher fatty acids, or derivatives thereof, may also be used for the surface treatment. Surface treatment with a coupling agent having cationic functional groups such as a silane coupling agent having (substituted) amino groups and quaternary ammonium salt structure, a coupling agent having fluorine functional groups such as fluorosilane, and other coupling agents having anionic functional groups such as carboxylic acids are also possible. These inorganic particles may be incorporated into the hydrophilic organic particles, or may be so-called internal addition particles.

The particle diameter of the inorganic particles constituting the composite particles is from about 10 nm to about 30 μm, desirably from about 50 nm to about 10 μm, and more desirably from about 0.1 μm to about 5 μm in the sphere-reduced average particle diameter, while the particle diameter of the inorganic particles adhered to the mother particles is from about 10 nm to about 1 μm, desirably from about 10 nm to about 0.1 μm, and more desirably from about 10 nm to about 0.05 μm in the sphere-reduced average particle diameter.

The other additives of the ink-recipient particles in the exemplary embodiment of the invention will be described below. The ink-recipient particles of the exemplary embodiment of the invention desirably contain components capable of aggregating or thickening the ink component.

The component having above-mentioned function may be contained as functional group of the organic resins or may be contained as compound, for example. Examples of the functional groups or compounds are carboxylic acid, polyvalent metal cations and polyamines.

Examples of the compound preferably include coagulants such as inorganic electrolytes, organic acids, inorganic acids and organic amines.

Examples of the inorganic electrolyte include salts of alkali metal ions such as lithium ion, sodium ion and potassium ion, polyvalent metal ions such as aluminum ion, barium ion, calcium ion, copper ion, iron ion, magnesium ion, manganese ion, nickel ion, tin ion, titanium ion and zinc ion with hydrochloric acid, hydrobromic acid, hydroiodic acid, sulfuric acid, nitric acid, phosphoric acid, thiocyanic acid, and organic carboxylic acid and organic sulfonic acid such as acetic acid, oxalic acid, lactic acid, fumaric acid, citric acid, salicylic acid and benzoic acid.

Specific examples include alkali metal salts such as lithium chloride, sodium chloride, potassium chloride, sodium bromide, potassium bromide, sodium iodide, potassium iodide, sodium sulfate, potassium nitrate, sodium acetate, potassium oxalate, sodium citrate and potassium benzoate; and polyvalent metal salts such as aluminum chloride, aluminum bromide, aluminum sulfate, aluminum nitrate, sodium aluminum sulfate, potassium aluminum sulfate, aluminum acetate, barium chloride, barium bromide, barium iodide, barium oxide, barium nitrate, barium thiocyanate, calcium chloride, calcium bromide, calcium iodide, calcium nitrite, calcium nitride, calcium nitrate, calcium dihydrogen phosphate, calcium thiocyanate, calcium benzoate, calcium acetate, calcium salicylate, calcium tartrate, calcium lactate, calcium fumarate, calcium citrate, copper chloride, copper bromide, copper sulfate, copper nitrate, copper acetate, iron chloride, iron bromide, iron iodide, iron sulfate, iron nitride, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogenphosphate, manganese acetate, manganese salicylate, manganese benzoate, manganese lactate, nickel chloride, nickel bromide, nickel sulfate, nickel nitride, nickel acetate, tin sulfate, titanium chloride, zinc chloride, zinc bromide, zinc sulfate, zinc nitrate, zinc thiocyanate and zinc acetate.

Specific examples of the organic acid include alginic acid, citric acid, glycine, glutamic acid, succinic acid, tartaric acid, cysteine, oxalic acid, fumaric acid, phthalic acid, maleic acid, malonic acid, lysine, malic acid and compounds represented by formula (1), and derivatives of these compounds.

(1)

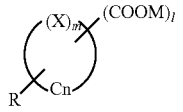

In the formula, X represents O, CO, NH, $NR_1$, S or $SO_2$. $R_1$ represents an alkyl group, which is desirably $CH_3$, $C_2H_5$ or $C_2H_4OH$. R represents an alky group, which is desirably $CH_3$, $C_2H_5$ or $C_2H_4OH$. R may be included or not included in the formula. X is desirably CO, NH, NR or O, more desirably CO, NH or O. M represents hydrogen atom, alkali metals or ammines. M is desirably H, Li, Na, K, monoethanolamine, diethanolamine or triethanolamine, more preferably H, Na or K, and further preferably hydrogen atom. n is an integer from 3 to 7. n is desirably a number for forming 6- or 5-membered heterocyclic ring, more preferably 5-membered heterocyclic ring. m is 1 or 2. The compound represented by formula (1) may be a heterocyclic ring, either saturated heterocyclic ring or unsaturated heterocyclic ring. 1 is an integer from 1 to 5.

Specific examples of the compound represented by formula (1) include compounds having a furan, pyrrole, pyrroline, pyrrolidone, pyron, thiophene, indole, pyridine or quinoline structure, and further having a carboxyl group as a functional group. Specific examples include 2-pyrrolidone-5-carboxylic acid, 4-methyl-4-pentanolido-3-carboxylic acid, furan carboxylic acid, 2-benzofuran carboxylic acid, 5-methyl-2-furan carboxylic acid, 2,5-dimethyl-3-furan carboxylic acid, 2,5-furan dicarboxylic acid, 4-butanolido-3-carboxylic acid, 3-hydroxy-4-pyrone-2,6-dicarboxylic acid, 2-pyron-6-carboxylic acid, 4-pyron-2-carboxylic acid, 5-hydroxy-4-pyrone-5-carboxylic acid, 4-pyrone-2,6-dicarboxylic acid, 3-hydroxy-4-pyrone-2,6-dicarboxylic acid, thiophene carboxylic acid, 2-pyrrole carboxylic acid, 2,3-dimethylpyrrole-4-carboxylic acid, 2,4,5-trimethylpyrrole-3-propionic acid, 3-hydroxy-2-indole carboxylic acid, 2,5-dioxo-4-methyl-3-pyrroline-3-propionic acid, 2-pyrrolidine carboxylic acid, 4-hydroxyproline, 1-methylpyirolidine-2-carboxylic acid, 5-carboxy-1-methylpyrrolidine-2-acetic acid, 2-pyridine carboxylic acid, 3-pyridine carboxylic acid, 4-pyridine carboxylic acid, pyridine dicarboxylic acid, pyridine tricarboxylic acid, pyridine pentacarboxylic acid, 1,2,5,6-tetrahydro-1-methyl nicotinic acid, 2-quinoline carboxylic acid, 4-quinoline carboxylic acid, 2-phenyl-4-quinoline carboxylic acid, 4-hydroxy-2-quinoline carboxylic acid and 6-methoxy-4-quinoline carboxylic acid.

The organic acid is desirably citric acid, glycine, glutamic acid, succinic acid, tartaric acid, phthalic acid, pyrrolidone carboxylic acid, pyrone carboxylic acid, pyrrole carboxylic acid, furan carboxylic acid, pyridine carboxylic acid, coumalic acid, thiophene carboxylic acid or nicotinic acid, or derivatives thereof, or salts thereof. The organic acid is more desirably pyrrolidone carboxylic acid, pyrone carboxylic acid, pyrrole carboxylic acid, furan carboxylic acid, pyridine carboxylic acid, coumalic acid, thiophene carboxylic acid or nicotinic acid, or derivatives thereof, or salts thereof, more desirably pyrrolidone carboxylic acid, pyrone carboxylic acid, furan carboxylic acid or coumalic acid, or derivatives thereof, or salts thereof.

The organic amine may be any one of primary, secondary, tertiary and quaternary amines, and salts thereof. Specific examples include tetraalkyl ammonium, alkylamine, benzarconium, alkyl pyridium, imidazolium and polyamine, and derivatives thereof and salts thereof. Specific examples include amylamine, butylamine, propanolamine, propylamine, ethanolamine, ethylethanolamine, 2-ethylhexylamine, ethylmetylamine, ethylbenzylamine, ethylenediamine, octylamine, oleylamine, cyclooctylamine, cyclobutylamine, cyclopropylamine, cyclohexylamine, diisopropanolamine, diethanolamine, diethylamine, di-2-ethylhexylamine, diethylene triamine, diphenylamine, dibutylamine, dipropylamine, dihexylamine, dipentylamine, 3-(dimethylamino)propylamine, dimethylethylamine, dimethylethylene diamine, dimethyloctylamine, 1,3-dimethylbutylamine, dimethyl-1,3-propane diamine, dimethylhexylamine, aminobutanol, aminopropanol, aminopropane diol, N-acetylamino ethanol, 2-(2-aminoethylamino)ethanol, 2-amino-2-ethyl-1,3-propanediol, 2-(2-aminoethoxy)ethanol, 2-(3,4-dimethoxyphenyl)ethylamine, cetylamine, triisopropanolamine, triisopentylamine, triethanolamine, trioctylamine, trithylamine, bis(2-aminoethyl)-1,3-propane diamine, bis(3-aminopropy)ethylenediamine, bis(3-aminopropyl)-1,3-propane diamine, bis(3-aminopropyl)methylamine, bis(2-ethylhexyl)amine, bis(trimethylsilyl)amine, butylamine, butylisopropylamine, propane diamine, propyldiamine, hexylamine, pentylamine, 2-methylcyclohexylamine, methylpropylamine, methylbenzylamine, monoethanolamine, laurylamine, nonylamine, trimethylamine, triethylamine, dimethylpropylamine, propylenediamine, hexamethylenediamine, tetraethylene pentamine, diethyl ethanolamine, tetramethyl ammonium chloride, tetraethyl ammonium bromide, dihydroxyethyl stearylamine, 2-heptadecenyl hydroxyethyl imidazoline, lauryldimethylbenzyl ammonium chloride, cetylpyridinium chloride, stearamidomethyl pyridium chloride, diallyldimethyl ammonium chloride polymer, diallylamine polymer and monoallylamine polymer.

More preferably, triethanolamine, triisopropanolamine, 2-amino-2-ethyl-1,3-propane diol, ethanolamine, propanediamine and propylamine are used.

Polyvalent metal salts (such as $Ca(NO_3)$, $Mg(NO_3)$, $Al(OH)_3$ and polyaluminum chloride) are favorably used among these coagulants.

One of these coagulants may be used alone, or two or more of them may be used by mixing. The content of the coagulant is desirably from about 0.01% to about 30% by weight, more desirably from about 0.1% to about 15% by weight, and further desirably from about 1% to about 15% by weight.

The particle diameter of the mother particles of the exemplary embodiment of the invention is, as a sphere-reduced average particle diameter, desirably from about 0.1 μm to about 50 μm, more desirably from about 0.5 μm to about 25 μm, and further desirably about 1 μm to about 10 μm.

High image quality may be attained when the sphere-reduced average particle diameter is within above-mentioned range as compared with the case when the sphere-reduced average particle diameter is out of above-mentioned range. In other words, smoothness of the image may be impaired since a difference of level is generated between the portions where the particles are adhered and not adhered to the image surface when the sphere-reduced average particle diameter is large. On the other hand, handling performance of the powder is reduced and the powder cannot be often supplied to desired positions on the transfer body when the sphere-reduced average particle diameter is small. Consequently, there are portions with no liquid-absorbing particles on the image to fail in attaining high recording speed and high image quality. When the ink-recipient particles are composed of primary particles, above-mentioned range of the sphere-reduced average particle diameter is desirable.

The proportion of the polar monomer to all the monomer components in the hydrophilic organic particles is from 10 mol % to 90 mol %, or from about 10 mol % to about 90 mol %, desirably from 15 mol % to 85 mol %, or from about 15 mol % to about 85 mol %, and further desirably from 30 mol % to 80 mol %, or from about 30 mol % to about 80 mol %.

Since the ink is trapped in higher speed in the particles and in the voids between the particles when the proportion of the monomer is within above-mentioned range as compared with the case when the proportion of the monomer is out of above-mentioned range, various inks may be received in higher speed, and printing in higher speed is possible.

The hydrophilic organic particles favorably contain a weakly liquid-absorbent resin. The weakly liquid-absorbent resin refers to a lyophilic resin capable of absorbing from several % (~5%) to several hundreds % (~500%), desirably from 5% to 100% of the liquid relative to the weight of the resin when the absorbed liquid is water.

Ink retention capacity of the ink-recipient particles decreases when the liquid-absorbent ability of the weakly liquid-absorbent resin is less than 5%, while the ink-recipient particles actively absorb moisture with large environment dependency when the ink retention capacity exceeds 500%.

The proportion of the polar monomer to all the monomers in the hydrophobic organic particles is from about 0 mol % to about 10 mol %, desirably from about 0.1 mol % to about 8 mol %, and more desirably from about 2 mol % to about 5 mol %.

When the proportion of the polar monomer is within above-mentioned range, chargeability on the surface of the ink-recipient particles is secured when the hydrophilic organic particles contained in the mother particles have absorbed moisture in air during storage of the ink-recipient particles or when the ink-recipient particles have absorbed the liquid component. These ink-recipient particles are able to be supplied to the intermediate transfer body, and an image suppressed from being disturbed may be formed without elimination of the ink-recipient particles from the intermediate transfer body.

(Material for Recording)

Material for recording of the exemplary embodiment of the invention is provided with an ink containing at least a recording material and the ink-recipient particles of the exemplary embodiment of the invention. Recording of an image is possible by transfer of the ink-recipient particles to a recording medium after allowing the ink-recipient particles to receive the ink.

The ink will be described in detail below. While both aqueous inks and oily inks are available, the aqueous ink is used in terms of environmental problems. The aqueous ink (simply referred to as "ink" hereinafter) contains a recording material as well as an ink solvent (for example water or an aqueous organic solvent). Other additives may be optionally contained.

The recording material will be described first. An example of the recording material is a colorant. While the colorant available is either a dye or a pigment, the pigment is preferable. Any of organic pigments and inorganic pigments may be used. Examples of the black pigment include carbon black pigments such as furnace black, lamp black, acetylene black and channel black. Black color and three primary colors of cyan, magenta and yellow as well as pigments of specified colors such as red, green, blue, charcoal and white, metallic luster pigments of gold and silver colors, colorless or pale-colored extender pigments, and plastic pigments may be used. The pigment may be optionally synthesized for use in the exemplary embodiment of the invention.

Particles prepared by adhering a dye or pigment to surface of cores of silica, alumina or polymer beads, insoluble lake of dyes, colored emulsions and colored latexes may also be used as the pigment.

While specific examples of the black pigment include RAVEN 7000, RAVEN 5750, RAVEN 5250, RAVEN 5000 ULTRA II, RAVEN 3500, RAVEN 2000, RAVEN 1500, RAVEN 1250, RAVEN 1200, RAVEN 1190 ULTRA II, RAVEN 1170, RAVEN 1255, RAVEN 1080 and RAVEN 1060 (manufactured by Columbian Carbon Corp.), REGAL 400R, REGAL 330R, REGAL 660R, MOGUL L, BLACK PEARLS L, MONARCH 700, MONARCH 800, MONARCH 880, MONARCH 900, MONARCH 1000, MONARCH 1100, MONARCH 1300 and MONARCH 1400 (manufactured by Cabot Corp.), COLOR BLACK FW1, COLOR BLACK FW2, COLOR BLACK FW2V, COLOR BLACK 18, COLOR BLACK FW200, COLOR BLACK S150, COLOR BLACK S160, COLOR BLACK S170, PRINTEX 35, PRINTEX U, PRINTEX V, PRINTEX 140U, PRINTEX 140V, SPECIAL BLACK 6, SPECIAL BLACK 5, SPECIAL BLACK 4A and SPACIAL BLACK 4 (manufactured by Degussa), and NO. 25, NO. 33, NO. 40, NO. 47, NO. 52, NO. 900, NO. 2300, MCF-88, MA 600, MA 7, MA 8 and MA 100 (manufactured by Mitsubishi Chemical Corp.), the pigments are not restricted to these examples.

While examples of the cyan pigment include C.I. Pigment Blue-1, -2, -3, -15, -15:1, -15:2, -15:3, 15:4, -16, -22 and -60, the pigments are not restricted to these examples.

While examples of the magenta pigment include C.I. Pigment Red-5, -7, -12, -48, -48:1, -57, -112, -122, -123, -146, -168, -177, -184 and -202, and C.I. Pigment Violet-19, the pigments are not restricted to these examples.

While examples of the yellow pigment include C.I. Pigment Yellow-1, -2, -3, -12, -13, -14, -16, -17, -73, -74, -75, -83, -93, -95, -97, -98, -114, -128, -129, -138, -151, -154 and -180, the pigments are not restricted to these examples.

When the pigment is used as the colorant, it is desirable to use a pigment dispersion agent together. Examples of the pigment dispersion agent available include polymer dispersion agents, anionic surfactants, cationic surfactants, amphoteric surfactants and nonionic surfactants.

Polymers having a hydrophilic structure and hydrophobic structure may be favorably used as the polymer dispersion agent. Condensation polymers and addition polymers may be used as the polymers having the hydrophilic structure and hydrophobic structure. Examples of the condensation polymer are known polyester dispersion agents. Examples of the addition polymers are addition polymers of monomers having α,β-ethylenic unsaturated groups. Desired polymer dispersion agents may be obtained by copolymerizing a mixture of monomers having α,β-ethylenic unsaturated groups and having hydrophilic groups and monomers having α,β-ethylenic unsaturated groups and having hydrophobic groups. Homopolymers of monomers having α,β-ethylenic unsaturated groups having hydrophilic groups may also be used.

Examples of the monomer having α,β-ethylenic unsaturated groups and having hydrophilic groups include monomers having carboxyl group, sulfonic acid group, hydroxyl group or phosphoric acid group, for example acrylic acid, methacrylic acid, crotonic acid, itaconic acid, itaconic monoester, maleic acid, maleic acid monoester, fumaric acid, fumaric acid monoester, vinylsulfonic acid, styrenesulfonic acid, sulfonated vinylnaphthalene, vinyl alcohol, acrylamide, methacryloxyethyl phosphate, bismethacryloxyethyl phosphate, methacryloxyethylphenyl acid phosphate, ethyleneglycol dimethacrylate and diethyleneglycol dimethacrylate.

Examples of the monomer having the α,β-ethylenic unsaturated group and having hydrophobic groups include styrene derivatives such as styrene, α-methyl styrene and vinyl toluene, vinyl cyclohexane, vinyl naphthalene, vinyl naphthalene derivatives, acrylic acid alkyl ester, methacrylic acid alkyl eater, methacrylic acid phenyl ester, methacrylic acid cycloalkyl ester, crotonic acid alkyl ester, itaconic acid dialkyl ester and maleic acid dialkyl ester.

Examples of the desirable copolymer used for the polymer dispersion agent include styrene-styrene-sulfonic acid copolymer, styrene-maleic acid copolymer, styrene-methacrylic acid copolymer, styrene-acrylic acid copolymer, vinyl naphthalene-maleic acid copolymer, vinyl naphthalene-methacrylic acid copolymer, vinyl naphthalene-acrylic acid copolymer, acrylic acid alkyl ester-acrylic acid copolymer, methacrylic acid alkyl ester-methacrylic acid copolymer, styrene-methacrylic acid alkyl ester-methacrylic acid copolymer, styrene-acrylic acid alkyl ester-acrylic acid copolymer, styrene-methacrylic acid phenyl ester-methacrylic acid copolymer and styrene-methacrylic acid cyclohexyl ester-methacrylic acid copolymer. These polymers may be copolymerized with monomers having polyoxyethylene group or hydroxyl group.

The polymer dispersion agent has a weight average molecular weight of, for example, from 2,000 to 50,000.

One of these pigment dispersing agent may be used alone, or two or more of them may be used together. While the amount of addition of the pigment dispersing agent cannot be uniquely determined since it is largely different depending on the pigments, it is usually from about 0.1% to about 100% by weight relative to the amount of the pigment.

Pigments self-dispersible in water may be used as the colorant. The pigments self-dispersible in water refer to pigments having a number of water-solubilizing groups on the surface of the pigment and capable of being dispersed in water without adding the polymer dispersion agent. Specifically, the pigment self-dispersible in water may be obtained by subjecting so-called common pigments to a surface modification treatment such as acid-base treatment, coupling agent treatment, polymer graft treatment, plasma treatment or oxidation/reduction treatment.

Examples of the pigment self-dispersible in water include the pigments subjected to surface modification treatment as described above as well as commercially available pigments self-dispersible in water such as CAB-O-JET-200, CAB-O-JET-250, CAB-O-JET-260, CAB-O-JET-270, CAB-O-JET-300 (manufactured by Cabot Corp.), and MICROJET BLACK CW-1 and CW-2 (manufactured by Orient Chemical Industries, Ltd.).

The self-dispersible pigment desirably has at least sulfonic acid, sulfonic acid salts, carboxylic acid or carboxylic acid salts as functional groups on the surface of the pigment. The pigment more desirably has at least carboxylic acid or carboxylic acid salts on the surface as functional groups.

Pigments coated with a resin may also be used. The pigment is called as a microcapsule pigment, and examples of the microcapsule pigment available include commercially available microcapsule pigments manufactured by Dainippon Ink and Chemicals, Inc. and Toyo Ink Mfg. Co., Ltd. as well as microcapsule pigments as test products for the exemplary embodiment of the invention.

Resin dispersible pigments prepared by physically adsorbing or chemically bonding a polymer substance to the pigment may also be used.

Other examples of the recording material include hydrophilic anionic dyes, direct dyes, cationic dyes, reactive dyes, dyes such as polymer dyes and oil-soluble dyes, wax powders, resin powders and emulsions colored with dyes, fluorescent dyes and fluorescent pigments, IR absorbing agents, UV absorbing agents, magnetic materials such as ferromagnetic materials represented by ferrite and magnetite, titanium oxide, semiconductors and photocatalysts represented by zinc oxide, and particles of other organic and inorganic electronic materials.

The content (concentration) of the recording material is, for example, in the range from about 5% to about 30% by weight relative to the amount of the ink.

The volume average particle diameter of the recording material is, for example, from about 10 nm to about 1,000 nm.

The volume average particle diameter of the recording material refers to the recording material's own particle diameter, or the particle diameter including additives such as dispersion agents adhering to the recording material in a case that the additives have adhered to the recording particle. MICROTRACK UPA particle diameter analyzer 9340 (trade name, manufactured by Leeds & Northrup) is used as a measuring apparatus of the volume average particle diameter. The ink (4 ml) is charged in a measuring cell, and the volume average particle diameter is measured by a predetermined measuring method. The viscosity of the ink is used as the viscosity and the density of the recording material is used as the density of the dispersed particles as input values necessary for measuring the particle diameter.

The water-soluble organic solvent will be described below. Examples of the water-soluble organic solvent used include polyfunctional alcohols, polyfunctional alcohol derivatives, nitrogen-containing solvents, alcohols and sulfur-containing solvents.

Specific examples of the water-soluble solvent include, as the polyfunctional alcohols, ethyleneglycol, diethyleneglycol, propyleneglycol, butyreneglycol, triethyleneglycol, 1,5-pentane diol, 1,2-hexane diol, 1,2,6-hexane triol, glycerin, trimethylol propane, sugar alcohols such as xylitol, and sugars such as xylose, glucose and galactose.

Examples of the polyfunctional alcohol derivatives include ethyleneglycol monomethyl ether, ethyleneglycol monoethyl ether, ethyleneglycol monobutyl ether, diethyleneglycol monomethyl ether, diethyleneglycol monoethyl ether, diethyleneglycol monobutyl ether, propyleneglycol monobutyl ether, dipropyleneglycol monobutyl ether and ethyleneoxide adduct of diglycerin.

Examples of the nitrogen-containing solvent include pyrrolidone, N-methyl-2-pyrrolidone, cyclohexyl pyrrolidone and triethanolamine; and examples of alcohol include ethanol, isopropyl alcohol, butyl alcohol and benzyl alcohol.

Examples of the sulfur-containing solvent include thiodiethanol, thiodiglycerol, sulfolane and dimethylsulfoxide.

Propylene carbonate and ethylene carbonate may also be used as the water-soluble organic solvent.

At least one or more of the water-soluble organic solvents may be used. The content of the water-soluble organic solvent is from about 1% to about 70% by weight.

Water will be described below. Ion-exchange water, ultrapure water, distilled water or ultrafiltration water may be used for preventing impurities from being mingled.

Other additives will be described below. A surfactant may be added to the ink.

Examples of the surfactant include various anionic surfactants, nonionic surfactants, cationic surfactants and amphoteric surfactants. It is desirable to use the anionic surfactant and nonionic surfactant.

Specific examples of the surfactant will be listed below.

Examples of the anionic surfactant available include alkylbenzene sulfonate, alkylphenyl sulfonate, alkylnaphthalene sulfonate, salts of higher fatty acid, sulfate of higher fatty acid ester, sulfonate of higher fatty acid ester, sulfate and sulfonate of higher alcohol ether, higher alkyl sulfosuccinate, plyoxyethylene alkylether carboxylate, polyoxyethylene alkylether sulfate, alkylphosphate and polyoxyethylene alkylether phosphate. Dodecylbenzene sulfonate, isopropylnaphthalene sulfonate, monobutylphenylphenol monosulfonate, monobutylbiphenyl sulfonate, monobutylbiphenyl sulfonate and dibutylphenylphenol disulfonate are desirably used.

Examples of the nonionic surfactants available include polyoxyethylene alkylether, polyoxyethylene alkylphenylether, polyoxyethylene fatty acid ester, sorbitan fatty acid ester, polyoxyethylene sorbitan fatty acid ester, polyoxyethylene sorbitol fatty acid ester, glycerin fatty acid ester, polyoxyethylene glycerin fatty acid ester, polyglycerin fatty acid ester, sucrose fatty acid ester, polyoxyethylene alkyl amine, polyoxyethylene fatty acid amide, alkyl alkanol amide, polyethylene glycol polypropyleneglycol block copolymer, acetyleneglycol and polyoxyethylene adduct of acetyleneglycol. Polyoxyethylene nonylphenyl ether, polyoxyethylene octylphenyl ether, polyoxyethylene dodecylphenyl ether, polyoxyethylene alkylether, polyoxyethylene fatty acid ester, sorbitan fatty acid ester, polyoxyethylene sorbitan fatty acid ester, fatty acid alkyrol amide, polyethyleneglycol polypropyleneglycol block copolymer, acetyleneglycol and polyoxyethylene adduct of acetyleneglycol are desirably used.

In addition, silicone surfactants such as polysiloxane oxyethylene adduct; fluorinated surfactants such as perfluoroalkyl carboxylate, perfluoroalkyl sulfate and oxyethylene perfluoroalkyl ether; and bio-surfactants such as spiculisporic acid, rhamnolipid and lysolecithin may also be used.

One of these surfactants may be used alone, or a mixture of them may be used. The hydrophobicity-hydrophilicity balance of the surfactant is desirably in the range from 3 to 20 in terms of solubility.

The amount of addition is desirably from 0.001% to 5% by weight, particularly from 0.01% to 3% by weight.

An penetrant for improving osmosis; polyethylenimine, polyamine, polyvinyl pyrrolidone, polyethyleneglycol, ethyl cellulose and carboxymethyl cellulose for controlling characteristics such as improvement of ink ejectability; alkali metal compounds such as potassium hydroxide, sodium hydroxide and lithium hydroxide for controlling conductivity and pH; and optionally a pH buffering agent, an antioxidant, a fungicide, a viscosity control agent, a conductive agent, ultraviolet absorber and chelating agent; may also be added to the ink.

Exemplary characteristics of the ink will be described below. The ink has a surface tension from about 20 mN/m to about 45 mN/m.

A Wilhelmy type surface tension meter (manufactured by Kyowa Interface Science Co., Ltd.) is used for measuring the surface tension, and values measured at 23° C. and 55% RH are employed.

The viscosity of the ink is from about 1.5 mP·s to about 30 mP·s.

RHEOMAT 115 (manufactured by Contraves) is used for the measurement, and values at 23° C. with a shear rate of 1400 $s^{-1}$ are employed.

The ink is not restricted to above-mentioned constitution. The ink may contain, for example, functional materials such as liquid crystal materials and electronic materials in addition to the recording materials.

(Ink-recipient Particle Storage Member)

The ink-recipient particle storage member of the exemplary embodiment of the invention is attachable to and detachable from a recording apparatus. The member stores the ink-recipient particle storage member of the exemplary embodiment of the invention while it supplies the ink-recipient particles to a particle coating device (particle supply device) of the recording apparatus.

Figure 8:
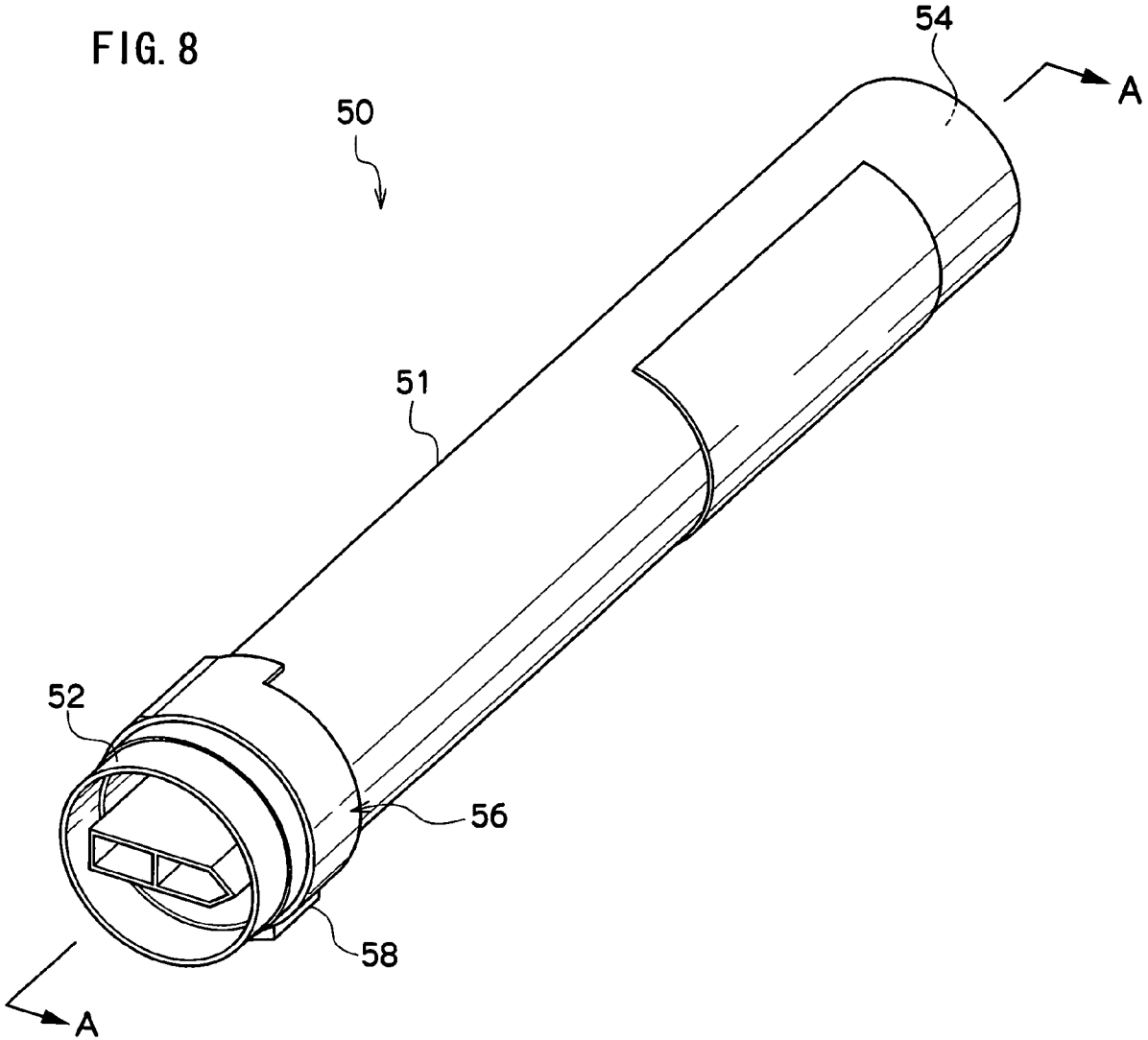
FIG. 8 is a perspective view showing a cartridge for storing the ink-recipient particles according to the second exemplary embodiment of the invention.
Figure 9:
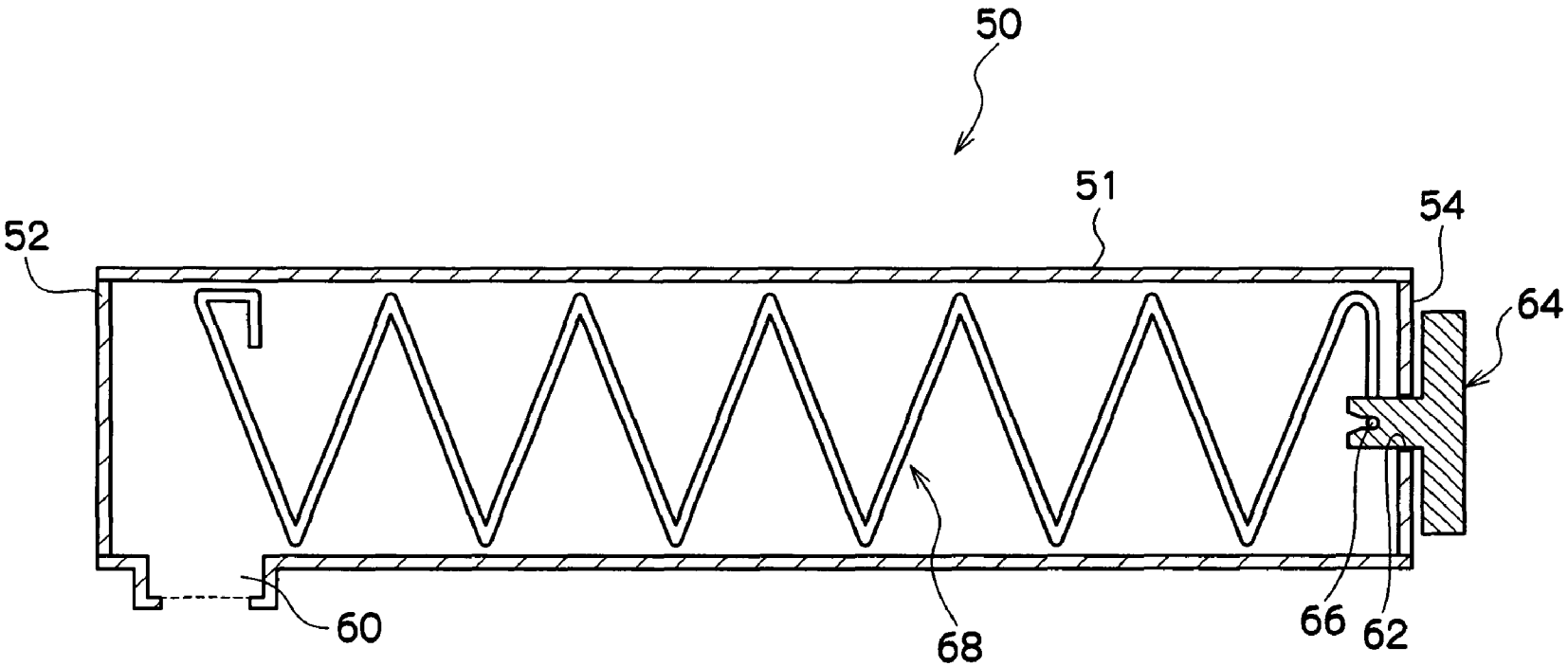
FIG. 9 shows a cross-section along the line A-A in FIG. 8.

The ink-recipient particle storage member of the exemplary embodiment of the invention will be described below with reference to the drawing. FIG. 8 is a perspective view of the cartridge for storing the ink-recipient particles according to the exemplary embodiment of the invention. FIG. 9 shows a cross section along the line A-A in FIG. 8.

The storage cartridge 50 of the ink-recipient particles according to the exemplary embodiment of the invention has a cylindrical particle storage cartridge body 51 and side walls 52 and 54 fitted at both end of the particle storage cartridge body 51.

A supply port 60 for supplying the ink-recipient particles to a particle application device (particle supply device, not shown) of the recording apparatus is provided on the circumference surface at one end side of the particle storage cartridge body 51. A belt member 56 freely slidable relative to the particle storage cartridge body 51 is also provided. A housing 58 for housing the supply port 60 is provided at the outside of the supply port 60 on the belt member 56.

Accordingly, the supply port 60 is housed in the housing 58 and the ink-recipient particles in the particle storage cartridge body 51 do not leak out of the supply port 60 of the cartridge when the particle storage cartridge 50 is not attached to the recording apparatus (or immediately after attaching the cartridge to the recording apparatus).

A hole 62 is open at the center of the side wall 54 at the other end of the particle storage cartridge body 51, and a joint 66 of a coupling member 64 penetrates through the hole 62 of the side wall 54 into the particle storage cartridge body 51. The coupling member 64 is attached to be freely rotatable against the side wall 54.

An agitator 68 is provided in the particle storage cartridge body 51. The agitator 68 is formed into a spiral with a metal wire member, for example stainless steel (SUS 304 WP) wire, having a round cross section. One end of the agitator is bent toward a rotation axis (center of rotation), and is connected to the coupling member 64. The other end of the agitator is a non-constrained free end.

The agitator 68 is rotated by receiving a rotation force from the joint 66 of the coupling member 64, and transports the ink-recipient particles in the particle storage cartridge body 51 toward the supply port 60 while the particles are agitated. In this way, the ink-recipient particles are replenished into the recording apparatus by releasing the particles from the supply port 60.

However, the constitution of the ink-recipient particle storage member of the exemplary embodiment of the invention is not restricted to those described above.

(Recording Apparatus)

The recording apparatus of the exemplary embodiment of the invention uses an ink containing recording materials and ink-recipient particles of the exemplary embodiment of the invention, and the recording method includes the steps of ejecting an ink (ink ejection step), transferring the ink-recipient particles that have received the ink onto a recording medium (transfer step), and fixing the ink-recipient particles transferred onto the recording medium (fixing step).

Specifically, the ink-recipient particles are supplied as a layer to the intermediate member (intermediate transfer body) from a supply device. The ink-recipient particles formed as a layer (referred to as ink-recipient particle layer hereinafter) is made to receive the ink by ejecting it from an ink ejection device. The ink-recipient particle layer that have received the ink is transferred onto a recording medium from the intermediate member by the transfer device. Transfer of either the entire ink-recipient particle layer or a recording part (an ink-recipient part) of the ink-recipient particle layer is selectively performed. The ink-recipient particle layer transferred onto the recording medium is pressurized (or heated and pressurized) with a fixing device thereafter to fix the layer. Recording is thus performed with the ink-recipient particles that have received the ink. Transfer and fixing may be substantially simultaneous, or may be separately performed.

While the ink-recipient particles are formed into a layer for receiving the ink, the thickness of the ink-recipient particle layer is, for example, in the range from about 1 μm to about 100 μm, desirably from about 3 μm to about 60 μm, and more desirably from about 5 μm to about 30 μm. The void ratio in the ink-recipient particle layer (or void ratio between the ink-recipient particles+void ratio in the ink-recipient particles (trap structure)) is, for example, in the range from about 10% to about 80%, desirably from about 30% to about 70%, and more desirably from about 40% to about 60%.

A releasing agent may be applied to the surface of the intermediate body before supplying the ink-recipient particles. Examples of the releasing agent include (modified) silicone oil, fluorinated oil, hydrocarbon oil, mineral oil, plant oil, polyalkyleneglycol, alkyleneglycol ether, alkane diol and molted wax.

Both permeable media (for example plain paper and coat paper) and non-permeable media (for example art paper and resin film) may be used for the recording medium. The recording medium is not restricted to these media, and industrial products such as semiconductor substrates may be used.

Figure 10:
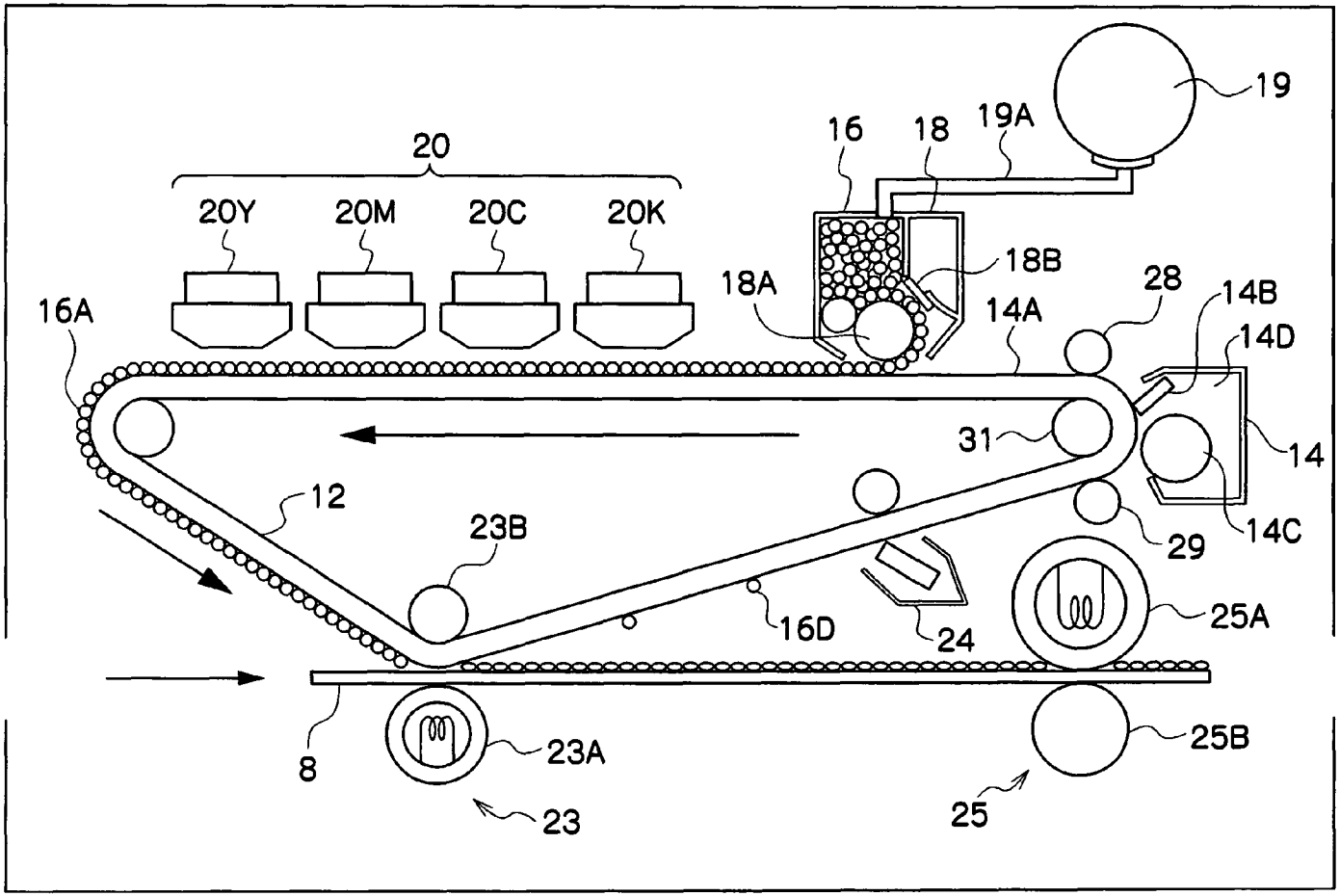
FIG. 10 shows a recording apparatus according to the second exemplary embodiment of the invention.
Figure 11:
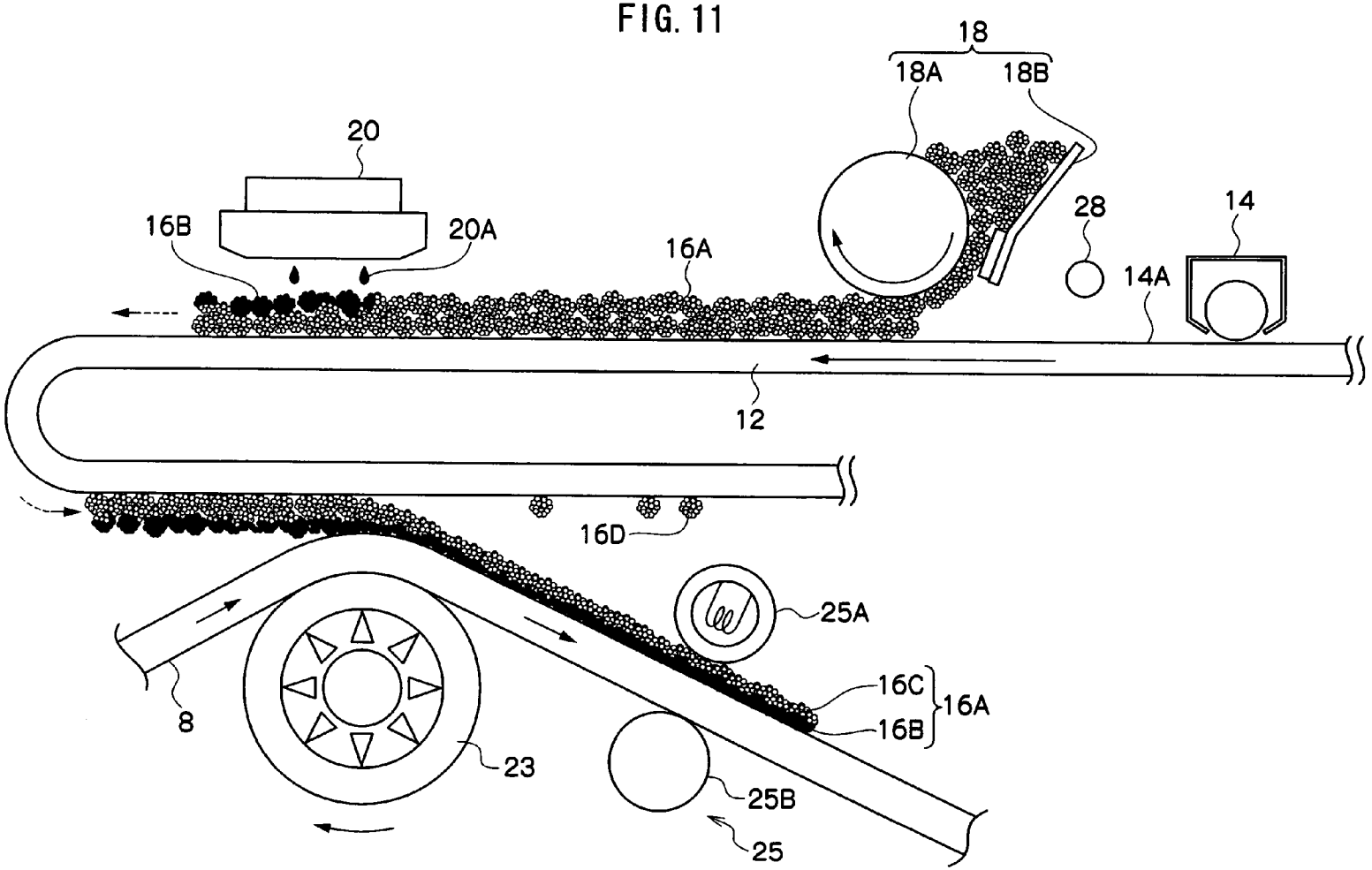
FIG. 11 shows a main part of the recording apparatus according to the second exemplary embodiment of the invention.
Figure 12A:
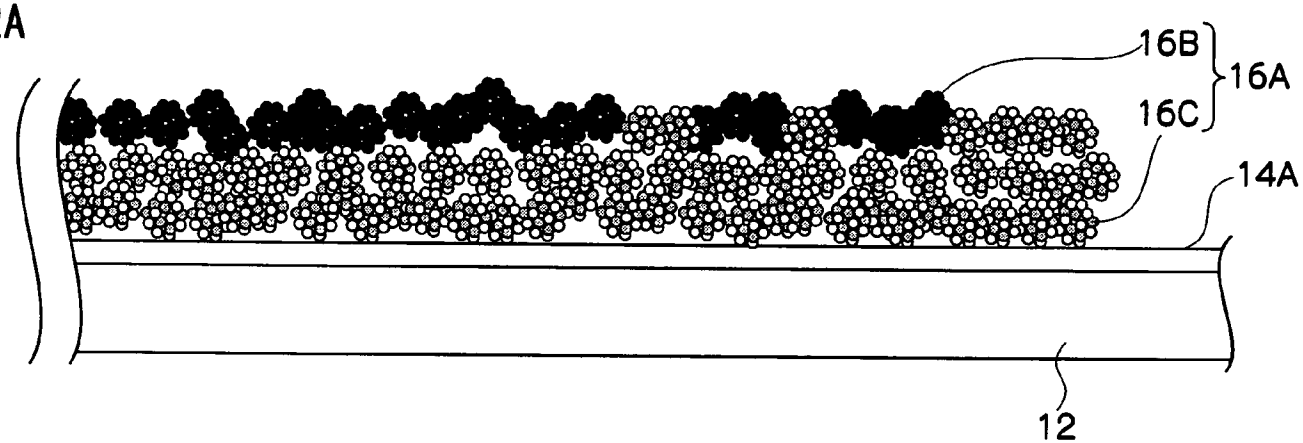
FIGS. 12A and 12B show an ink-recipient particle layer according to the second exemplary embodiment of the invention.
Figure 12B:
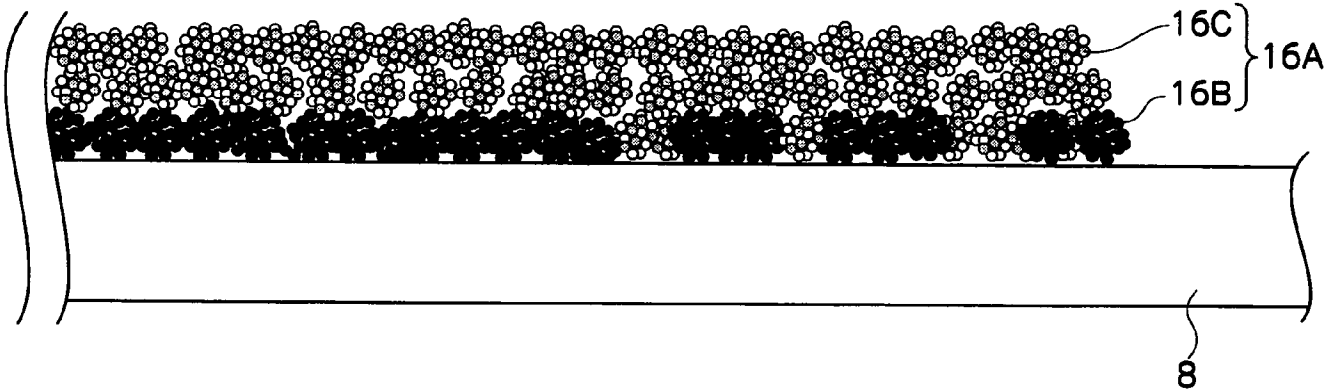

The exemplary embodiment of the recording apparatus according to the invention will be described below with reference to drawings. FIG. 10 shows the recording apparatus according to the exemplary embodiment of the invention. FIG. 11 shows the main part of the recording apparatus according to the exemplary embodiment of the invention. FIG. 12A and 12B show the ink-recipient particle layer according to the exemplary embodiment of the invention. In the exemplary embodiment, composite particles are used as the mother particles of the ink-recipient particles. The same constitution elements as the constituting elements in the recording apparatus of the first exemplary embodiment shown in FIG. 1 are given the same reference numerals.

As shown in FIG. 10, the recording apparatus 11 according to the exemplary embodiment of the invention includes an intermediate transfer body 12 as an endless belt, a charging device 28 for charging the surface of the intermediate transfer body 12, a particle application device 18 for forming a particle layer by adhering the ink-recipient particles 16 to the charged region on the intermediate transfer body 12, ink-jet recording heads 20 for forming an image by ejecting ink droplets on the particle layer, a transfer device 23 for transferring the ink-recipient particle layer 16A to a recording medium 8 by putting the recording medium 8 on the intermediate transfer body 12 and by applying a pressure and heat, and a fixing device 25 for fixing the ink-recipient particle layer 16A on the recording medium 8. An ink-recipient particle storage cartridge 19 is attachably and detachably linked to a particle application device 18 via a supply pipe 19A.

A releasing agent application device 14 for forming a releasing layer 14A is disposed upstream of the charging device 28, wherein the releasing layer 14A is provided for improving transfer efficiency of the ink-recipient particle layer 16A from the surface of the intermediate transfer body 12 to the recording medium and for enhancing release of the ink-recipient particle layer 16A from the surface of the intermediate transfer body 12.

On the surface of the intermediate transfer body 12 charged with the charging device 28, the ink-recipient particles 16 is formed as a layer by the particle supply device 18, and color images are formed on the particle layer by ejecting ink droplets of respective colors from ink-jet recording heads 20 of the respective colors, that is, 20K, 20C, 20M and 20Y.

The particle layer on the surface of which the color images are formed is transferred together with the color images on the recording medium 8 with the transfer and fixing device (transfer and fixing roller) 22.

Downstream of the transfer and fixing device 22, disposed is a cleaning device 24 for removing the ink-recipient particles 16 remaining on the surface of the intermediate transfer body 12 and for removing foreign substances other than the particles (such as paper powder of the recording medium 8) adhering to the surface of the intermediate transfer body.

The recording medium 8 on which the color image is transferred is directly transported, and the surface of the intermediate transfer body 12 is charged again at the charging device 28. The ink-recipient particles transferred onto the recording medium 8 are promptly transported since they absorb and retain ink droplets 20A.

A discharging device 29 for removing residual charge on the surface of the intermediate transfer body 12 may be optionally disposed between the cleaning device 24 and the releasing agent supply device 14 ("between A and B" means both A and B are not included unless otherwise stated).

In the exemplary embodiment, a surface layer of an ethylene-propylene rubber (EPDM) with a thickness of 400 μm is formed on a polyimide film base of the intermediate transfer body 12 with a thickness of 1 mm. This surface layer desirably has a surface resistant of about $10^{13}$ Ω/□ and a volume resistivity of about $10^{12}$ Ω·cm (semiconductive).

While the intermediate transfer body 12 circulates, the releasing layer 14A is formed on the surface of the intermediate transfer body 12 at first by means of the releasing agent supply device 14. The releasing agent 14D is supplied on the surface of the intermediate transfer body 12 with a feed roller 14C of the releasing agent supply device 14, and the thickness of the releasing layer is determined with a blade 14B.

The releasing agent supply device 14 may continuously contact the intermediate transfer body 12 or may be apart from the intermediate transfer body 12 in order to continuously form and print the image.

Alternatively, supply of the releasing agent 14D may be prevented from being suspended by supplying the releasing agent 14D from an independent liquid supply system (not shown).

Subsequently, the surface of the intermediate transfer body 12 is positively charged by conferring the surface of the intermediate transfer body 12 with a positive charge using the charging device 28. For this purpose, a potential capable of supplying/adsorbing the ink-recipient particles 16 on the surface of the intermediate transfer body 12 may be formed by an electrostatic force capable of being formed between a feed roller 18A of the particle supply device 18 and the surface of the intermediate transfer body 12.

The surface of the intermediate transfer body 12 is charged in this exemplary embodiment by applying a voltage between the charging device 28 and a following roll 31 (grounded) disposed between the charging device 28 and the intermediate transfer body 12 using the charging device 28.

The charging device 28 is a roll-shaped member adjusted to have a volume resistance from about $10^6$ Ω·cm to about $10^8$ Ω·cm by forming an elastic layer (urethane foam resin) in which a conductivity conferring material is dispersed on the outer circumference of a rod made of stainless steel. The surface of the elastic layer is further coated with a water-repellent and oil-repellent coating layer (for example, made of an ethylene tetrafluoride-perfluoroalkyl vinylether copolymer (PFA)) with a thickness from 5 μm to 100 μm.

DC power source is connected to the charging device 28, and the following roll 31 is electrically connected to a frame ground. The charging device 28 is subjected to coupled movement while putting the intermediate transfer body 12 between the charging device 28 and following roll 31, and is able to charge the surface of the intermediate transfer body 12 since a given electric potential is generated at a press point between the grounded following roll 31 and the charging device 28. A voltage of, for example, 1 kV is impressed on the surface of the intermediate transfer body 12 from the charging device 28 to charge the surface of the intermediate transfer body 12.

The charging device 28 may be a corotron or the like.

The ink-recipient particles 16 are supplied on the surface of the intermediate transfer body 12 from the particle supply device 18 to form an ink-recipient particle layer 16A. The particle supply device 18 has the feed roller 18A disposed at a portion facing the intermediate transfer body 12 in a vessel for storing the ink-recipient particles 16 and a charging blade 18B disposed so that it is pressed onto the feed roller 18A. The charging blade 18B also serves for controlling the thickness of the layer of the ink-recipient particles 16 supplied on the surface of the feed roller 18A.

The ink-recipient particles 16 are supplied to the feed roller 18A (conductive roll). The thickness of the ink-recipient particle layer 16A is determined by the charging blade 18B (conductive blade) while the ink-recipient particles are negatively charged so that the particles have polarity opposed to the charge on the surface of the intermediate transfer body 12. An aluminum solid roll may be used for the feed roller 18A, while a metal plate (such as a SUS plate) on which urethane rubber is fixed may be used for the charging blade 18B in order to apply a pressure. The charging blade 18B is in contact with the feed roller 18A by a doctor method.

The charged ink-recipient particles 16 form, for example, one layer of the particle layer on the surface of the feed roller 18A, and are transported to a portion facing the surface of the intermediate transfer body 12. The charged ink-recipient particles 16 are transferred onto the surface of the intermediate transfer body 12 by an electric field generated by a potential difference between the feed roller 18A and the surface of the intermediate transfer body 12.

The travel speed of the intermediate transfer body 12 and rotation speed of the feed roller 18A (circumferential speed ratio) are relatively determined so that one particle layer is formed on the surface of the intermediate transfer body 12. The circumferential speed ratio depends on parameters such as the amount of charge of the intermediate transfer body 12, the amount of charge of the ink-recipient particles 16, the positional relation between the feed roller 18A and intermediate transfer body 12 and the like.

The number of particles supplied onto the intermediate transfer body 12 may be increased by relatively increasing the circumferential speed of the feed roller 18A based on the circumference speed ratio for forming one layer of the ink-recipient particle layer 16A. When the density of a transferred image is low (the amount of ink jetting is small: for example from 0.1 g/m$^2$ to 1.5 g/m$^2$), the thickness of the layer is controlled to be a minimum essential thickness (for example from 1 μm to 5 μm), while the thickness of the layer is controlled to be a thickness (for example from 10 μm to 25 μm) enough for retaining ink liquid components (solvents and dispersion media) when the amount of ink jetting is large (for example from 4 g/m$^2$ to 15 g/m$^2$).

In a case of a letter image or the like that is printed with a small amount of ink jetting, for example, when the image is formed on the one layer of the ink-recipient particles layer on the intermediate transfer body, image-forming components (pigments) in the ink are trapped on the surface of the ink-recipient particle layer on the intermediate transfer body and fixed on the surface of the ink-recipient particles and in internal voids between the particles so that the components have a small distribution in the direction of depth.

For example, when a particle layer 16C as a protective layer is to be provided on an image layer 16B a final image, the layer 16A of the ink-recipient particles is formed with a thickness of three layers or so. When the ink image is formed on the uppermost layer (see FIG. 3A), the particle layer 16C of the two layers on which no image is formed is formed on the image layer 16B to be a protective layer after transfer and fixing of the image (see FIG. 3B).

When an image with a large amount of ink jetting, for example a secondary or tertiary color image, is formed, layers of the ink-recipient particles 16 are laminated with a sufficient number of particles so that the layers are able to retain ink liquid components (solvents and dispersion media) and to trap a recording material (for example a pigment) while the recording material does not reach the lowermost layer. The image forming-material (pigment) is not exposed to the surface of the image layer after transfer and fixing, and the ink-recipient particles 16 that are not involved in imaging may form a protective layer on the surface of the image.

Then, the ink-jet recording head 20 ejects the ink droplets 20A on the ink-recipient particle layer 16A. The ink-jet recording head 20 ejects the ink droplets 20A on predetermined positions based on given image information.

The ink-recipient particle layer 16A is transferred onto the recording medium 8 by applying a pressure and heat to the ink-recipient particle layer 16A after inserting the recording medium 8 and intermediate transfer body 12 into the transfer device 23.

The transfer device 23 includes a heating roll 23A integrating a built-in heat source and a pressurizing roll 23B facing the heating roll 22A across the intermediate transfer body 12. A contact part is formed by contact of the heating roll 23A with the pressurizing roll 23B. The outer surfaces of aluminum cores of the heating roll 23A and pressurizing roll 23B are coated with a silicone rubber, and PFA tubes are further coated on the silicone rubber.

The organic resin constituting the ink-recipient particles 16 at a non-image part is heated at a temperature lower than the glass transition temperature (Tg) of the resin, the ink-recipient particle layer 16A is released from the releasing layer 14A formed on the surface of the intermediate transfer body 12 by pressurizing, and the ink-recipient particle layer is transferred onto the recording medium 8. The intermediate transfer body 12 may be pre-heated before it arrives at the transfer device 23.

The ink-recipient particle layer 16A is finally fixed on the recording medium 8 by applying a pressure and heat to the ink-recipient particle layer 16A after inserting the recording medium 8 and intermediate transfer body 12 into a fixing device 25.

The fixing device 25 includes a heating roll 25A having a built-in heat source, and a pressurizing roll 25B opposed to the heating roll 25A with interposition of the intermediate transfer body 12. A contact part is formed by contact of the heating roll 25A with the pressurizing roll 25B. The outer surfaces of aluminum cores of the heating roll 25A and pressurizing roll 25B are coated with a silicone rubber, and PFA tubes are further coated on the silicone rubber.

The organic resin particles constituting the ink-recipient particle layer 16A is softened (or melted) by heating the resin at a temperature above the glass transition temperature (Tg) at the contact part between the heating roll 25A and pressurizing roll 25B, and the ink-recipient particle layer 16A is fixed on the recording medium 8 by pressurizing.

Fixability is improved by heating. The surface of the heating roll 25A is controlled at 160° C. in the exemplary embodiment of the invention. The ink liquid components (solvents and dispersion media) retained in the ink-recipient particle layer 16A are also retained unchanged in the ink-recipient particle layer 16A after transfer and fixing.

The image forming process of the recording apparatus according to the exemplary embodiment of the invention will be described in detail hereinafter. As shown in FIG. 2, the releasing layer 14A may be formed with the releasing layer supply device 14 on the surface of the intermediate transfer body 12 in the recording apparatus according to the exemplary embodiment of the invention. Forming the releasing layer 14A is particularly desirable when the material of the intermediate transfer body 12 is aluminum and a PET base. Alternatively, the surface itself of the intermediate transfer body 12 may have release ability by using a material of a fluoride resin or silicone rubber.

The surface of the intermediate transfer body 12 is charged to have an inverse polarity to the ink-recipient particles 16 using the charging device 28. The ink-recipient particles 16 supplied with the feed roller 18A of the particle supply device 18 are electrostatically adsorbed, and a layer of the ink-recipient particles 16 may be formed on the surface of the intermediate transfer body 12.

The layer of the ink-recipient particles 16 is formed on the surface of the intermediate transfer body 12 using the feed roller 18A of the particle supply device 18. For example, the ink-recipient particle layer 16A is formed so that the ink-recipient particles 16 are stacked at a thickness of about three layers. The thickness of the ink-recipient particle layer 16A that is transferred onto the recording medium 8 is adjusted by controlling the ink-recipient particle layer 16A by the space between the charging blade 18B and feed roller 18A. Alternatively, the thickness may be adjusted by the circumferential speed ratio between the feed roller 18A and intermediate transfer body 12.

Ink droplets 20A are ejected on the ink-recipient particle layer 16A from ink-jet recording heads 20 of respective colors by a piezoelectric method, thermal method, or the like and the image layer 16B is formed on the ink-recipient particle layer 16A. The ink droplets 20A ejected from the ink-jet recording head 20 are jetted onto the ink-recipient particle layer 16A, and the liquid component of the ink is promptly absorbed into the voids between the ink-recipient particles 16 and into the voids constituting the ink-recipient particles 16 while the recording material (for example pigment) is also trapped on the surface of the ink-recipient particles 16 (constituent particles) or in the voids between the particles constituting the ink-recipient particles 16.

While the ink liquid components (solvents and dispersion media) contained in the ink droplets 20A permeate into the ink-recipient particle layers 16A, the recording material such as the pigment is trapped on the surface of the ink-recipient particle layer 16A or in the void between the particles. In other words, while the ink liquid components (solvents and dispersion media) may be permeated to the back face of the ink-recipient particle layer 16A, the recording material such as the pigment does not permeate to the back face of the ink-recipient particle layer 16A. Therefore, since the particle layer 16C into which the recording material such as the pigment is not permeated is formed on the image layer 16B when the image is transferred onto the recording medium 8, the particle layer 16C serves as a protective layer for confining the surface of the image layer 16B, and an image having no recording materials (for example colorants such as pigments) exposed on the surface may be formed.

A color image is formed on the recording medium 8 by transfer/fixing of the ink-recipient particle layer 16A on which the image layer 16B is formed onto the recording medium 8 from the intermediate transfer body 12. The ink-recipient particle layer 16A on the intermediate transfer body 12 is heated and pressurized with the transfer and fixing device (transfer and fixing roller) 22 heated with a heating device such as a heater, and is transferred on the recording medium 8.

The ink-recipient particle layer 16A transferred onto the recording medium 8 is fixed on the recording medium 8 by being heated and pressurized with a fixing device (fixing roller) 25 heated with a heating device such as a heater. The heating temperature at the fixing device is desirably higher than the heating temperature at the transfer device, and the temperature is desirably higher than the glass transition temperature (Tg) of the organic resin constituting the ink-recipient particle layer 16A.

Glossiness of the surface may be adjusted by controlling the roughness of the surface of the image by heating and pressurizing, or may be adjusted by cooling and separating as will be described hereinafter.

Residual particles 16D remaining on the surface of the intermediate transfer body 12 after separating the ink-recipient particle layer 16A are retrieved with a cleaning device 24 (see FIG. 1), the surface of the intermediate transfer body 12 is charged again with the charging device 28, and the ink-recipient particle layer 16A is formed by supplying the ink-recipient particles 16.

FIGS. 3A and 3B show the particle layer used for forming an image according to the exemplary embodiment of the invention. As shown in FIG. 3A, the releasing layer 14A is formed on the surface of the intermediate transfer body 12.

A layer of the ink-recipient particles 16 is formed on the surface of the intermediate transfer body 12 using the particle supply device 18. The ink-recipient particle layer 16A formed as described above desirably has a thickness corresponding to about three layers of the ink-recipient particles 16. The thickness of the ink-recipient particle layer 16A transferred on the recording medium 8 is controlled by controlling the ink-recipient particle layer 16A to have a desired thickness. The surface of the ink-recipient particle layer 16A is evened to an extent not inhibiting the image (image layer 16B) from being formed by ejection of the ink droplets 20A.

The recording material such as the pigment contained in the ink droplets 20A permeates to a depth from ⅓ to ½ of the ink-recipient particle layer 16A as shown in FIG. 3A, and a particle layer 16C in which the recording material such as the pigment is not permeated remains under the permeated layer.

Since the ink-recipient particle layer 16A formed on the recording medium 8 by transfer with heating and pressurizing using the transfer and fixing device (transfer and fixing roller) 22 includes the particle layer 16C containing no ink on the image layer 16B as shown in FIG. 3B, the image layer 16B is not directly exposed on the surface and the layer 16C serves as a protective layer. Accordingly, the ink-recipient particles 16 should be transparent at least after fixing.

The surface of the particle layer 16C may be flattened by heating and pressurizing with the transfer and fixing device (transfer and fixing roller) 22, and glossiness of the surface of the image may be controlled by heating and pressurizing.

The ink liquid components (solvents and dispersion media) trapped in the ink-recipient particles 16 may be accelerated to be dried by heating.

The ink liquid components (solvents and dispersion media) received and retained in the ink-recipient particle layer 16A are also retained in the ink-recipient particle layer 16A after transfer and fixing, and removed by spontaneous drying.

The image forming process completes through above-mentioned steps. When residual particles 16D remaining on the intermediate transfer body 12 and foreign substances such as paper powders released from the recording medium 8 are left behind on the intermediate transfer body 12 after transfer of the ink-recipient particles 16 to the recording medium 8, they may be removed with the cleaning device 24.

A discharging device 29 may be placed downstream of the cleaning device 24. For example, the surface of the intermediate transfer body 12 is discharged by inserting the intermediate transfer body between a conductive roll used as the discharging device 29 and the following roll 31 (grounded) and by applying a voltage of about ±3 kV at a frequency of 500 Hz to the surface of the intermediate transfer body 12.

Charge voltage, thickness of the particle layer, and other conditions of the devices such as fixing temperature are optimized for respective devices, since the optimum conditions are determined by the ink-recipient particles 16, the composition of the ink, the amount of ejection of the ink and the like.

<Each Constitution Element>

The constituent element of each step in the first exemplary embodiment will be described in detail below.

<Intermediate Transfer Body>

The intermediate transfer body 12 on which the ink-recipient particle layer is formed may be a belt or a cylinder (drum). For supplying and retaining the ink-recipient particles on the surface of the intermediate transfer body by an electrostatic force, the outer circumference of the intermediate transfer body is required to have semiconductive or insulative particle-retaining characteristics. A material is used so that the intermediate transfer body has a surface resistivity from $10^{10}$ Ω/□ to $10^{14}$ Ω/□ and volume resistivity from $10^{9}$ Ω·cm to $10^{13}$ Ω·cm when electrical characteristics of the surface of the intermediate transfer body is semiconductive, while a material is used so that the intermediate transfer body has a surface resistivity of $10^{14}$ Ω/□ and volume resistivity of $10^{13}$ Ω·cm when electrical characteristics of the surface of the intermediate transfer body is insulative.

When the intermediate transfer body is a belt, the base of the belt may be capable of rotary drive of the belt in the apparatus and have a sufficient mechanical strength, and further may have required heat resistance, in particular, in a case that heat is used for transfer and fixing. Specific examples of the material used include polyimide, polyamide-imide, aramid resin, polyethylene terephthalate, polyester, polyether sulfone and stainless steel.

The base may be aluminum, stainless steel or the like when the intermediate transfer member is a drum.

For improving transfer efficiency of the ink-recipient particles 16 (efficient transfer from the intermediate transfer body 12 to the recording medium 8), it is desirable that the releasing layer 14A is formed on the surface of the intermediate transfer body 12. The releasing layer 14A may be formed as a surface (material) of the intermediate transfer body 12, or may be formed as a releasing layer 14A on the surface of the intermediate transfer body 12 by on-process addition.

The releasing layer 14A on the surface of the intermediate transfer body 12 is desirably formed of fluorinated resins such as tetrafluoroethylene-ethylene copolymer, polyvinylidene fluoride, tetrafluoroethylene-perfluoroalkyl vinylether copolymer and tetrafluoroethylene-hexafluoropropylene copolymer, silicone rubber, fluorosilicone rubber and phenyl silicone rubber.

When the releasing layer 14A is formed by on-process addition, the surface of the aluminum is subjected to anodic oxidation when the intermediate transfer member is a drum, while when the intermediate transfer member is a belt, base itself is formed (either the belt or the drum) from silicone rubber, fluorosilicone rubber, phenylsilicone rubber, fluorinated rubber, chloroprene rubber, nitrile rubber, ethylene-propylene rubber, styrene rubber, isoprene rubber, butadiene rubber, ethylene-propylene-butadiene rubber or nitrile butadiene rubber.

When a heating method by electromagnetic induction is used in the transfer step by the transfer device (transfer roller) 23 or in the fixing step by the fixing device (fixing roller) 25, a heating layer may be formed on the intermediate transfer body 12 in place of the transfer device (transfer roller) 23 and/or fixing device (fixing roller) 25. A metal that exhibits electromagnetic induction action is used for the heating layer. For example, nickel, iron, copper, aluminum or chromium may be selected as the metal.

<Particle Supply Process>

The ink-recipient particle layer 16A is formed on the surface of the intermediate transfer body 12. A usually used method for supplying a toner to a photosensitive material in electrophotography may be used as the method for forming the ink-recipient particle layer 16A. The surface of the intermediate transfer body 12 is charged in advance by the usually used charging method (such as charging with the charging device 28) in electrophotography. The ink-recipient particles 16 are charged by frictional electrification (one-component or two-component frictional electrification) to an inverse polarity to the charge on the surface of the intermediate transfer body 12.

The ink-recipient particles 16 retained on the feed roller 18A generates an electric field between the particles and the surface of the intermediate transfer body 12, and are transferred and supplied onto the intermediate transfer body 12 and retained there. The thickness of the ink-recipient particle layer 16A may be controlled depending on the thickness of the image layer 16B formed on the ink-recipient particle layer 16A (in response to the amount of the jetted ink). The absolute value of charging of the ink-recipient particles 16 is desirably in the range from 5 μc/g to 50 μc/g.

The particle supply process corresponding to the one-component supply (development) method will be described below.

The ink-recipient particles 16 are supplied to the feed roller 18A, and the particles are charged while the thickness of the particle layer is controlled with the charging blade 18B.

The charging blade 18B serves for determining the thickness of the layer of the ink-recipient particles 16 on the surface of the feed roller 18A. For example, the thickness of the layer of the ink-recipient particles 16 on the surface of the feed roller 18A is changed by changing the pressure applied to the feed roller 18A. For example, the ink-recipient particles 16 are formed as substantially one layer on the surface of the feed roller 18A, and the ink-recipient particles 16 are formed as one layer on the surface of the intermediate transfer body 12. Alternatively, the compression pressure of the charging blade 18B is controlled low in order to increase the thickness of the layer of the ink-recipient particles 16 formed on the surface of the feed roller 18A, and the thickness of the layer of the ink-recipient particles formed on the surface of the intermediate transfer body 12 may be increased.

Otherwise, when the circumferential speed ratio between the feed roller 18A and intermediate transfer body 12 is adjusted to 1 for forming one layer of the particle layer on the surface of the intermediate transfer body 12, the condition for forming the layer may be controlled so that the number of the ink-recipient particles 16 supplied onto the intermediate transfer body 12 is increased by increasing the circumferential speed of the feed roller 18A to consequently increase the thickness of the layer of the ink-recipient particles on the intermediate transfer body 12. The thickness may be controlled by combining above-mentioned two methods. The ink-recipient particles 16 are negatively charged while the surface of the intermediate transfer body 12 is positively charged in above-mentioned examples.

A pattern covered with the protective layer on the surface may be formed while the amount of consumption of the ink-recipient particle layer is suppressed by controlling the thickness of the ink-recipient particle layer as described above.

A roll with a diameter from 10 mm to 25 mm having a volume resistivity from $10^6$ Ω·cm to $10^8$ Ω·cm may be used as the charging roll in the charging device 28, wherein an elastic layer is formed by dispersing a conductivity conferring material on the outer circumference of a rod-like or pipe-like member made of aluminum, stainless steel or the like.

One of resin materials such as a urethane resin, thermoplastic elastomer, epichlorohydrin rubber, ethylene-propylene-diene copolymer rubber, silicone rubber, acrylonitrile-butadiene copolymer rubber and polynorbornene rubber may be used alone for the elastic layer, or they may be used as a mixture. The urethane foam is a desirable material.

The urethane foam desirably has a closed-cell structure by dispersing hollow materials such as hollow glass beads or heat-expanded microcapsules in the urethane resin.

The surface of the elastic layer may be further coated with a water-repellent coating layer at a thickness from 5 μm to 100 μm.

DC power source is connected to the charging device 28, and the following roll 31 is electrically connected to a frame ground. The charging device 28 is subjected to coupled movement while putting the intermediate transfer body 12 between the charging device 28 and following roll 31, and a predetermined potential difference is generated at a press point between the charging device and following roll 31.

<Marking Process>

Ink droplets 20A are ejected on the layer of the ink-recipient particles 16 (ink-recipient particle layer 16A) formed on the surface of the intermediate transfer body 12 from the ink-jet recording head 20 based on image signal to form an image. The ink droplets 20A ejected from the ink-jet recording head 20 are jetted to the ink-recipient particle layer 16A. The ink droplets 20A are promptly adsorbed in inter-particle voids (spaces) formed in the ink-recipient particles 16, and recording materials (for example pigments) are trapped on the surface of the ink-recipient particles 16 or in the inter-particle voids constituting the ink-recipient particles 16.

It is desirable that much recording materials (for example pigments) are trapped on the surface of the ink-recipient particle layer 16A. The inter-particle voids (spaces) in the ink-recipient particles 16 exhibit a filter effect, and the recording materials (for example pigments) are trapped on the surface of the ink-recipient particle layer 16A while they are trapped and fixed in the inter-particle voids in the ink-recipient particles 16.

For reliably trapping the recording materials (for example pigments) on the surface of the ink-recipient particle layer 16A and in the inter-particle voids of the ink-recipient particles 16, the recording materials (for example pigments) may be rapidly insolubilized (coagulated) by allowing the ink to react with the ink-recipient particles 16. Specifically, a reaction between the ink and multivalent metal salts or a pH-dependent reaction may be used.

While a line-type ink-jet recording head having a width equal to or larger than the width of the recording medium is desirable, the image may be sequentially formed on the particle layer formed on the intermediate transfer body using a conventional scanning type ink-jet recording head. The ink ejection method of the ink-jet recording head 20 is not restricted so long as the method is capable of ejecting the ink such as a piezoelectric element actuation method and heating element actuation method. A pigment ink is preferably used as the ink while a conventional dye ink may also be used.

When the ink-recipient particles 16 are made to react with the ink, the particles used are treated with an aqueous solution containing a coagulant (for example multivalent metal salts, organic acids and the like) for giving an effect for coagulating the pigment by permitting the ink-recipient particles 16 to react with the ink and dried.

<Transfer Process>

The ink-recipient particle layer 16A, which has received the ink droplets 20A and on which an image is formed, forms the image on a recording medium 8 by transfer of the particle layer on the recording medium. The transfer process may be performed with application of heating and pressurizing. When the recording medium 8, on which the image (the ink-recipient particle layer 16A) has been transferred, is separated from the intermediate transfer body 12 after heating and pressurizing, the recording medium may be separated after the ink-recipient particle layer 16A has been cooled. The cooling method includes spontaneous cooling and forced cooling such as air cooling. The intermediate transfer body 12 suitable for applying these processes is an intermediate transfer belt.

The ink image is desirably formed so that it is protected with the particle layer 16C of the ink-recipient particles 16, by forming the image on the surface layer of the layer of the ink-recipient particles 16 formed on the intermediate transfer body 12 (the recording material (pigment) is trapped on the surface of the ink-recipient particle layer 16A), and by transferring the image on the recording medium 8.

The ink liquid components (solvents and dispersion media) that have received and retained in the layer of the ink-recipient particle 16 are retained in the layer of the ink-recipient particle 16 after transfer and fixing, and are removed by spontaneous drying after fixing process.

<Fixing Process>

While the ink-recipient particle layer 16A transferred onto the recording medium 8 is fixed by applying at least heating and pressurizing with the fixing device 25, it is desirable to substantially simultaneously apply heating and pressurizing.

Glossiness may be controlled by adjusting the surface properties of the ink-recipient particle layer 16A by controlling heating and pressurizing.

The transfer process and fixing process may be separately applied, or may be applied substantially simultaneously.

<Releasing Layer>

It is possible to provide a step for forming the releasing layer 14A such as a silicone oil layer on the surface of the intermediate transfer body 12 before supplying the ink-recipient particles 16.

Examples of the material of the releasing layer include silicone oil, modified silicone oil, fluorinated oil, hydrocarbon oil, mineral oil, plant oil, polyalkyleneglycol, alkyleneglycol ether, alkane diol and molten wax.

The method for providing the releasing layer 14A includes: a method for forming the releasing layer 14A by supplying an oil stored in an oil tank that is mounted inside the apparatus, to an oil coating member, and supplying the oil on the surface of the intermediate transfer body 12 with the oil coating member; and a method for forming the releasing layer 14A on the surface of the intermediate transfer body 12 with a coating member impregnated with the oil.

<Cleaning Process>

A process for cleaning the surface of the intermediate transfer body 12 with the cleaning device 24 is necessary for repeatedly using the intermediate transfer body after refreshing. The cleaning device 24 has a cleaning part and a particle transport/retrieval part (not shown). The ink-recipient particles 16 (residual particles 16D) remaining on the surface of the intermediate transfer body 12 and adhered substances on the intermediate transfer body 12 such as foreign substances other than the particles (for example paper powder of the recording medium 8) are removed by cleaning. The retrieved residual particles 16D may be reused.

<Decharging Process>

The surface of the intermediate transfer body 12 may be discharged using the discharging device 29 before forming the releasing layer 14A.

Other Embodiments

While full color images are recorded on the recording medium 8 by selectively ejecting the ink droplets 20A from the ink-jet recording heads 20 of black, yellow, magenta and cyan colors based on image information in the exemplary embodiment of the invention, the exemplary embodiment of the invention is not restricted to recording of letters and images on the recording medium. The apparatus according to the exemplary embodiment of the invention may also be applied to all industrially used droplet discharge (ejection) apparatus.

EXAMPLES

The invention will be described in detail with reference to examples. However, the invention is by no means restricted to these examples.

Examples 1 to 14, Comparative Examples 1 and 2

An image is formed using a recording apparatus having the same construction as in the first exemplary embodiment to which the releasing agent and ink-recipient particles according to the conditions in Table 1 are applied (see FIGS. 1 to 3, the recording head is for only one color of black), and the image is evaluated. The thickness of the releasing layer (the amount of application of he releasing agent) on the intermediate transfer body 12 using the releasing agent is 1 μm, the thickness of the particle layer on the intermediate transfer body using the ink-recipient particles (the amount of supply of the ink-recipient particles) is 15 μm, and the amount of ejection of the ink is 4 pL per one pixel where the image density is 1,200×1,200 dpi (dpi: number of dots per inch) and the recording medium is OK Topcoat N printing paper (manufactured by Oji Paper Co., Ltd.). The ink-recipient particles and ink used are produced as follows.

-Production of Ink-recipient Particles-

-Ink-recipient Particles A-

- styrene/n-butyl methacrylate/acrylic acid copolymer (polar monomer ratio: 50 mol %): 95 parts by weight
- amorphous polyester resin (polar monomer ratio: 0.5 mol %): 5 parts by weight
- paraffin wax (OX-3215, manufactured by Nippon Seiro Co., Ltd.): 1 pat by weight Above-mentioned materials are mixed with stirring in Henschel mixer to prepare a kneaded material. Then, the material is charged in an extruder for melt-kneading. After cooling the kneaded product, it is pulverized using a jet mill. The pulverized product is classified with an air classifier to obtain particles with a sphere-reduced average diameter of 8 μm.

Composite particles with a sphere-reduced average particle diameter of 10 μm are produced by mixing, with stirring, the following components with 100 parts by weight of the particles obtained above to obtain ink-recipient particles A:

- amorphous silica (AEROSIL TT600, manufactured by Degussa): 1 part by weight amorphous silica (AEROSIL R972, manufactured by Degussa): 1 part by weight -Ink-recipient Particles B-styrene/n-butyl methacrylate/acrylic acid copolymer (polar monomer ratio: 85 mol %): 50 parts by weight styrene/n-butyl methacrylate/acrylic acid copolymer (polar monomer ratio: 50 mol %): 40 parts by weight amorphous polyester resin (polar monomer ratio: 0.5 mol %): 5 parts by weight paraffin wax (OX-3215, manufactured by Nippon Seiro Co., Ltd.): 1 parts by weight Above-mentioned materials are mixed with stirring in Henschel mixer to prepare a kneaded material. Then, the mixed material is charged in en extruder for melt kneading. After cooling the kneaded product obtained, it is pulverized with a jet mill. The pulverized powder is classified with an air classifier to obtain particles with a sphere-reduced average particle diameter of 7 μm.

Composite particles with a sphere-reduced average particle diameter of 8 μm are produced by mixing, with stirring, the following components with 100 parts by weight of the particles obtained above to obtain ink-recipient particles B:

amorphous silica (AEROSIL TT600, manufactured by Degussa): 0.5 parts by weight amorphous silica (AEROSIL R972, manufactured by Degussa): 1.5 parts by weight -Ink-recipient Particle C-styrene/2-ethylhexyl methacrylate/acrylic acid copolymer (polar monomer ratio: 12.5 mol %): 50 parts by weight styrene/n-butyl methacrylate/acrylic acid copolymer (polar monomer ratio: 50 mol %): 40 parts by weight paraffin wax (OX-3215, manufactured by Nippon Seiro Co., Ltd.): 1 part by weight Above-mentioned materials are mixed in Henschel mixer with stirring to prepare a kneaded material. The material is charged in an extruder for melt kneading. After cooling the kneaded product, it is pulverized with a jet mill. The pulverized powder is classified with an air classifier to obtain particles with a sphere-reduced average particle diameter of 8 μm.

Composite particles with a sphere-reduced average particle diameter of 10 μm are produced by mixing, with stirring, the following components with 100 parts by weight of the particles obtained above to obtain ink-recipient particles C:

amorphous silica (AEROSIL TT600, manufactured by Degussa): 1 parts by weight amorphous silica (AEROSIL R972, manufactured by Degussa): 1 parts by weight -Ink-recipient Particles D-

2,2-azobisisobutyronitrile is added to styrene/n-butyl methacrylate/acrylic acid copolymer (polar monomer ratio: 50 mol %) in a weight ratio of 2.5%, and is mixed with an extruder with melting. The powder thus obtained is pulverized with a jet mill, and is classified with an ultrasonic classifier to obtain porous particles with a sphere-reduced average particle diameter of 8 μm.

Composite particles with a sphere-reduced average particle diameter of 10 μm are produced by mixing, with stirring, the following components with 100 parts by weight of the particles obtained above to obtain ink-recipient particles D:

amorphous silica (AEROSIL TT600, manufactured by Degussa): 1.25 parts by weight amorphous silica (AEROSIL R972, manufactured by Degussa): 0.75 parts by weight -Ink-recipient Particles E-amorphous polyester resin (acid value: 5 mgKOH/g): 8 parts by weight styrene/n-butyl methacrylate/acrylic acid copolymer (polar monomer ratio: 50 mil %): 70 parts by weight amorphous silica (AEROSIL OX50, manufactured by Degussa): 20 parts by weight amorphous silica (AEROSIL R972, manufactured by Degussa): 2 parts by weight The materials are mixed in Henschel mixer with stirring to prepare a kneading material, which is then charged in an extruder for melt kneading. After cooling the kneaded product, it is pulverized with a jet mill. The pulverized powder is classified with an ultrasonic sieve to obtain organic/inorganic hybrid particles with a sphere-reduced average particle diameter of 7 μm.

Composite particles with a sphere-reduced average particle diameter of 9 μm are produced by mixing, with stirring, the following components with 100 parts by weight of the particles obtained above to obtain ink-recipient particles E:

amorphous silica (AEROSIL TT600, manufactured by Degussa): 1.25 parts by weight amorphous silica (AEROSIL R972, manufactured by Degussa): 0.75 parts by weight -Production of Ink- After mixing the following ink component with stirring, the mixture is filtered with a membrane filter with a pore size of 5 μm to prepare an ink.

-Ink Component-cyan pigment (C.I. Pig. Blue 15:3): 7.5 parts by weight styrene/acrylic acid (acid value: 150 mg.KOH/g): 2.5 parts by weight butyl carbitol: 2.5 parts by weight diethyleneglycol: 10 parts by weight glycerol: 25 parts by weight nonionic surfactant (acetyleneglycol derivative): 1 part by weight pH control agent, bactericidal agent (PROXEL GXL (S), manufactured by Arch Chemicals Japan, Inc.): small amount pure water: 60 parts The ink obtained has a surface tension of 33 mN/m, a viscosity of 7.2 mP·s, pH 8.8, and volume average particle diameter of 92 nm.

(Evaluation)

-Disturbance of Image (Ghost)-

Disturbance of the image is evaluated as follows. After printing the same image on successive 20 sheets of paper, a different image is printed on one sheet of paper. The quality of the image is evaluated by a sensory test by inspecting whether an image is formed on non-image portions of the last sample print with reference to a limiting standard sample that has been determined in advance. The evaluation criteria are as follows:

a: no image is observed at the non-image portions on a magnified image;

b: while images are observed at the non-image portions on a magnified image, they are not discriminated by visual inspection and within a permissible range;

b-: while images are observed at the non-image portions by visual inspection, they are within a permissible range; and c: images are observed at the non-image portions by visual inspection, and they are out of a permissible range.

-Image Density-

The image density is evaluated as follows. A 100% coverage pattern is printed, and the optical density of the printed part is measured with X-RITE 404 (manufactured by X-Rite, Inc.). The evaluation criteria are as follows:

a: optical density is 1.4 or more;

b: optical density is from 1.35 to less than 1.4;

b-: optical density is from 1.3 to less than 1.35; and c: optical density is less than 1.3

-Feathering-

Feathering is evaluated as follows. 1 dot line pattern is printed, and feathering of the line is evaluated by a sensory test with reference to a limiting standard sample that has been determined in advance. The evaluation criteria are as follows:

a: no feathering is observed at the non-image portions on a magnified image;

b: while feathering is observed at the non-image portions on a magnified image, they are not discriminated by visual inspection and within a permissible range;

c: while feathering is observed at the non-image portions by visual inspection, they are within a permissible range; and d: feathering is observed at the non-image portions by visual inspection, and they are out of a permissible range.

polypropylene wax (melting point 120° C.): 2 parts by weight

Above materials are mixed with stirring with Henschel mixer in a predetermined blend ratio to prepare a kneaded material, which is then charged in an extruder for melt-kneading. After cooling the kneaded product, the product is crushed with a hammer mill to obtain crushed product a1.

styrene/n-butyl acrylate/acrylic acid copolymer (polar monomer ratio: 40 mol %): 95 parts by weight amorphous silica (AEROSIL TT600, manufactured by Degussa, sphere-reduced average particle diameter 0.40 μm): 10 parts by weight crushed product a1: 7 parts by weight Above materials are mixed with stirring in a predetermined blend ratio to prepare a kneaded material, which is then charged in an extruder for melt-kneading. After cooling the kneaded product obtained, it is crushed with a jet mill. The crushed powder is classified with an air classifier to obtain particles a2 (mother particles) with a sphere-reduced average particle diameter of 6 μm.

TABLE 1

| | Releasing agent | | | | | Ink- | Disturbance | | |
|---|---|---|---|---|---|---|---|---|---|
| | Kind | Product name | Manufacturer | SP value | Viscosity (mPa · s) | recipient particle | of image (Ghost) | Image density | feathering |
| Example 1 | Polypropyleneglycol | PF-754 | Asahi Glass Co., Ltd. | 9.4 | 175 | A | a | a | a |
| Example 2 | Polypropyleneglycol | PF-753 | Asahi Glass Co., Ltd. | 9.0 | 84 | B | a | a | a |
| Example 3 | Ethyleneoxide-propyleneoxide copolymer | Blaunon P-172 | Aoki Oil Industrial Co,. Ltd. | 8.8 | 13 | C | a | a | a |
| Example 4 | Ethyleneoxide-propyleneoxide copolymer | Blaunon P-201 | Aoki Oil Industrial Co,. Ltd. | 8.7 | 10 | D | a | a | a |
| Example 5 | Dimethyl silicone oil | KF-96L-0.65cs | Shin-Etsu Silicone | — | 0.4 | E | a | a | a |
| Example 6 | Fluorine-modified silicone oil | X-22-822 | Shin-Etsu Silicone | — | 64 | A | a | a | a |
| Example 7 | Fluorinated oil | DEMNUM S-20 | Daikin Industries, Ltd. | — | 31 | A | a | a | a |
| Example 8 | Nonionic surfactant | EL-1502.2 | Aoki Oil Industrial Co,. Ltd. | 9.7 | 38 | B | a | a | a |
| Example 9 | Polyether-modified silicone oil | KF-352 | Shin-Etsu Silicone | — | 1024 | B | b- | a | b- |
| Example 10 | Dipropyleneglycol monobutylether | | | 10.7 | 13 | C | b | b | b |
| Example 11 | Diethyleneglycol diethylether | | | 8.2 | 8 | C | a | a | a |
| Example 12 | Methyl hydrogen silicone oil | KF-99 | Shin-Etsu Silicone | — | 13 | D | a | a | a |
| Example 13 | Methylstyryl-modified silicone oil | KF-410 | Shin-Etsu Silicone | — | 550 | D | b | a | b- |
| Example 14 | Methylphenyl silicone oil | KF-54 | Shin-Etsu Silicone | — | 240 | D | b | a | a |
| Comparative example 1 | No releasing agent used | | | — | — | A | c | a | a |
| Comparative example 2 | Diethyleneglycol | | | 15 | 14.1 | A | c | b- | c |

The results above show that the ink-recipient particles remain on the intermediate transfer body after transfer of the image onto the recording media, or cleaning is favorable, and images are continuously formed without disturbance of the image in the samples in Examples 1 to 14 as compared with Comparative Examples 1 and 2.

Examples 15 to 28, Comparative Examples 3 to 6

-Production of Particle A-styrene/n-butyl acrylate/acrylic acid copolymer (polar monomer ratio: 10 mol %): 5 parts by weight particle a2 (mother particles): 100 parts by weight amorphous silica (AEROSIL TT600, manufactured by Degussa, sphere-reduced average particle diameter: 0.04 μm): 1 part by weight Above materials are mixed with stirring to a predetermined blend ratio to prepare particle A with a sphere-reduced average particle diameter of 8 μm.

-Production of Particle B— styrene/2-ethylhexyl methacrylate/acrylic acid copolymer (polar monomer ratio: 35 mol %): 95 parts by weight styrene/2-ethylhexyl methacrylate/acrylic acid copolymer polar monomer ratio: 10 mol %): 5 parts by weight
amorphous silica (AEROSIL TT600, manufactured by Degussa, sphere-reduced average particle diameter 0.04 μm): 10 parts by weight
polypropylene wax (melting point 109° C.): 4.5 parts by weight Above materials are mixed with stirring in Henschel mixer in a predetermined blend ratio to prepare a kneaded material, which is charged in an extruder for melt-kneading. After cooling the kneaded product, it is pulverized with a jet-mill. The pulverized powder is classified with an air classifier to obtain particles b1 (mother particles) with a sphere-reduced particle diameter of 8 μm.

particle b1:100 parts by weight
amorphous silica (AEROSIL TT600, manufactured by Degussa, sphere-reduced average particle diameter 0.04 μm): 1 parts by weight Above materials are mixed with stirring in a predetermined blend ratio to prepare particle B with a sphere-reduced particle diameter of 9 μm.

-Particle C-styrene/n-butyl methacrylate/methacrylic acid copolymer (polar monomer ratio: 67 mol %): 95 parts by weight
styrene/n-butyl methacrylate/methacrylic acid copolymer (polar monomer ratio: 15 mol %): 5 parts by weight
amorphous polyester resin: 10 parts by weight
N-hydroxyethyl linoleilarnide (melting point 45° C., ITO-WAX J-400, manufactured by Ito Oil Chemicals Co., Ltd.): 1.5 parts by weight
polypropylene wax (melting point 109° C.): 1.5 parts by weight Above materials are mixed with stirring with Henschel mixer in a predetermined proportion to prepare a kneaded material, which is then charged in an extruder for melt-kneading. After cooling the kneaded product, it is pulverized with a jet mill. The pulverized powder is classified with an air classifier to obtain particle cl (mother particles) with a sphere-reduced particle diameter of 8 μm.

particle c1 (mother particles): 100 parts by weight
zinc stearate: 0.2 parts by weight
amorphous silica (AEROSIL TT600, manufactured by Degussa, sphere-reduced average particle diameter 0.04 μm): 1 part by weight Above materials are mixed with stirring in a predetermined blend ratio to prepare particle C with a sphere-average particle diameter of 10 μm.

-Particle D-styrene/n-butyl methacrylate/acrylic acid copolymer (polar monomer ratio: 12 mol %): 50 parts by weight
microcrystalline wax (HI-MIC-2095 (manufactured by Nippon Seiro Co., Ltd.), melting point 98° C.): 1.2 parts by weight Above materials are mixed with stirring with Henschel mixer in a predetermined proportion to prepare a kneaded material, which is then charged in an extruder for melt-kneading. After cooling the kneaded product, it is crushed with a hammer mill to obtain crushed powder d1.

styrene/2-ethylhexyl methacrylate/maleic acid copolymer (polar monomer ratio: 55 mol %): 50 parts by weight
crushed powder d1: 51.2 parts by weight Above materials are mixed with stirring with Henschel mixer in a predetermined proportion to prepare a kneaded material, which is then charged in an extruder for melt-kneading. After cooling the kneaded product, it is pulverized with a jet mill. The pulverized particle is classified with an air classifier to obtain particle d2 (mother particles) with a sphere-reduced particle diameter of 5 μm.

particle d2 (mother particles): 100 parts by weight
amorphous silica (AEROSIL TT600, manufactured by Degussa, sphere-reduced average particle diameter: 0.04 μm): 1 part by weight Above materials are mixed with stirring in a predetermined bled ratio to prepare particle D with a sphere-reduced average particle diameter of 7 μm.

-Particle E-styrene/n-butyl methacrylate/acrylic acid copolymer (polar monomer ratio: 12.5 mol %): 5 parts by weight
polyethyleneglycol (melting point 45° C., PEG-1500, manufactured by Sanyo Chemical Industries, Ltd.): 2.5 parts by weight
polypropylene wax (melting point 109° C.): 2.5 parts by weight Above materials are mixed with stirring with Henschel mixer in a predetermined proportion to prepare a kneaded material, which is then charged in an extruder for melt-kneading. After cooling the kneaded product, it is crushed with a hammer mill to obtain crushed particle e1.

styrene/n-butyl methacrylate/acrylic acid copolymer (polar monomer ratio: 25 mol %): 95 parts by weight
amorphous polyester resin: 5 parts by weight
crushed particle e1: 10 parts by weight Above materials are mixed with stirring with Henschel mixer in a predetermined proportion to prepare a kneaded material, which is then charged in an extruder for melt-kneading. After cooling the kneaded product, it is pulverized with a jet mill. The pulverized particle is classified with an air classifier to obtain particle e2 (mother particles) with a sphere-reduced particle diameter of 7 μm.

particle e2 (mother particles): 100 parts by weight
amorphous silica (AEROSIL TT600, manufactured by Degussa, sphere-reduced average particle diameter; 0.04 μm): 1 part by weight Above materials are mixed with stirring in a predetermined composition to obtain particle E with a sphere-reduced particle diameter of 10 μm.

-Particle F-styrene/n-butyl methacrylate/methacrylic acid copolymer (polar monomer ratio: 40 mol %): 95 parts by weight
styrene/n-butyl methacrylate/methacrylic acid copolymer (polar monomer ratio: 10 mol %): 5 parts by weight
amorphous polyester resin: 10 parts by weight
vinylether wax (melting point 45° C., V-WAX, manufactured by BASF): 3 parts by weight
microcrystalline wax (HI-MIC-2095, melting point 98° C., manufactured by Nippon Seiro Co., Ltd.): 1.2 parts by weight Above materials are mixed with stirring with a Henschel mixer in a predetermined blend ratio to prepare a kneading material, which is charged in an extruder for melt-kneading. After cooling the kneaded product obtained, it is pulverized with a jet mill. The pulverized powder is classified with an air classifier to obtain particle f1 (mother particles) with a sphere-reduced average particle diameter of 8 μm.

particle f1 (mother particles): 100 parts by weight
amorphous silica (AEROSIL TT600, manufactured by Degussa, sphere-reduced average particle diameter: 0.04 μm): 1 part by weight Above materials are mixed with stirring in a predetermined blend ratio to prepare particle F with a sphere-reduced average particle diameter of 12 μm.

-Particle G-styrene/n-butyl methacrylate/methacrylic acid copolymer (polar monomer ratio: 50 mol %, sphere-reduced average particle diameter; 2 μm): 70 parts by weight amorphous silica (sphere-reduced average particle diameter; 0.6 μm): 40 parts by weight polypropylene wax (melting point: 120° C., sphere-reduced average particle diameter; 3 μm): 2 parts by weight After mixing above particles (30 seconds with a sample mill), composite particles are prepared by intermittently processing with a mechanofusion system. The particle diameter is measured for every intermittent operation, and the particles are taken out of the system when the particle diameter has reached 12 μm to obtain particle g1 (mother particles).

particle g1 (mother particles): 100 parts by weight amorphous silica (AEROSIL TT600, manufactured by Degussa; sphere-reduced average particle diameter; 0.04 μm): 1 part by weight Above particles are mixed with stirring in a predetermined blend ratio to prepare particle G with a sphere-reduced average particle diameter of 12 μm.

-Particle H-styrene/n-butyl methacrylate/methacrylic acid copolymer (polar monomer ratio: 40 mol %): 90 parts by weight styrene/n-butyl methacrylate/methacrylic acid copolymer (polar monomer ratio: 10 mol %): 10 parts by weight amorphous polyester resin: 10 parts by weight vinylether wax (melting point 45° C.; V-WAX, manufactured by BASF): 3 parts by weight microcrystalline wax (HI-MIC-2095, manufactured by Nippon Seiro Co., Ltd., melting point 98° C.): 15 parts by weight Above materials are mixed with stirring with Henschel mixer in a predetermined proportion to prepare a kneading material, which is then charged in an extruder for melt-kneading. After cooling the kneaded product, it is pulverized with a jet mill. The pulverized powder is classified with an air classifier to obtain particle h1 (mother particles) with a sphere-reduced average particle diameter of 8 μm.

particle h1 (mother particles): 100 parts by weight amorphous silica (AEROSIL TT600, manufactured by Degussa, sphere-reduced average particle diameter; 0.04 μm): 1 part by weight Above materials are mixed with stirring to a predetermined blend ratio to prepare particle H with a sphere-reduced average particle diameter of 13 μm.

-Particle I-styrene/n-butyl methacrylate/methacrylic acid copolymer (polar monomer ratio: 40 mol %): 85 parts by weight styrene/n-butyl methacrylate/methacrylic acid copolymer (polar monomer ratio: 10 mol %): 15 parts by weight amorphous polyester resin: 10 parts by weight vinylether wax (melting point 45° C.; V-WAX, manufactured by BASF): 3 parts by weight microcrystalline wax (HI-MIC-2095, manufactured by Nippon Seiro Co., Ltd., melting point 98° C.): 22.5 parts by weight Above materials are mixed with stirring with Henschel mixer in a predetermined proportion to prepare a kneading material, which is then charged in an extruder for melt-kneading. After cooling the kneaded product, it is pulverized with a jet mill. The pulverized powder is classified with an air classifier to obtain particle i1 (mother particles) with a sphere-reduced average particle diameter of 11 μm.

particle i1 (mother particles): 100 parts by weight amorphous silica (AEROSIL TT660, manufactured by Degussa, sphere-reduced average particle diameter: 0.04 μm): 1 part by weight Above materials are mixed with stirring to produce particle I with a sphere-reduced average particle diameter of 15 μm.

-Particle J-hydroxyl apatite (BET specific surface area: 180 $g/m^2$): 100 parts by weight

KF-96-1000 cs (silicone oil that is a liquid at room temperature, manufactured by Shin-Etsu Silicone): 100 parts by weight Above materials are mixed with stirring in a predetermined blend ratio, and the mixture is evacuated to 1,000 Pa or lower. After resuming the pressure to atmospheric pressure, excess oil is removed to obtain a porous material j1 containing the silicone oil.

styrene/n-butyl methacrylate/methacrylic acid copolymer (polar monomer ratio: 40 mol %): 85 parts by weight porous material j1: 15 parts by weight Above materials are mixed with stirring with Henschel mixer in a predetermined proportion to prepare a kneading material, which is then charged in an extruder for melt-kneading. After cooling the kneaded product, it is pulverized with a jet mill. The pulverized powder is classified with an air classifier to obtain particle j2 (mother particles) with a sphere-reduced average particle diameter of 10 μm.

particle j2 (mother particles): 100 parts by weight amorphous silica (AEROSIL TT600, manufactured by Degussa; sphere-reduced average particle diameter: 0.04 μm): 1 part by weight Above materials are mixed with stirring in a predetermined blend ratio to prepare particle J with a sphere-reduced average particle diameter of 15 μm.

-Particle K-styrene/n-butyl methacrylate/acrylic acid copolymer (polar monomer ratio: 50 mol %; sphere-reduced average particle diameter: 2 μm): 50 parts by weight amorphous silica (sphere-reduced average particle diameter: 0.16 μm): 50 parts by weight polypropylene wax (melting point 120° C.; sphere-reduced average particle diameter: 3 μm): 2 parts by weight After mixing above particles with stirring (30 seconds with a sample mill), the mixed particles are intermittently processed with a mechanofusion system to prepare composite particles. The particle diameter is measured for every intermittent operations, and the composite particles are taken out of the system when the sphere-reduced average particle diameter has reached 11 μm to obtain particle k1 (mother particles).

particle k1 (mother particles): 100 parts by weight amorphous silica (AEROSIL TT600, manufactured by Degussa; sphere-reduced average particle diameter: 0.04 μm): 1 part by weight Above materials are mixed with stirring in a predetermined blend ratio to prepare particle K with a sphere-reduced average particle diameter of 12 μm.

-Particle L-styrene/n-butyl methacrylate/methacrylic acid copolymer (polar monomer ratio: 87.5 mol %): 50 parts by weight styrene/n-butyl methacrylate/methacrylic acid copolymer (polar monomer ratio: 12.5 mol %): 50 parts by weight amorphous polyester resin: 10 parts by weight microcrystalline wax (HI-MIC-2095, manufactured by Nippon Seiro Co., Ltd., melting point 98° C.): 3 parts by weight Above materials are mixed with stirring with Henschel mixer in a predetermined proportion to prepare a kneading material, which is then charged in an extruder for melt-kneading. After cooling the kneaded product, it is pulverized with a jet mill. The pulverized powder is classified with an air classifier to obtain particle l1 (mother particles) with a sphere-reduced average particle diameter of 8 μm.

particle l1 (mother particles): 100 parts by weight amorphous silica (AEROSIL TT600, manufactured by Degussa; sphere-reduced average particle diameter; 0.04 μm): 1 part by weight Above materials are mixed with stirring in a predetermined blend ratio to prepare particle L with a sphere-reduced average particle diameter of 13 μm.

-Particle M-styrene/2-ethylhexyl methacrylate/acrylic acid copolymer (polar monomer ratio: 40 mol %): 100 parts by weight amorphous silica (AEROSIL TT600, manufactured by Degussa; sphere-reduced average particle diameter; 0.04 μm): 10 part by weight Above materials are mixed with stirring with Henschel mixer in a predetermined blend ratio to prepare a kneading material, which is then charged in an extruder for melt-kneading. After cooling the kneaded product, it is pulverized with a jet mill. The pulverized powder is classified with an air classifier to obtain particle m1 (mother particles) with a sphere-reduced average particle diameter of 6 μm.

particle m1 (mother particles): 100 parts by weight amorphous silica (AEROSIL TT600, manufactured by Degussa; sphere-reduced average particle diameter; 0.04 μm): 1 part by weight Above materials are mixed with stirring in a predetermined blend ratio to prepare particle M with a sphere-reduced average particle diameter of 8 μm.

-Particle N-styrene/n-butyl methacrylate/methacrylic acid copolymer (polar monomer ratio: 8 mol %): 100 parts by weight amorphous silica (AEROSIL TT600, manufactured by Degussa; sphere-reduced average particle diameter; 0.04 μm): 10 part by weight polyethyleneglycol (melting point; 51° C., PEG-2000, manufactured by Sanyo Chemical Industries, Ltd.): 5 parts by weight Above materials are mixed with stirring with Henschel mixer in a predetermined blend ratio to prepare a kneading material, which is then charged in an extruder for melt-kneading. After cooling the kneaded product, it is pulverized with a jet mill. The pulverized powder is classified with an air classifier to obtain particle n1 (mother particles) with a sphere-reduced average particle diameter of 5 μm.

particle n1 (mother particles): 100 parts by weight amorphous silica (AEROSIL TT600, manufactured by Degussa; sphere-reduced average particle diameter; 0.04 μm): 1 part by weight Above materials are mixed with stirring in a predetermined composition to prepare particle N with a sphere-reduced average particle diameter of 7 μm.

-Particle O-styrene/n-butyl methacrylate/methacrylic acid copolymer (polar monomer ratio: 95 mol %): 100 parts by weight amorphous silica (AEROSIL TT600, manufactured by Degussa; sphere-reduced average particle diameter; 0.04 μm): 10 part by weight polyethyleneglycol (melting point; 51° C., PEG-2000, manufactured by Sanyo Chemical Industries, Ltd.): 5 parts by weight Above materials are mixed with stirring with Henschel mixer in a predetermined blend ratio to prepare a kneading material, which is then charged in an extruder for melt-kneading. After cooling the kneaded product, it is pulverized with a jet mill. The pulverized powder is classified with an air classifier to obtain particle o1 (mother particles) with a sphere-reduced average particle diameter of 10 μm.

particle o1 (mother particle): 100 parts by weight amorphous silica (AEROSIL TT600, manufactured by Degussa; sphere-reduced average particle diameter; 0.04 μm): 1 part by weight Above materials are mixed with stirring in a predetermined blend ratio to prepare particle 0 with a sphere-reduced average particle diameter of 12 μm.

-Particle P-styrene/n-butyl methacrylate/acrylic acid copolymer (polar monomer ratio: 50 mol %): 100 parts by weight amorphous silica (AEROSIL TT600, manufactured by Degussa; sphere-reduced average particle diameter; 0.04 μm): 10 part by weight polypropylene (melting point; 170° C.): 5 parts by weight Above materials are mixed with stirring with Henschel mixer in a predetermined blend ratio to prepare a kneading material, which is then charged in an extruder for melt-kneading. After cooling the kneaded product, it is pulverized with a jet mill. The pulverized powder is classified with an air classifier to obtain particle p1 (mother particles) with a sphere-reduced average particle diameter of 9 μm.

particle p1 (mother particles): 100 parts by weight amorphous silica (AEROSIL TT600, manufactured by Degussa; sphere-reduced average particle diameter; 0.04 μm): 1 part by weight Above materials are mixed with stirring in a predetermined blend ratio to prepare particle P with a sphere-reduced average particle diameter of 12 μm.

-Particle Q-hydroxyl apatite (BET specific surface area: 180 $g/m^2$): 100 parts by weight

DEGNUM S-20 (fluorinated oil that is a liquid at room temperature, manufactured by Daikin Industries, Ltd.): 100 parts by weight Above materials are mixed in a predetermined blend ratio, and the mixture is evacuated to 1,000 Pa or less. After resuming the pressure to the atmospheric pressure, excess oil is removed to obtain porous material q1 containing the fluorinated oil.

styrene/n-butyl methacrylate/methacrylic acid copolymer (polar monomer ratio: 40 mol %): 85 parts by weight porous material q1: 15 parts by weight Above materials are mixed with stirring with Henschel mixer in a predetermined blend ratio to prepare a kneading material, which is then charged in an extruder for melt-kneading. After cooling the kneaded product, it is pulverized with ajet mill. The pulverized powder is classified with an air classifier to obtain particle q2 (mother particles) with a sphere-reduced average particle diameter of 10 μm.

particle q2 (mother particles): 100 parts by weight amorphous silica (AEROSIL TT600, manufactured by Degussa; sphere-reduced average particle diameter; 0.04 μm): 1 part by weight Above materials are mixed with stirring in a predetermined blend ratio to prepare particle Q with a sphere-reduced average particle diameter of 15 μm.

-Particle R-hydroxyl apatite (BET specific surface area: 180 $g/m^2$): 100 parts by weight

PF 753 (an oil that is a liquid at room temperature, manufactured by Asahi Glass Co., Ltd., SP=8.8): 100 parts by weight Above materials are mixed in a predetermined blend ratio, and the mixture is evacuated to 1,000 Pa or less. After resuming the pressure to the atmospheric pressure, excess oil is removed to prepare porous material r1 containing an organic material (oil) with a SP value of 11 or less.

styrene/n-butyl methacrylate/methacrylic acid copolymer (polar monomer ratio: 40 mol %): 85 parts by weight porous material r1: 15 parts by weight.

Above materials are mixed with stirring with Henschel mixer in a predetermined blend ratio to prepare a kneading material, which is then charged in an extruder for melt-kneading. After cooling the kneaded product, it is pulverized with a jet mill. The pulverized powder is classified with an air classifier to obtain particle r2 (mother particles) with a sphere-reduced average particle diameter of 10 μm.

particle r2 (mother particles): 100 parts by weight amorphous silica (AEROSIL TT600, manufactured by Degussa; sphere-reduced average particle diameter; 0.04 μm): 1 part by weight Above materials are mixed with stirring in a predetermined blend ratio to prepare particle R with a sphere-reduced average particle diameter of 15 μm.

Characteristics of particles A to Q prepared above are summarized in Table 2.

-Ink Component-cyan pigment (C.I. Pig. Blue 15:3): 7.5 parts styrene/acrylic acid (acid value 150 mg.KOH/g): 2.5 parts butyl carbitol: 2.5 parts diethyleneglycol: 10 parts glycerol: 25 parts nonionic surfactant (acetyleneglycol derivative): 1 part pH control agent, bactericidal agent (PROXEL GXL (S), manufactured by Arch Chemicals Japan, Inc.): small amount pure water: 60 parts The ink obtained has a surface tension of 33 mN/N, a viscosity of 7.2 Pa·s, pH of 8.8 and volume average particle diameter of 92 nm.

The image is formed as follows. Particles are sprayed on an intermediate medium using a cake printer. While the mount of spray of the particles differs depending on the kind of the particle, it is in the range from 5 to 12 g/m$^2$. The ink (3 pL) is applied on the intermediate medium on which the particles have been sprayed at an image area ratio of 1,200×1,200 dots per 1 square inch to form a predetermined printing pattern. OK Topcoat N printing paper (manufactured by Oji Paper Co., Ltd.) is pressed into contact with the image thus obtained at 3×10$^5$ Pa, and the image is heated at 90° C. for 1 minute.

TABLE 2

| | | Hydrophilic organic resin | | Water-repellent organic material | | |
|---|---|---|---|---|---|---|
| | Mother particle Particle configuration | Polar monomer ratio (mol %) | Mass ratio of hydrophilic organic resin (%) | Melting point (° C.) | Mass ratio of water-repellent organic material (% by weight) | Particle diameter (μm) |
| Particle A | | 40/10 | 89 | 120 | 1.8 | 8 |
| Particle B | | 35/10 | 87 | 109 | 3.9 | 9 |
| Particle C | | 67/15 | 88 | 45/109 | 2.7 | 10 |
| Particle D | | 12/55 | 98.8 | 98 | 1.2 | 7 |
| Particle E | | 12.5/25 | 91 | 45/109 | 4.5 | 10 |
| Particle F | | 40/10 | 88 | 45/98 | 3.7 | 12 |
| Particle G | Organic-inorganic composite particle | 50 | 63 | 120 | 1.8 | 12 |
| Particle H | | 40/10 | 78 | 45/98 | 14 | 13 |
| Particle I | | 40/10 | 74 | 45/98 | 19 | 15 |
| Particle J | | 40 | 85 | <23 | 7.5 | 15 |
| Particle K | Organic-inorganic composite particle | 50 | 49 | 120 | 1.96 | 12 |
| Particle L | | 87.5/12.5 | 80 | 98 | 2.7 | 13 |
| Particle Q | | 40 | 85 | <23 | 7.5 | 15 |
| Particle R | | 40 | 85 | <23 | 7.5 | 15 |
| Particle M | | 40 | 91 | — | — | 8 |
| Particle N | | 8 | (87) | 51 | 4.3 | 7 |
| Particle O | | 95 | (87) | 51 | 4.3 | 12 |
| Particle P | | 50 | 87 | 170 | (4.3) | 12 |

"—" in the table shows no blending ( ) denotes the weight ratio of the content of the material that does not satisfy the essential element of the invention The following items are evaluated using ink A utilizing above-mentioned particles as the ink-recipient particles. The results are shown in Table 3.

-Ink A-

The ink is prepared by mixing the following ink components, and by filtering the mixture using a membrane filter with a pore size of 5 μm after stirring the mixture.

-Disturbance of Image-

After printing the same image on successive 20 sheets of paper, a different image is printed on one sheet of paper. Non-image portions of the last print sample are observed directly by visual inspection and on a magnified image under an optical microscope to evaluate disturbance of the image.

The evaluation criteria are as follows:

a: no disturbance of the image are observed on the magnified image;

b: while disturbance of the image is observed on the magnified image, it is not distinguishable by visual inspection and is within a permissible range;

c: while disturbance of the image is observed on the magnified image and partially distinguishable by visual inspection, it is within a permissible range;

d: disturbance of the entire image is distinguishable by visual inspection, it is within a permissible range; and e: disturbance of the image is distinguishable by visual inspection, and is out of the permissible range.

-Optical Density-

The optical density is evaluated as follows. A 100% coverage pattern is formed as the printing pattern, and the optical density of the image obtained is measured with X-RITE 404 (manufactured by X-Rite, Inc.).

The evaluation criteria are as follows:

a: the optical density is 1.4 or more;

b: the optical density is from 1.3 to less than 1.4; and c: the optical density is less than 1.3.

-Feathering-

Feathering is evaluated as follows. A 1-dot line pattern is printed as a printing pattern, and feathering is evaluated directly by visual inspection and as a magnified image under an optical microscope.

The evaluation criteria are as follows:

a: no feathering is observed on partial images on the magnified image;

b: while feathering may be observed at a high magnification ratio of partial images on the magnified image, it is indistinguishable by visual inspection and is within a permissible range;

c: while feathering may be observed at a low magnification ratio of partial images on the magnified image, it is indistinguishable by visual inspection and is within a permissible range;

d: while feathering is observed in the image portion by visual inspection, it is within a permissible range; and e: feathering is observed on the image portion by visual inspection, and it is out of the permissible range due to severe feathering.

-Storage Stability-

Storage stability is evaluated as follows. Ink-recipient particles stored at 23° C. and 75% RH for 24 hours are used for evaluation of disturbance of the image.

The evaluation criteria are as follows:

a: no disturbance is observed on a magnified image;

b: while disturbance of the image is observed on a magnified image, it is not distinguishable by visual inspection and is within a permissible range; and c: disturbance of the image is distinguishable by visual inspection, and is out of the permissible range.

TABLE 3

| | Particle | Disturbance of image | Optical density | Feathering | Storage stability |
|---|---|---|---|---|---|
| Example 15 | Particle A | b | a | a | a |
| Example 16 | Particle B | a | a | a | a |
| Example 17 | Particle C | a | a | a | a |
| Example 18 | Particle D | b | a | a | b |
| Example 19 | Particle E | b | b | b | a |
| Example 20 | Particle F | a | a | a | a |
| Example 21 | Particle G | c | b | b | a |
| Example 22 | Particle H | b | b | b | a |
| Example 23 | Particle I | d | b | d | a |
| Example 24 | Particle J | b | b | b | a |
| Example 25 | Particle K | c | b | c | a |

TABLE 3-continued

| | Particle | Disturbance of image | Optical density | Feathering | Storage stability |
|---|---|---|---|---|---|
| Example 26 | Particle L | b | a | b | a |
| Example 27 | Particle Q | b | b | b | a |
| Example 28 | Particle R | b | b | b | a |
| Comparative example 3 | Particle M | e | b | e | a |
| Comparative example 4 | Particle N | e | c | e | a |
| Comparative example 5 | Particle O | e | b | e | c |
| Comparative example 6 | Particle P | e | b | e | b |

Table 3 shows that the image is formed without disturbance of the fixed image such as offset in Examples 15 to 28 as compared with Comparative Examples 3 to 6.

The foregoing description of the embodiments of the present invention has been provided for the purposes of illustration and description. It is not intended to be exhaustive or to limit the invention to the precise forms disclosed. Obviously, many modifications and variations will be apps rent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. A recording apparatus comprising:

an intermediate transfer body;

a releasing agent supply device that supplies a releasing agent onto the intermediate transfer body;

a particle supply device that supplies hydrophilic ink-recipient particles that receive an ink, onto the releasing agent supplied onto the intermediate transfer body;

an ink ejection device that ejects the ink onto the ink-recipient particles supplied onto the intermediate transfer body; and a transfer device that transfers the ink-recipient particles that received the ink, onto a recording medium from the intermediate transfer body, the releasing agent comprising at least one selected from the group consisting of a silicone oil, a fluorinated oil and an organic compound having a solubility parameter (SP value) of about 11 or less.

2. The recording apparatus of claim 1, wherein the silicone oil is at least one selected from the group consisting of a straight silicone oil and a modified silicone oil.

3. The recording apparatus of claim 2, wherein the straight silicone oil is at least one selected from the group consisting of dimethyl silicone oil and methyl hydrogen silicone oil.

4. The recording apparatus of claim 1, wherein the solubility parameter (SP value) of the organic compound is from about 8 to about 10.

5. The recording apparatus of claim 1, wherein the viscosity of the releasing agent is from about 5 mP·s to about 200 mP·s.

6. The recording apparatus of claim 1, wherein the ink-recipient particles comprise at least an organic resin having a polar monomer at a ratio of from about 10 mol % to about 90 mol % relative to all monomer components thereof.

7. A recording method comprising:

supplying a releasing agent onto an intermediate transfer body;

supplying hydrophilic ink-recipient particles that receive an ink onto the releasing agent supplied onto the intermediate transfer body;

ejecting the ink onto the ink-recipient particles supplied onto the intermediate transfer body; and transferring the ink-recipient particles that received the ink, onto a recording medium from the intermediate transfer body, the releasing agent comprising at least one selected from the group consisting of a silicone oil, a fluorinated oil and an organic compound having a solubility parameter (SP value) of about 11 or less.

* * * * *